US012259176B2

(12) United States Patent
Hong et al.

(10) Patent No.: US 12,259,176 B2
(45) **Date of Patent: *Mar. 25, 2025**

(54) REFRIGERATOR

(71) Applicant: LG Electronics Inc., Seoul (KR)

(72) Inventors: Euddeum Hong, Seoul (KR); Sangho Jung, Seoul (KR); Daekil Kang, Seoul (KR); Jiwook Moon, Seoul (KR); Gyunghyun Park, Seoul (KR)

(73) Assignee: LG Electronics Inc., Seoul (KR)

( * ) Notice: Subject to any disclaimer, the term of this patent is extended or adjusted under 35 U.S.C. 154(b) by 179 days.

This patent is subject to a terminal disclaimer.

(21) Appl. No.: 17/802,624

(22) PCT Filed: Feb. 26, 2021

(86) PCT No.: PCT/KR2021/002481
§ 371 (c)(1),
(2) Date: Aug. 26, 2022

(87) PCT Pub. No.: WO2021/172948
PCT Pub. Date: Sep. 2, 2021

(65) Prior Publication Data

US 2023/0108392 A1 Apr. 6, 2023

(30) Foreign Application Priority Data

Feb. 26, 2020 (KR) ..... 10-2020-0023351
Jun. 17, 2020 (KR) ..... 10-2020-0073939
Sep. 2, 2020 (KR) ..... 10-2020-0111954

(51) Int. Cl.
*F25D 23/02* (2006.01)

(52) U.S. Cl.
CPC ..... *F25D 23/028* (2013.01); *F25D 2400/18* (2013.01)

(58) Field of Classification Search
CPC ... A47B 2096/208; A47B 96/20; F25D 23/02; F25D 23/028; F25D 2323/02; F25D 2400/18
See application file for complete search history.

(56) References Cited

U.S. PATENT DOCUMENTS 7,770,985 B2 8/2010 Davis et al.
7,954,345 B2 6/2011 Park
(Continued)

FOREIGN PATENT DOCUMENTS

CN 101676635 3/2010
CN 110382981 10/2019
(Continued)

OTHER PUBLICATIONS

Office Action in Australian Appln. No. 2021204021, mailed on Mar. 29, 2023, 4 pages.
(Continued)

*Primary Examiner* — Andrew Roersma
(74) *Attorney, Agent, or Firm* — Fish & Richardson P.C.

(57) ABSTRACT

A refrigerator of the present embodiment comprises: a cabinet for forming a storage space; and a door for opening/closing the storage space. The door comprises: a frame assembly in which a thermal insulation material is filled; and a panel assembly which is separably-coupled to the frame assembly and forms the front exterior of the door, wherein, in a state where the lower side of the panel assembly is supported on the lower side of the frame assembly, the upper side of the panel assembly is fixed to the upper side of the frame assembly.

20 Claims, 60 Drawing Sheets

(56) References Cited

U.S. PATENT DOCUMENTS

| | | | | |
|---|---|---|---|---|
| 8,789,900 | B2 | 7/2014 | Liable et al. | |
| 11,774,164 | B2 * | 10/2023 | Moon | F25D 23/063 312/116 |
| 2007/0188059 | A1 | 8/2007 | Davis et al. | |
| 2008/0042537 | A1 | 2/2008 | Kim et al. | |
| 2010/0026155 | A1 | 2/2010 | Yun | |
| 2011/0025173 | A1 | 2/2011 | Ciyanoglu et al. | |
| 2013/0026900 | A1 * | 1/2013 | Oh | F25D 23/028 312/401 |
| 2016/0341468 | A1 | 11/2016 | Joo et al. | |
| 2017/0370631 | A1 | 12/2017 | Kim et al. | |
| 2018/0172337 | A1 | 6/2018 | Choi et al. | |
| 2019/0257571 | A1 | 8/2019 | Park et al. | |
| 2020/0326119 | A1 * | 10/2020 | Lee | F25D 23/028 |
| 2021/0055038 | A1 * | 2/2021 | Lee | F25D 23/126 |
| 2021/0071933 | A1 | 3/2021 | Lee et al. | |
| 2021/0318056 | A1 * | 10/2021 | Park | F25D 23/02 |
| 2023/0012438 | A1 * | 1/2023 | Hong | F25D 23/028 |
| 2023/0408170 | A1 * | 12/2023 | Moon | F25D 23/02 |

FOREIGN PATENT DOCUMENTS

| | | | | |
|---|---|---|---|---|
| CN | 110542267 | | 12/2019 | |
| EP | 0647821 | A1 * | 4/1995 | F25D 23/02 |
| EP | 1650512 | | 4/2006 | |
| EP | 3378359 | | 9/2018 | |
| EP | 3505853 | | 7/2019 | |
| EP | 3809072 | | 4/2021 | |
| EP | 3809076 | | 4/2021 | |
| GB | 2050814 | | 1/1981 | |
| JP | S44-24857 | | 10/1969 | |
| JP | H0791816 | | 4/1995 | |
| JP | H08-35761 | | 2/1996 | |
| JP | 6139274 | | 5/2017 | |
| JP | 6460832 | | 1/2019 | |
| KR | 20000019775 | | 11/2000 | |
| KR | 10200690134520 | A * | 12/2006 | F25D 23/02 |
| KR | 10-2010-0057246 | | 5/2010 | |
| KR | 10-2018-0022232 | | 3/2018 | |
| KR | 20180106734 | | 10/2018 | |
| WO | WO 2006/120082 | | 11/2006 | |
| WO | WO 2011/026817 | | 3/2011 | |
| WO | WO2014024429 | | 2/2014 | |
| WO | WO 2020/213861 | | 10/2020 | |
| WO | WO 2021/112658 | | 6/2021 | |
| WO | WO-2021112658 | A1 * | 6/2021 | F25D 23/02 |

OTHER PUBLICATIONS

Office Action in Chinese Appln. No. 202180016561.9, mailed on Apr. 29, 2023, 20 pages (with English machine translation).

Office Action in U.S. Appl. No. 17/350,440, dated Feb. 7, 2023, 13 pages.

Extended European Search Report in European Appln. No. 21760390.1, mailed on Mar. 19, 2024, 13 pages.

Extended European Search Report in European Appln. No. 21761471.8, mailed on Mar. 5, 2024, 7 pages.

Office Action in U.S. Appl. No. 18/238,354, mailed on Mar. 4, 2024, 15 pages.

* cited by examiner

REFRIGERATOR

CROSS-REFERENCE TO RELATED APPLICATIONS

This application is a National Stage application under 35 U.S.C. § 371 of International Application No. PCT/KR2021/002481, filed on Feb. 26, 2021, which claims the benefit of Korean Patent Application No. 10-2020-0023351, filed on Feb. 26, 2020, Korean Patent Application No. 10-2020-0073939, filed on Jun. 17, 2020, and Korean Patent Application No. 10-2020-0111954, filed on Sep. 2, 2020. The disclosures of the prior applications are incorporated by reference in their entirety.

TECHNICAL FIELD

The present invention relates to a refrigerator.

BACKGROUND ART

In general, refrigerators are home appliances for storing foods at low temperature in an inner storage space covered by a refrigerator door. Here, the inside of the storage space is cooled using cool air that is generated by being heat-exchanged with a refrigerant circulated in a refrigeration cycle to store the foods in an optimal state.

Such refrigerators tend to increase more and more in size and provide multi-functions due to the trends of change of dietary life and high quality, and accordingly, refrigerators provided with various structures and convenience devices in consideration of user convenience are brought to the market.

Structures that vary in outer appearance of a front surface of a door of the refrigerator are proposed to harmonize with an environment, in which the refrigerator is disposed, or surrounding furniture or home appliances.

A structure in which a decor panel defining the outer appearance of the front surface of the door of the refrigerator is mounted is disclosed in U.S. Pat. No. 8,789,900. A structure, in which a plurality of bridges for restriction are disposed at both sides of the decoration panel, and brackets inserted into both ends of the door are coupled to the bridge so that the decoration panel is mounted, is disclosed.

However, in the above-described technology according to the related art, since the plurality of brackets have to be mounted on the outside so as to mount the panel, productivity may be deteriorated, and an accurate mounting position may not be maintained according to workability of a worker. Particularly, there is a problem of deteriorating the outer appearance of the structure in which the brackets for the coupling are exposed to both the sides of the door.

A structure in which a glass panel defining the outer appearance of the front surface of the door of the refrigerator is mounted is disclosed in Japanese Patent No. 6460832. A structure in which a plurality of recessed grooves are defined in a front surface portion of a door body, and an installation portion bent in multiple stages is disposed on a rear surface of the glass panel, and the installation portion is inserted into each of the recessed grooves to mount the glass panel, is disclosed.

However, in such a technology according to the related art, it is not easy to accurately couple a plurality of installation portions, which are disposed on the rear surface of the glass panel, to the grooves of the door body, and thus, there is a limitation in that workability and productivity are deteriorated.

DISCLOSURE OF THE INVENTION

Technical Problem

An embodiment of the present invention provides a refrigerator having an improved outer appearance by preventing a structure that is configured to mount a panel assembly from being exposed to the outside.

Alternatively or additionally, an embodiment of the present invention provides a refrigerator in which a firmly mounted state of a panel assembly is maintained.

Alternatively or additionally, an embodiment of the present invention provides a refrigerator in which a panel assembly is easily mounted and detached.

Technical Solution

A refrigerator according to one aspect may include: a cabinet configured to define a storage space; and a door configured to open and close the storage space.

The door may include: a frame assembly in which an insulator is filled; and a panel assembly detachably coupled to the frame assembly and configured to define an outer appearance of a front surface of the door.

In a state in which a lower portion of the panel assembly is supported on a lower portion of the frame assembly, an upper portion of the panel assembly may be fixed to an upper portion of the frame assembly.

The frame assembly may include: a front frame; an upper frame connected to an upper portion of the front frame; and a lower frame connected to a lower portion of the front frame.

The panel assembly may include: a panel; an upper bracket provided on an upper portion of a rear surface of the panel; and a lower bracket provided on a lower portion of the rear surface of the panel.

The lower bracket may be coupled to the lower frame, and the upper bracket may be coupled to the upper frame.

The lower frame may include: a support end configured to support the panel assembly; and a lower protrusion extending upward from the support end and inserted into the lower bracket in a state in which the panel assembly is seated on the support end.

A lower insertion portion into which the lower protrusion is inserted may be provided in the lower bracket.

The lower frame may further include a lower coupling boss to which a screw passing through the support end is coupled.

The lower bracket may include an insertion portion having a bent shape, and the lower frame may include a recessed portion into which the insertion portion is inserted.

The insertion portion may include: a first extension portion extending backward from the rear surface of the panel; and a second extension portion bent from the first extension portion to extend downward.

The recessed portion may include: a first recessed portion extending backward from a front surface of the lower frame; and a second recessed portion bent from the first recessed portion to extend downward.

The first extension portion may be disposed in the first recessed portion, and the second extension portion may be disposed in the second recessed portion.

The upper bracket may include: an upper adhesion portion adhering to the rear surface of the panel; and an upper coupling portion protruding backward from the upper adhesion portion.

The upper frame may include an upper coupling portion configured to accommodate the upper coupling protrusion. An upper coupling member may pass through the upper coupling portion so as to be coupled to the upper coupling protrusion.

A protrusion inclined surface that is inclinedly provided may be disposed on a top surface of the upper coupling protrusion, and a screw hole to which the upper coupling member is coupled may be defined in the protrusion inclined surface.

An evacuation portion that is further inclined than the protrusion inclined surface to prevent the panel assembly from interfering with the upper frame when the panel assembly is mounted may be defined in a rear end of the top surface of the upper coupling protrusion.

The upper frame may have a recessed space with an opened top surface, and the upper coupling portion may be exposed to an inside of the recessed space so that the upper coupling member is coupled through the recessed space.

A coupling portion inclined surface that has an inclination corresponding to the protrusion inclined surface and is in contact with the protrusion inclined surface may be disposed on the upper coupling portion. The upper coupling member may be coupled to sequentially pass through the coupling portion inclined surface and the protrusion inclined surface.

The upper frame may include a cover configured to open and close the recessed space.

The upper bracket may include: an adhesion portion extending along an end of the panel; and an insertion protrusion provided in plurality at a regular interval along the adhesion portion, the insertion protrusion protruding to a front surface of the upper frame.

The upper frame may be configured to define a circumferential surface of the door, and an insertion hole into which the insertion protrusion is inserted may be defined in a front surface of the upper frame.

The upper frame may include a recessed portion recessed from an outer surface thereof to communicate with the insertion hole. The insertion protrusion may pass through the insertion hole so as to be inserted into the recessed portion.

The upper frame may include a cover configured to shield the recessed portion. A restriction protrusion extending to an inside of the recessed portion so as to be restricted with the insertion protrusion may be disposed on the cover.

A through-hole that is penetrated vertically may be defined in the insertion protrusion, and the restriction protrusion may pass through the through-hole when the cover is mounted on the upper frame.

A coupling protrusion to which a screw passing through an inside of the recessed portion is coupled may be disposed on the adhesion portion.

The upper bracket may include a seating portion protruding from the panel and seated on the upper frame. The upper frame may include a support portion on which the seating portion is seated.

In a state in which the seating portion is seated on the support portion, the seating portion and the support portion may be fixed by a screw.

The support portion may include: a first surface defined by being recessed from a top surface of the upper frame; and a second surface defined by being recessed from a front surface of the upper frame. The seating portion may be seated on the first surface.

A refrigerator according to another aspect may include: a cabinet configured to define a storage space; and a door configured to open and close the storage space, wherein the door includes: a door body in which an insulator is filled and of which outer appearances of top and bottom surfaces are defined by an upper cap decoration and a lower cap decor; and a panel assembly provided on a front surface of the door body to define an outer appearance of a front surface of the door, wherein, in a lower end of the panel assembly, a lower protrusion protruding upward from the lower cap decoration is inserted to be restricted, and in an upper end of the panel assembly, an upper coupling member coupled by passing through the upper cap decoration is coupled to be mounted on the body.

The panel assembly includes: a plate-shaped panel configured to define an outer appearance of a front surface of the door; an upper bracket which is disposed along an upper end of a rear surface of the panel and to which the coupling member is coupled; and a lower bracket disposed along a lower end of the rear surface of the panel. Here, an insertion portion into which the lower protrusion is inserted may be defined in a bottom surface of the lower bracket.

The panel may be made of a tempered glass material.

The panel may be made of a metal material, and a bent portion that extends backward may be disposed around the panel.

A bent portion opening communicating with the insertion portion may be defined in the bent portion disposed along the lower end of the panel among the bent portions, and the lower protrusion may be inserted into the insertion portion by passing through the bent portion opening.

A lower coupling boss to which a lower coupling member sequentially passing through the lower cap decoration and the bent portion is coupled may be disposed on a bottom surface of the lower bracket.

The bent portion disposed along the upper end of the panel among the bent portions may include a first bent portion bent backward from the upper end of the front surface of the panel and a second bent portion bent downward from a rear end of the first bent portion.

The upper cap decoration and the lower cap decoration may include an upper support end and a lower support end, which protrude forward to face the bent portions disposed on the upper and lower ends of the panel, and the lower protrusion may be disposed along the lower support end.

The upper bracket may include: an upper adhesion portion that is in contact with the rear surface of the panel; and an upper coupling protrusion which protrudes backward from the upper adhesion portion and to which an upper coupling member is coupled.

An upper rib further protruding than a rear end of the bent portion may be disposed on an upper end of the upper adhesion portion.

The upper coupling protrusion may extend to be inclined backward and upward, and a screw hole to which the upper coupling member is coupled may be defined in an upper end of the upper coupling protrusion.

A protrusion inclined surface having an inclination that gradually decreases backward may be disposed on a top surface of the upper coupling protrusion, and the screw hole may be defined in the protrusion inclined surface.

An evacuation portion that is further inclined than the protrusion inclined surface to prevent the panel assembly from interfering with the upper cap decoration when the panel assembly is mounted may be defined in a rear end of the top surface of the upper coupling protrusion.

An upper coupling portion through which the upper coupling member passes may be disposed on the front surface of the upper cap decoration facing the upper coupling protrusion.

The upper cap decoration may define a recessed space having an opened top surface, and the upper coupling portion may be exposed to the inside of the recessed space so that the upper coupling member is coupled through the recessed space.

A decoration cover configured to open and close the recessed space may be disposed on the upper cap decor.

The upper coupling portion may be recessed backward to accommodate the upper coupling protrusion and protrudes to the inside of the recessed space.

A coupling portion inclined surface having an inclination corresponding to the protrusion inclined surface and being in contact with the protrusion inclined surface when the panel assembly is mounted may be disposed on the upper coupling portion, and the upper coupling member may be coupled to sequentially pass through the coupling portion inclined surface and the protrusion inclined surface.

When the panel assembly is mounted on the door body so that the lower protrusion is inserted into the insertion portion, the protrusion inclined surface and the coupling portion inclined surface may be in contact with each other.

The door body may be made of a steel material and include a front plate spaced apart from the rear surface of the panel to define the front surface of the door body, and a magnet for attaching the panel assembly to the front plate by using magnetic force may be provided on the rear surface of the panel.

A refrigerator according to further another aspect may include: a cabinet configured to define a storage space; and a door configured to open and close the cabinet, wherein the door may include: a door liner configured to define a rear surface of the door; a body plate spaced forward from the door liner; a first cap decoration coupled to the door liner and one end of the body plate; a second cap decoration coupled to the door liner and the other end of the body plate at a position facing the first cap decor; an insulator filled into a space defined by coupling of the door liner, the body plate, and the cap decors; and a panel assembly disposed detachably in front of the body plate, wherein the panel assembly may include: a panel configured to define an outer appearance of a front surface of the door; a first bracket protruding from a rear surface of the panel and inserted into the first cap decoration so as to be restricted; and a second bracket provided on the rear surface of the panel and supported by the second cap decor.

The first bracket may include: an adhesion portion extending along an end of the panel; and an insertion protrusion provided in plurality at a regular interval along the adhesion portion, the insertion protrusion protruding to a front surface of the first cap decor.

The first cap decoration may be configured to define a circumferential surface of the door, and an insertion hole into which the insertion protrusion is inserted may be defined in a front surface of the first cap decoration.

The first cap decoration may include a decoration recessed portion recessed from an outer surface thereof to communicate with the insertion hole, and the insertion protrusion may pass through the insertion hole so as to be inserted into the decoration recessed portion.

A decoration cover configured to shield the decoration recessed portion may be provided on the first cap decoration, and a restriction protrusion extending to the inside of the decoration recessed portion so as to be restricted with the insertion protrusion may be disposed on the decoration cover.

A through-hole that is penetrated vertically may be defined in the insertion protrusion, and the restriction protrusion may extend to pass through the through-hole when the decoration cover is mounted on the first cap decor.

A protrusion inclination surface having a width that gradually decreases in an extension direction thereof may be disposed on the restriction protrusion, and when the restriction protrusion is inserted, the panel assembly may be in close contact toward the body plate by contact between the protrusion inclination surface and the through-hole.

The refrigerator may further include the decoration coupling portion which is configured to support the decoration cover at a lower side and to which a screw passing through the decoration cover is coupled is further disposed inside the recessed portion.

The insertion protrusion may have a bottom surface provided in a planar shape to be in contact with a lower end of the insertion hole and a top surface with an inclination that is lower as the insertion protrusion extends in the protruding direction.

A coupling protrusion to which a screw passing through an inside of the recessed portion may be disposed on the adhesion portion.

The inside of the decoration recessed portion may be provided as a space that is partitioned to prevent the insulator from being permeated.

The first cap decoration may be provided with a first support end disposed along an end of the first cap decoration and protruding forward to support an end of the panel.

A plate coupling portion coupled to an upper end of the body plate may be disposed on the front surface of the first cap decoration, and the insertion hole may be defined above the plate mounting portion.

The second cap decoration is provided with a second support end disposed along an end of the second cap decoration and protruding forward to support an end of the panel, and a plurality of restriction portions hooked and restricted to the second bracket may protrude along the second support end.

A bracket insertion portion which is opened along an end of the second bracket and into which the restriction protrusion is inserted may be provided, and when a lower end of the panel is mounted to be in contact with the second support end, the restriction portion may be disposed inside the bracket insertion portion.

A pair of side frames configured to connect both ends of the first cap decoration and the second cap decoration to each other so as to define both surfaces of the door, and a space in which the panel assembly is accommodated may be defined by the first cap decoration, the second cap decoration, and front ends of the pair of side frames, wherein a front surface of the panel may protrude further forward than the first cap decoration, the second cap decoration, and the pair of side frames.

The body plate may be made of a steel material, and the body plate may be attached to each of both left and right ends of the rear surface of the panel.

The panel may be made of a metal material, and a bent portion that is bent backward may be disposed along a circumference of the panel.

A panel seating portion on which the first bracket and the second bracket are mounted may be disposed on a circumference of the panel.

The panel may be made of a glass or FENIX material.

A door of a refrigerator according to the present invention for implementing the above objects may include at least one or more fixing portions fixed to a plurality of frames to easily couple/separate a front panel.

In addition, when the front panel is coupled, the front panel may be hook-coupled through pressing, and when the front panel is separated, the hook coupling may be easily released through slidable movement.

A door of a refrigerator according to further another aspect may include: a front frame, a front panel detachably provided in front of the front frame, a hook provided on the front panel and disposed between a front surface of the front frame and a rear surface of the front panel, and a hook coupling portion recessed in the front frame. The hook coupling portion may include: a recessed portion including a plurality of side surfaces, which is recessed from a front surface of the front frame; and an inclined protrusion protruding at an inclination from both side surfaces of the recessed portion.

The inclined protrusion may be provided in pair that are contact with a bottom surface of the recessed portion and are closer to each other backward from a front side.

The hook may include: a plate attached to a rear surface of the front panel, and a hook member provided to be biased to the plate.

The hook member may include: an extension portion extending from the plate, and a hook portion bent from the extension portion to extend in directions that are away from each other.

The hook portion may move along the inclination of the inclined protrusion and be locked by pressing.

The locking between the hook portion and the inclined protrusion may be released by the slidable movement of the front panel.

The front frame may further include a front plate including a plurality of holes, and the hook coupling portion may further include an adhesion portion configured to surround the hole and attached to a rear surface of the front plate.

The refrigerator may further include an upper frame coupled to an upper portion of the front frame and a lower frame coupled to a lower portion of the front frame, wherein a fixing portion coupled to at least one of the upper frame or the lower frame may be provided on the front panel.

The upper frame may include a panel support portion on which the fixing portion is seated, wherein the panel support portion may include a first surface recessed from a top surface of the upper frame and a second surface recessed from a front surface of the upper frame.

The fixing portion may include an upper fixing portion extending from the rear surface of the front panel so as to be seated on the first surface.

The panel support portion and the upper fixing portion may be screw-coupled to each other.

The lower frame may include a lower recessed portion recessed from the front surface, and the fixing portion may include a lower fixing portion inserted into the lower recessed portion.

The lower fixing portion may extend to left and right sides of the front panel.

The lower fixing portion may include a first extension portion extending backward from the rear surface of the front panel and a second extension portion bent from the first extension portion to extend downward.

The lower recessed portion may include a first recessed portion extending backward from the front surface of the lower frame and a second recessed portion bent from the first recessed portion to extend downward, wherein the first extension portion may be disposed in the first recessed portion, and the second extension portion may be disposed in the second recessed portion.

Advantageous Effects

The following effects may be expected in the refrigerator according to the proposed embodiments of the present invention.

In the refrigerator according to the embodiment, the outer appearance of the front surface of the refrigerator may be defined by mounting the panel assembly. The panel assembly may be replaceable and mounted, as necessary. Therefore, in the case of the built-in installation, the panel assembly may be mounted to match the surrounding furniture or walls. In addition, even when the plurality of refrigerators are disposed in succession, the outer appearance may be harmonized.

The panel assembly may have the structure in which the upper and lower ends are fixed and restricted by the upper cap decoration and the lower cap decoration, and thus, the structure that is coupled to the outside when viewed from the front side may not be exposed to improve the outer appearance.

In addition, the magnet may be disposed on the rear surface of the panel assembly, and the left and right ends of the panel assembly may be attached to the door body by the magnet. Thus, the entire circumference of the panel assembly may be maintained in the stably coupled state without exposing the configuration for coupling the panel assembly.

The lower end of the panel assembly may have the structure in which the lower protrusion is primarily inserted into the insertion groove of the lower bracket, and the coupling member may be coupled to the upper end and the lower end of the panel assembly in the state in which the lower end of the panel assembly is primarily fixed, and thus, the panel assembly may be firmly fixed to the upper cap decoration and the lower cap decor.

That is, the upper end and the lower end of the panel assembly may be firmly fixed to the upper cap decoration and the lower cap decoration by the coupling due to the lower protrusion as well as the coupling of the upper coupling member and the lower coupling member to maintain the mounted state of the panel assembly.

In addition, the state in which the panel assembly is more firmly coupled to the door body may be maintained by the adhesion force between the upper and the front surface of the door body due to the magnet.

The panel assembly may be maintained in the state in which the coupling member is coupled in the state in which the lower end thereof is inserted into the lower protrusion and temporarily fixed by the magnet, and thus, the coupling of the coupling member may be more easily performed.

Particularly, in the state in which the lower end of the panel assembly is fixed, the upper end of the panel assembly may be naturally aligned with the upper coupling protrusion and the upper coupling portion, and thus, the coupling of the upper coupling member may be easy.

The structure in which the upper coupling member is coupled in the inclined direction to the upper coupling protrusion and the upper coupling portion, which are inclined, may be provided, and thus, the upper coupling member may be coupled in the state in which the panel assembly is laid down. Therefore, the space for the coupling operation may be secured, and thus, the coupling operation may be more easily performed.

In addition, the upper coupling portion may be disposed inside the recessed space of the upper cap decoration, and after the upper coupling member is coupled, the decoration cover may be mounted to shield the inside of the recessed space. Therefore, the structure for fixing the upper coupling member and the panel assembly may be prevented from being exposed to more improve the outer appearance.

In addition, after the coupling member is separated, the panel assembly may be lifted to Separation the lower end of the panel assembly from the lower protrusion, thereby easily performing the separation of the panel assembly.

MODE FOR CARRYING OUT THE INVENTION

Hereinafter, detailed embodiments will be described in detail with reference to the accompanying drawings. However, the present disclosure is limited to the embodiments in which the spirit of the present invention is proposed, and other degenerate idea or other embodiments included in the scope of the present invention may be easily proposed by addition, changes, deletions, etc. of other elements.

Prior to a description, directions are defined. In an embodiment of the present disclosure, a direction facing a front surface of the door illustrated in FIG. 2 may be defined as a front direction, a direction facing a cabinet with respect to the front surface of the door will be defined as a rear direction, a direction facing a bottom surface on which the refrigerator is installed will be defined as a downward direction, and a direction that is away from the bottom surface will be defined as an upward direction.

Figure 1:
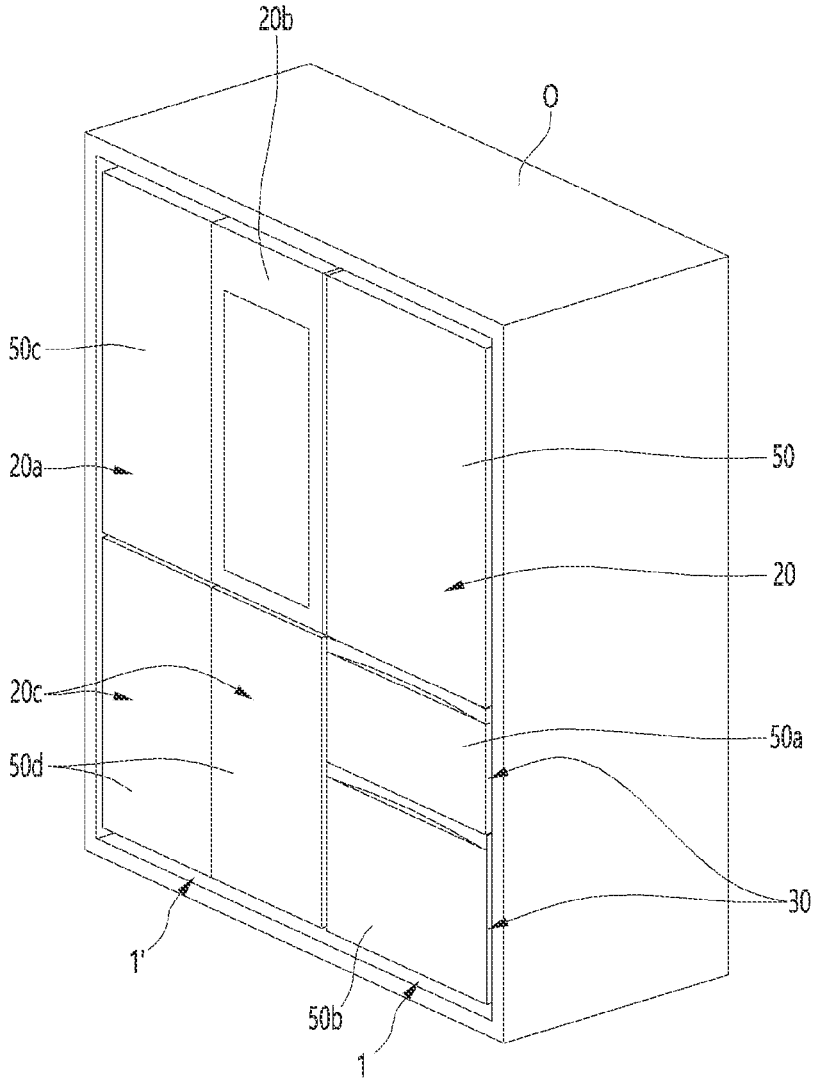
FIG. 1 is a perspective view illustrating a state in which a refrigerator is installed according to a first embodiment of the present invention.
Figure 2:
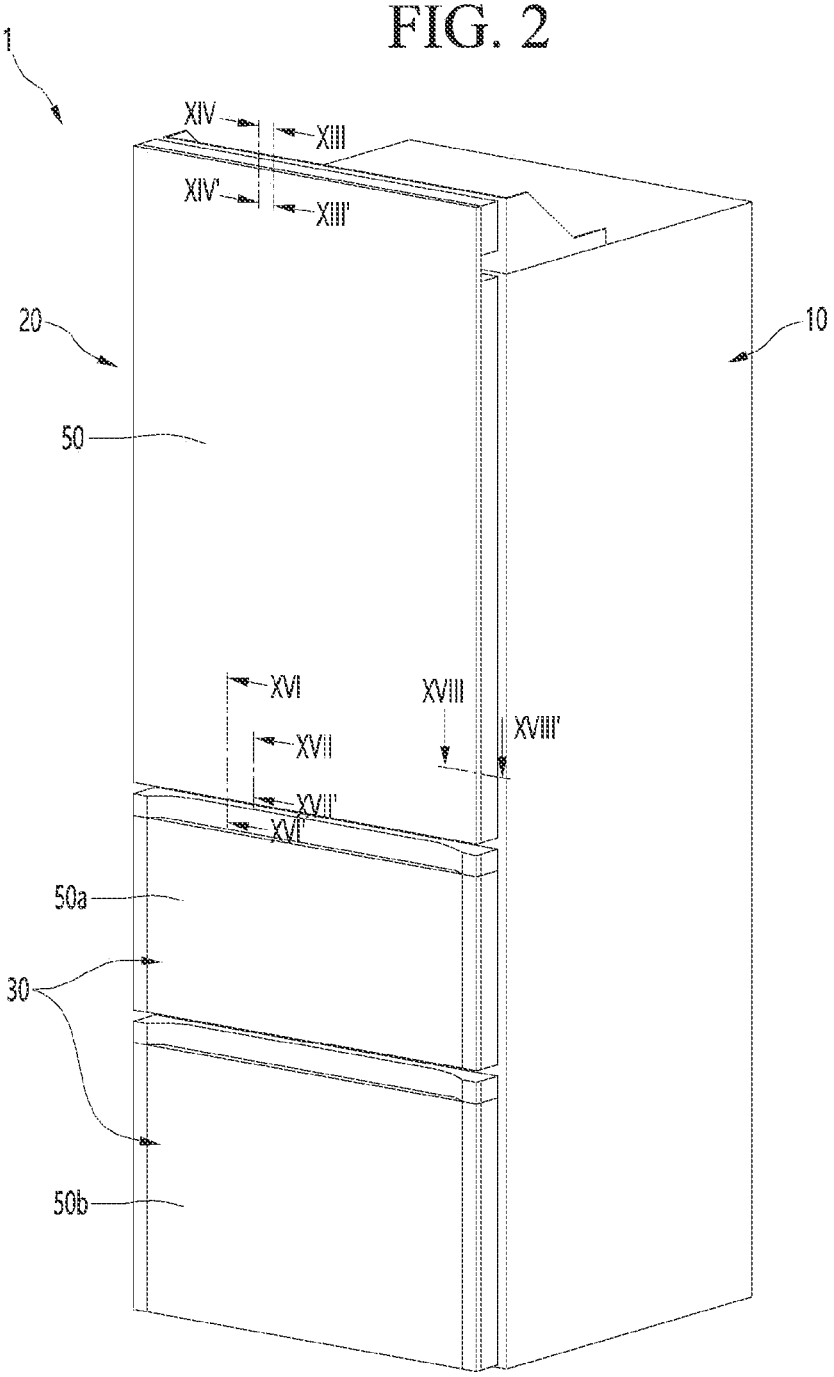
FIG. 2 is a perspective view of the refrigerator.

FIG. 1 is a perspective view illustrating a state in which a refrigerator is installed according to a first embodiment of the present invention. FIG. 2 is a perspective view of the refrigerator.

Referring to the drawings, a refrigerator 1 according to an embodiment of the present invention includes a cabinet 10 defining a storage space having an opened front surface and a door opening or closing the storage space. Here, an outer appearance of the refrigerator 1 may be defined by a cabinet 10 and doors 20 and 30.

The refrigerator 1 may be mounted so as to harmonize with furniture or a wall O of an indoor space. For example, as illustrated in FIG. 1, the refrigerator 1 may be installed in the indoor space such as a kitchen and may be disposed adjacent to the furniture or the wall O to harmonize with each other. That is, a space corresponding to a size of the refrigerator 1 may be provided in the furniture or the wall O, and the refrigerator 1 may be accommodated or disposed in a built-in type.

Also, the other refrigerator 1' may be continuously disposed in parallel at a side of the refrigerator 1. That is, a space in which a plurality of refrigerators 1 and 1' may be disposed may be provided by the furniture or the wall O.

The plurality of refrigerators 1 and 1' may have the same structure, and as necessary, the refrigerators 1 and 1' having various structures may be disposed in combination. For example, as illustrated in FIG. 1, in the refrigerator 1 disposed at a right side, doors 20 and 30 may be disposed vertically. That is, the right refrigerator 1 may be configured so that the door 20 that is opened and closed in a rotating manner is provided at an upper side, and the door 30 that is opened and closed in a sliding manner is provided at a lower side. Also, the refrigerator 1 disposed side by side at a left side may be configured so that an upper storage space is opened and closed by a pair of doors 20*a* and 20*b*, and a lower storage space is opened and closed by a pair of doors 20*c*. Also, the doors 20*a*, 20*b*, and 20*c* may be configured to be opened and closed in the rotating manner, and the doors 20*a*, 20*b*, and 20*c* may be referred to as French-type doors.

The same panel assemblies 50, 50*a*, 50*b*, 50*c*, and 50*d* may be mounted on the doors 20, 30, 20*a*, and 20*c* of the left refrigerator 1' and the right refrigerator 1. The panel assemblies 50, 50*a*, 50*b*, 50*c*, and 50*d* may define front surfaces of the doors 20, 30, 20*a*, and 20*c*, and thus, outer appearances of the refrigerators 1 and 1' may be defined when viewed from a front side. Of course, one door 20*b* among the doors of the left refrigerator 1' may have a different outer appearance and be configured to have an internal see-through function. All of the remaining doors 20, 30, 20*a*, and 20*c* except for the door 20*b* having a specific function may have the same appearance.

That is, the doors 20, 30, 20*a*, and 20*c* of the refrigerators 1 and 1' have different sizes, but the panel assemblies 50, 50*a*, 50*b*, 50*c*, and 50*d* having the same structure may be mounted. Thus, even if the plurality of refrigerators 1 are disposed, the same outer appearance, an outer appearance such as a color and texture may be provided. Of course, the panel assemblies 50, 50*a*, 50*b*, 50*c*, and 50*d* may have different colors or different textures as necessary.

Since each of the panel assemblies 50, 50*a*, 50*b*, 50*c*, and 50*d* has a detachable structure, the panel assembly 50 having an appropriate outer appearance may be selected according to an environment in which the refrigerators 1 and 1' and thus mounted.

When the refrigerator 1 is mounted on the furniture or wall O, the outer appearance of the refrigerator 1 may be provided to have the same material or materials having the same texture as the furniture or wall O, and thus, the outer appearance of the refrigerator and the adjacent furniture or wall O may have a sense of unity. Of course, even if the outer appearance of the refrigerator 1 and the furniture or wall O do not have a sense of unity, the refrigerator 1 may be made of a material that is capable of harmonized with the furniture or wall O.

The refrigerator 1 may be disposed adjacent to the adjacent refrigerator 1' and the furniture or wall O and also may be disposed close to the adjacent refrigerator 1 and the furniture or wall O in a range that does not interfere when the doors 20 and 30 are opened and closed.

Structures and mounting structures of the panel assemblies 50, 50*a*, 50*b*, 50*c*, and 50*d* according to an embodiment of the present invention may be the same in both the left refrigerator 1' and the right refrigerator 1. Therefore, hereinafter, a structure of the right refrigerator 1 of the refrigerators 1 and 1' of FIG. 1 will be described in more detail.

The refrigerator 1 may have an outer appearance defined by the cabinet 10 and the doors 20 and 30. The cabinet 10 may define a storage space that is divided vertically. The doors 20 and 30 that open and close the storage space may be continuously disposed in the vertical direction.

An upper door 20 may be provided in an upper storage space, and a lower door 30 may be provided in a lower storage space. The upper door 20 may open and close the upper storage space by rotation thereof. Thus, the upper door 20 may be referred to as a rotation type door. The lower door 30 may be withdrawn in a drawer type to open and close the lower storage space, and the lower door 30 may be referred to as a drawer type door 30.

The lower door 30 may be provided with two upper and lower doors, and the lower storage space opened and closed by the lower door 30 may be provided as one space, or a space in which each of the lower doors 30 is accommodated.

Outer appearances of front surfaces of the upper door 20 and the lower door 30 may be defined by the panel assemblies 50, 50*a*, and 50*b*, respectively. The panel assemblies 50, 50*a*, and 50*b* provided in the upper door 20 and the lower door 30, respectively, may be different in size and have the same appearance.

Hereinafter, for convenience of explanation and understanding, the panel assembly 50 and a mounting structure of the panel assembly 50 will be described with reference to the upper door 20. Also, hereinafter, the upper door 20 may be referred to as a door 20.

Figure 3:
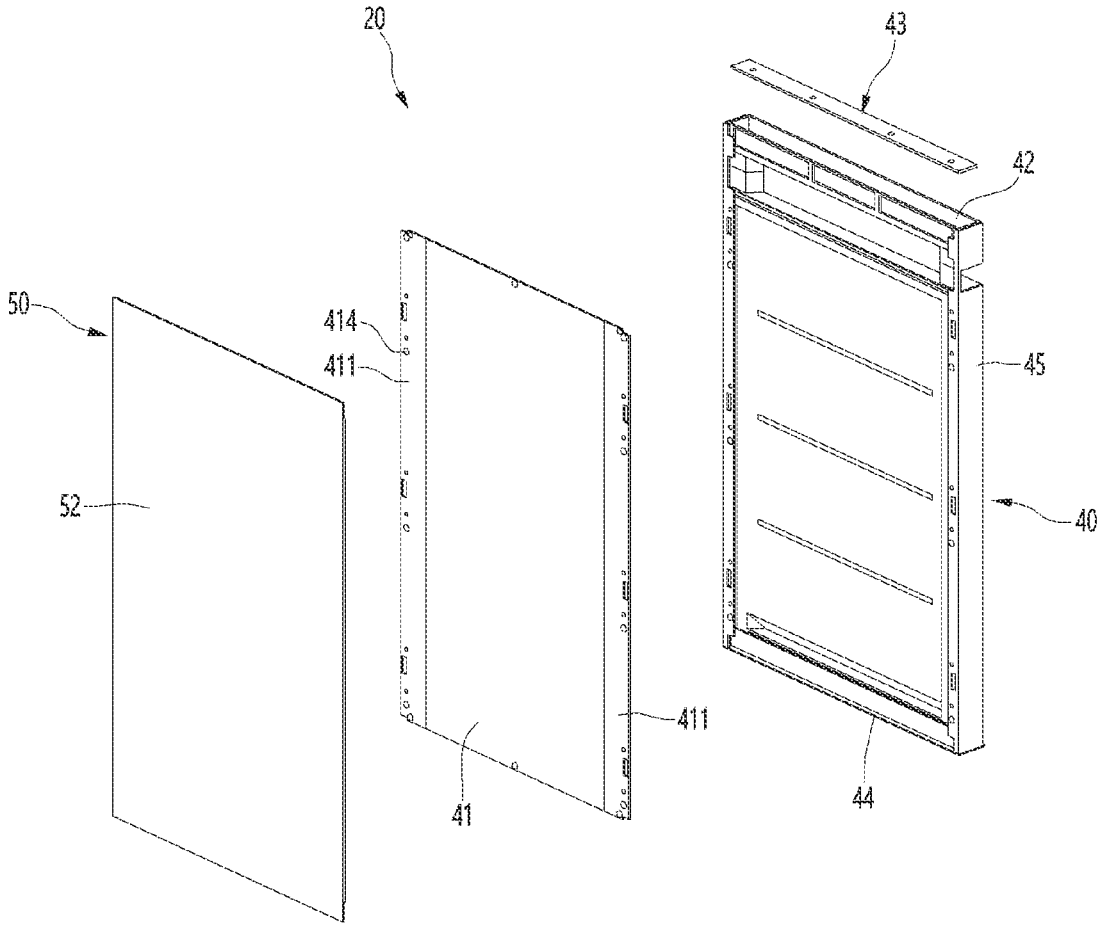
FIG. 3 is an exploded perspective view of a refrigerator door according to an embodiment of the present invention.
Figure 4:
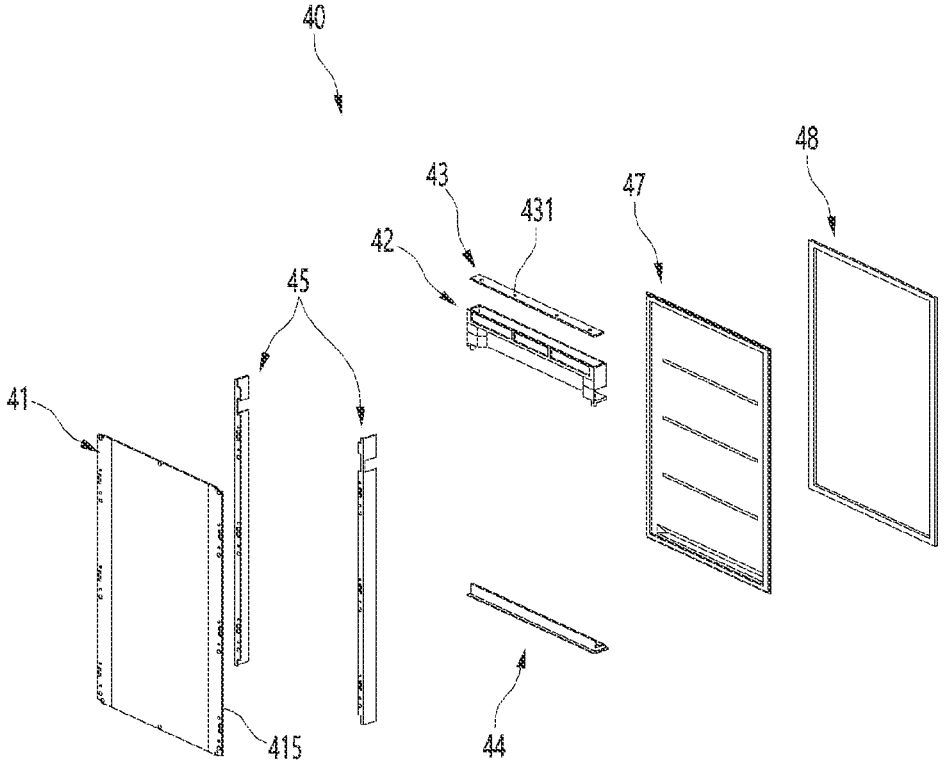
FIG. 4 is an exploded front perspective view illustrating a state in which a door body is disassembled according to an embodiment of the present invention.
Figure 5:
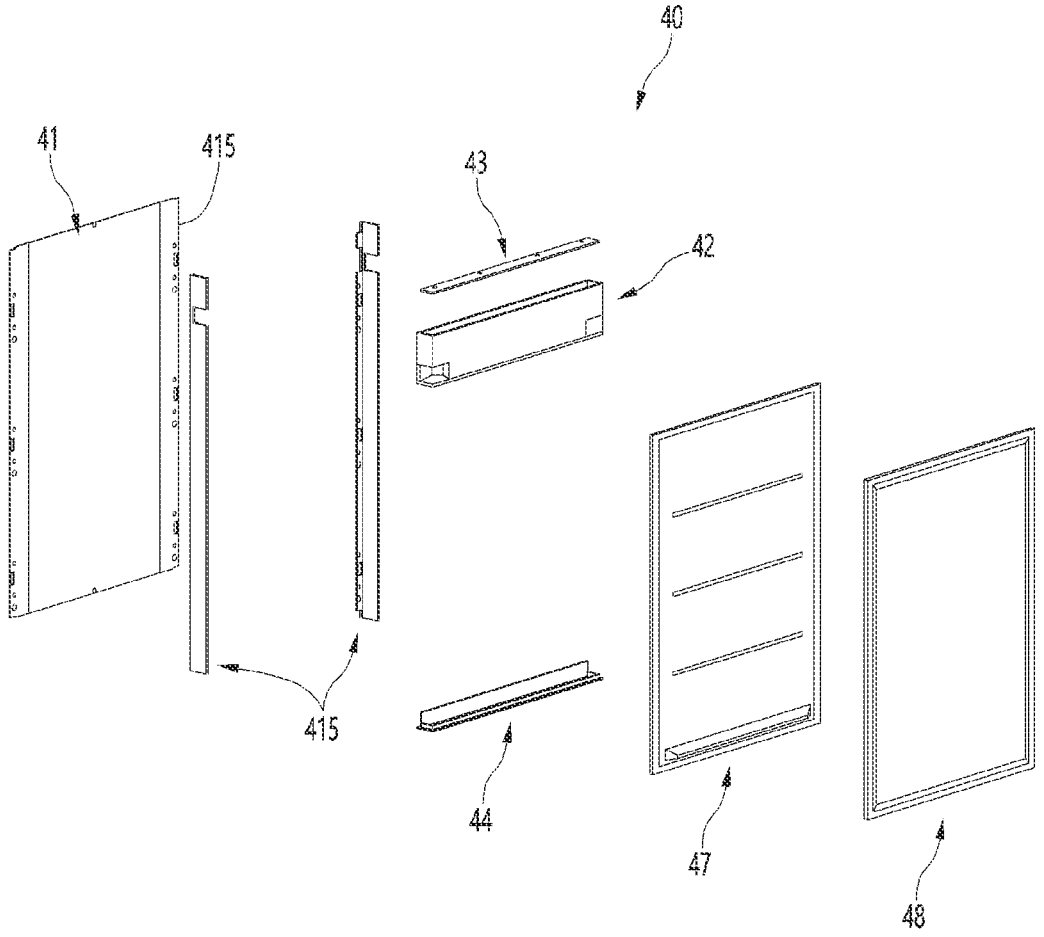
FIG. 5 is an exploded rear perspective view illustrating a state in which the door body is disassembled.

FIG. 3 is an exploded perspective view illustrating a refrigerator door according to an embodiment of the present invention. FIG. 4 is an exploded front perspective view illustrating a state in which a door body is disassembled according to an embodiment of the present invention. FIG. 5 is an exploded rear perspective view illustrating a state in which the door body is disassembled.

As illustrated in the drawings, the door 20 may be filled with an insulator 400 (see FIG. 16) and may include a door body 40 that substantially opens and closes the storage space, and a panel assembly 50 mounted on the door body 40.

The door body 40 may have a predetermined thickness, and the insulator 400 may be filled therein to insulate the storage space. The panel assembly 50 may be mounted on a front surface of the door body 40 to define outer appearances of the front surfaces of the door 20 and the refrigerator 1. The panel assembly 50 may be mounted to be easily detachable from the door body 40, and the panel assembly 50 may be easily detachable even when the door 20 is mounted on the cabinet 10.

Thus, the panel assembly 50 may be mounted in consideration of the outer appearance of the furniture or wall O, and the panel assembly 50 may be designed to be desired by the user and be mounted or replaced as necessary.

Referring to the structure of the door body 40, the door body 40 may include portions or all of a front plate 41, a side frame 45, an upper cap decoration 42, a lower cap decoration 44, a door liner 47, and a gasket 48 as a whole. The insulator 400 may be filled inside the door body 40.

In this specification, the door body 40 may also be referred to as a frame assembly. In addition, the upper cap decoration and the lower cap decoration may be referred to as an upper frame and a lower frame, respectively. In addition, the front plate may be referred to as a front frame.

In detail, the front plate 41 may define a front surface of the door body 40 and be provided in a plate shape. The front plate 41 may be made of a steel material and define a surface facing a rear surface of the panel assembly 50.

A plurality of screw holes 414 may be defined along a circumference of the front plate 41. Screws coupled to the upper cap decoration 42, the lower cap decoration 44, and both the side frames 45 may be coupled to the screw hole 414.

The upper cap decoration 42 and the lower cap decoration 44 may be respectively disposed at upper and lower ends of the front plate 41 to define top and bottom surfaces of the door body 40. The side frames 45 may be coupled to both left and right side ends of the front plate 41, respectively, and upper and lower ends of each of the side frames 45 may be connected to the upper cap decoration 42 and the lower cap decoration 44, respectively.

The door liner 47 may be coupled to rear surfaces of the upper cap decoration 42, the lower cap decoration 44, and the side frame 45. The door liner 47 may be provided in a plate shape to define the rear surface of the door body 40. The door liner 47 may be made of a plastic material and may be vacuum-molded to define a shape of the rear surface of the door body 40.

A gasket groove 471 may be defined around the rear surface of the door liner 47, and the gasket 48 may be disposed along the gasket groove 471. The gasket 48 may be in contact with a circumference of the cabinet 10 while the door 20 is closed to seal the storage space.

Hereinafter, main components constituting the door body 40 will be described in more detail with reference to the drawings.

Figure 6:
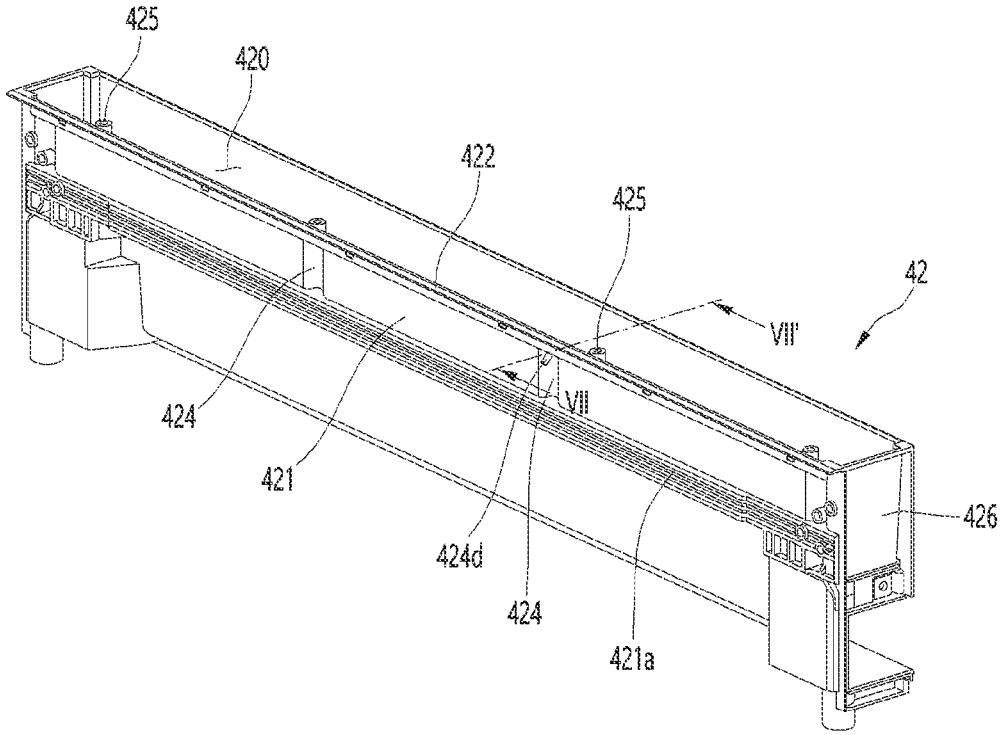
FIG. 6 is a perspective view illustrating an upper cap decoration that is one component of the door body.
Figure 7:
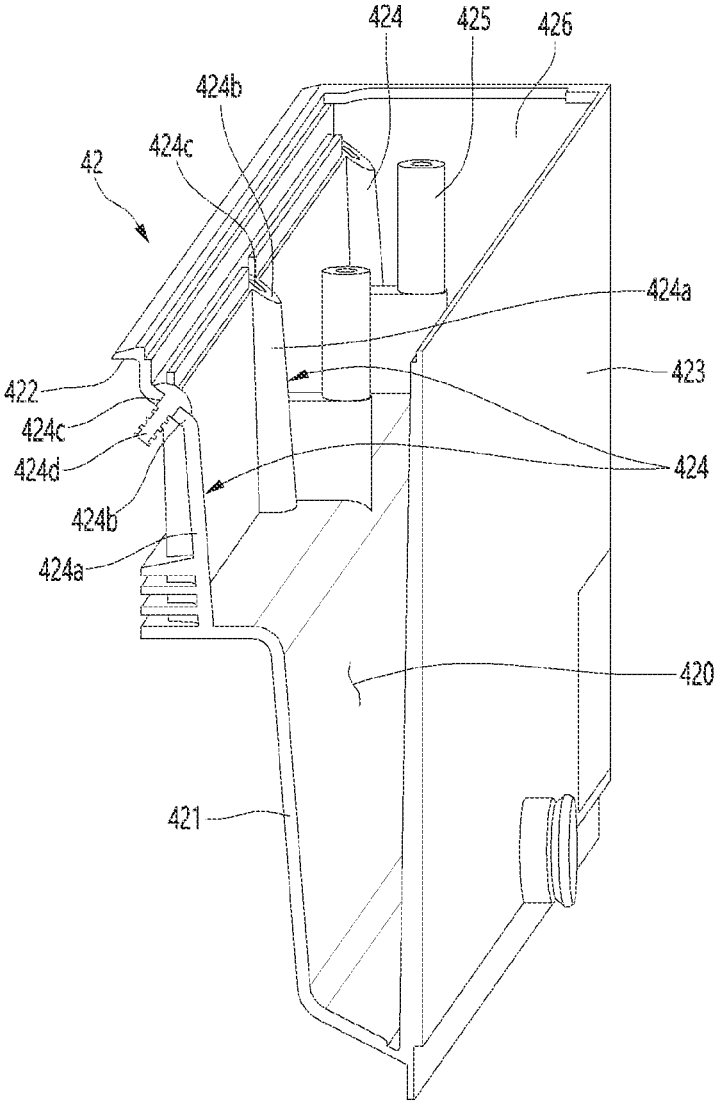
FIG. 7 is a cutaway perspective view taken along line VII-VII' of FIG. 6.

FIG. 6 is a perspective view illustrating an upper cap decoration that is one component of the door body. FIG. 7 is a cutaway perspective view taken along line VII-VII' of FIG. 6.

As illustrated in the drawings, the upper cap decoration 42 may define an upper portion of the door 20 and also may define a top surface of the door 20, which is exposed to the outside in an assembled state. The upper cap decoration 42 may support the front plate 41, the door liner 47, and the upper end of the side frame 45.

In detail, the upper cap decoration 42 may be made of a plastic material and may include a front surface 421, a rear surface 423, and both side surfaces 426. The front plate 41 may be coupled to the front surface 421, the door liner 47 may be coupled to the rear surface 423, and the side frame 45 may be coupled to each of both left and right side surfaces 426.

A recessed space 420 having an open top surface may be defined in the upper cap decoration 42, and a screw may be coupled to the upper end of the panel assembly 50 through the recessed space 420. A PCB for controlling electronic components provided in the door 20 may be accommodated inside the recessed space 420. The recessed space 420 may extend up to a lower end of the upper cap decoration 42, and during injection molding, the rear surface 423 may be provided in a planar shape. The opened top surface of the recessed space 420 may be shielded by the decoration cover 43. That is, the decoration cover 43 may define most of the outer appearance of the top surface of the door 20.

A plurality of screw holes 431 may be defined along the decoration cover 43. A cover support boss 425 extending upward may be disposed inside the recessed space 420 corresponding to the screw hole 431. The cover support boss 425 may be disposed at a position corresponding to the screw hole 431 and may extend to support the decoration cover 43 at the lower side when the decoration cover 43 is mounted. The screw passing through the screw hole 431 may be coupled to a top surface of the cover support boss 425 so that the decoration cover 43 is fixed.

An upper coupling portion 424 to which an upper coupling member **424*d* coupled to an upper bracket 53 to be described in detail below is coupled may be disposed inside the recessed space 420. The upper coupling portion 424 may be disposed at a position corresponding to the upper coupling protrusion 533 protruding from the upper bracket 53. For example, four upper coupling portions 424 may be disposed at a pair of positions spaced apart from each other at left and right sides with respect to a center of the upper cap decoration 42. That is, the upper coupling portion 424 may be disposed at each of both the side ends of the upper cap decoration 42** and may be further disposed at each of inner sides spaced apart from both the side ends.

The upper coupling portion 424 may include an upper extension portion **424*a* extending along a front surface of the recessed space 420, an upper inclined surface 424*b* disposed at an upper end of the upper extension portion 424*a*, and an upper screw hole 424*c* defined in the upper inclined surface 424*b***.

The upper extension portion **424*a* may be provided so that a portion of the front surface 421 is recessed to accommodate the upper coupling protrusion 533 and may protrude from the inside of the recessed space 420. The upper extension portion 424*a* may extend upward, i.e., may extend to a position lower than that of the decoration cover 43. For example, the upper extension portion 424*a* may have a height equal to or slightly lower than a height of the cover support boss 425. Thus, in a state in which the decoration cover 43 is opened, the upper coupling member 424*d* may be easily coupled to the screw hole 424*c* defined in a top surface of the upper extension portion 424*a*. For example, the upper coupling member 424*d*** may be a screw.

An upper inclined surface **424*b* may be disposed on the top surface of the upper extension portion 424*a*. The upper inclined surface 424*b* may have a downward inclination at which a rear end thereof is lower than a front end thereof. The upper screw hole 424***c* to which the upper coupling member 424*d* is coupled may be defined in the upper inclined surface 424*b*. Thus, when the door 20 is assembled, in a state in which the rear surface of the door 20 faces the bottom, a space for the coupling of the upper coupling member 424*d* may be easily secured through the recessed space 420.

The front surface of the upper cap decoration 42 may be provided in a shape in which a lower portion thereof protrudes more backward than an upper portion thereof. An upper plate coupling portion 421*a* supporting the front plate 41 at the rear side may be disposed on the front surface of the upper cap decoration 42. The upper plate coupling portion 421*a* may extend from a left end to a right end of the upper cap decoration 42 and may be disposed so that a plurality of ribs and grooves are continuously disposed vertically at regular intervals. The upper plate coupling portion 421*a* and the upper cap decoration 42 may be coupled by a screw. When a foaming liquid is injected below the upper cap decoration 42 to mold the insulator 400, the upper cap decoration 42 and a rear surface of the front plate 41 may adhere to each other while being filled in the groove of the upper plate coupling portion 421*a*. In the upper plate coupling portion 421*a* may be disposed to pass through a lower end of the upper extension portion 424*a*.

An upper support end 422 protruding forward may be disposed on an upper end of a front surface of the upper cap decoration 42. The upper support end 422 may protrude forward and may support an upper end of the panel assembly 50. A protruding length of the upper support end 422 may be less than a thickness of the panel assembly 50. Thus, in a state in which the panel assembly 50 is mounted, the upper support end 422 may not protrude forward from the panel assembly 50. Thus, when viewed from a front side, the upper panel assembly 50 may be completely exposed, and the upper support end 422 may be prevented from being excessively exposed.

Figure 8:
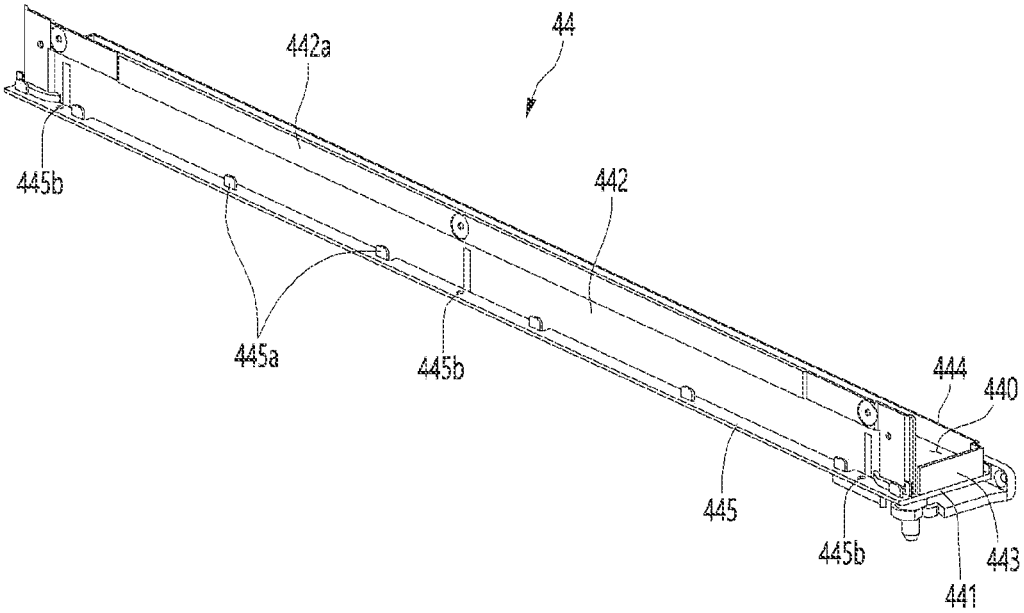
FIG. 8 is a perspective view illustrating a lower cap decoration that is one component of the door body.

FIG. 8 is a perspective view illustrating a lower cap decoration that is one component of the door body.

As illustrated in the drawings, the lower cap decoration 44 may be made of a plastic material may define a lower portion of the door body 40 and also define a bottom surface of the door body 40. The lower cap decoration 44 may generally include a bottom surface 441, a front surface 442, a rear surface 444, and both side surfaces 443. The lower cap decoration 44 may define a space 440 having an opened top surface, and the insulator 400 may be filled in the space 440.

The front surface 442 may support the lower end of the front plate 41 at the rear side. Both the side surfaces 443 may support the lower end of the side frame 45 at the inside. The rear surface 444 may support the lower end of the door liner 47 at a front side.

As described above, a closed space 440 may be defined by the front plate 41, the side frame 45, and the door liner 47, which are coupled to the front surface 442, both the side surfaces 443, and the rear surface 444 of the lower cap decoration 44, and the insulator 400 may be filled in the space 440.

A lower plate coupling portion 442*a* supporting the front plate 41 at the rear side may be disposed on the front surface of the lower cap decoration 44. The lower plate coupling portion 442*a* may extend from a left end to a right end of the front surface and may protrude slightly forward to support the front plate 41 at the rear side. A plurality of screws passing through the front plate 41 may be coupled to the lower plate coupling portion 442*a*.

A lower support end 445 extending forward may be disposed on a lower end of the front surface 442 of the lower cap decoration 44. The lower support end 445 may extend so that the bottom surface 441 of the lower cap decoration 44 passes through a lower end of the front surface 442 of the lower cap decoration 44.

The lower support end 445 may protrude to support the lower end of the panel assembly 50, and a protruding length of the lower support end 445 may be less than the thickness of the panel assembly 50. Thus, exposure of the lower support end 445 when viewed from the front side may be minimized so that the entire front surface of the door 20 is defined by the panel assembly 50.

A lower protrusion 445*a* protruding upward may be disposed on a lower end of the lower support end 445. The lower protrusion 445*a* may be inserted into a lower bracket 54 to be described below to restrict the lower end of the panel assembly 50.

A plurality of lower protrusions 445*a* may be disposed at a regular interval along the lower support end 445. The lower protrusions 445*a* may be disposed to be spaced apart from the front surface of the lower cap decoration 44. An opening 445*c* may be defined in the lower support end 445 between the lower protrusion 445*a* and the front surface 442. When the lower cap decoration 44 is injection-molded, the lower protrusion 445*a* may be molded by the opening 445*c*.

A plurality of lower coupling holes 445*b* may be defined in the lower support end 445. The lower coupling hole 445*b* may be defined so that a lower coupling member 545*b* coupled by passing through the lower support end 445 at the lower side passes therethrough. The lower coupling member 545*b* may be coupled to the lower bracket 54 through the lower coupling hole 445*b*, and a lower end of the panel assembly 50, which is seated on the lower support end 445, may be securely fixed.

Figure 9:
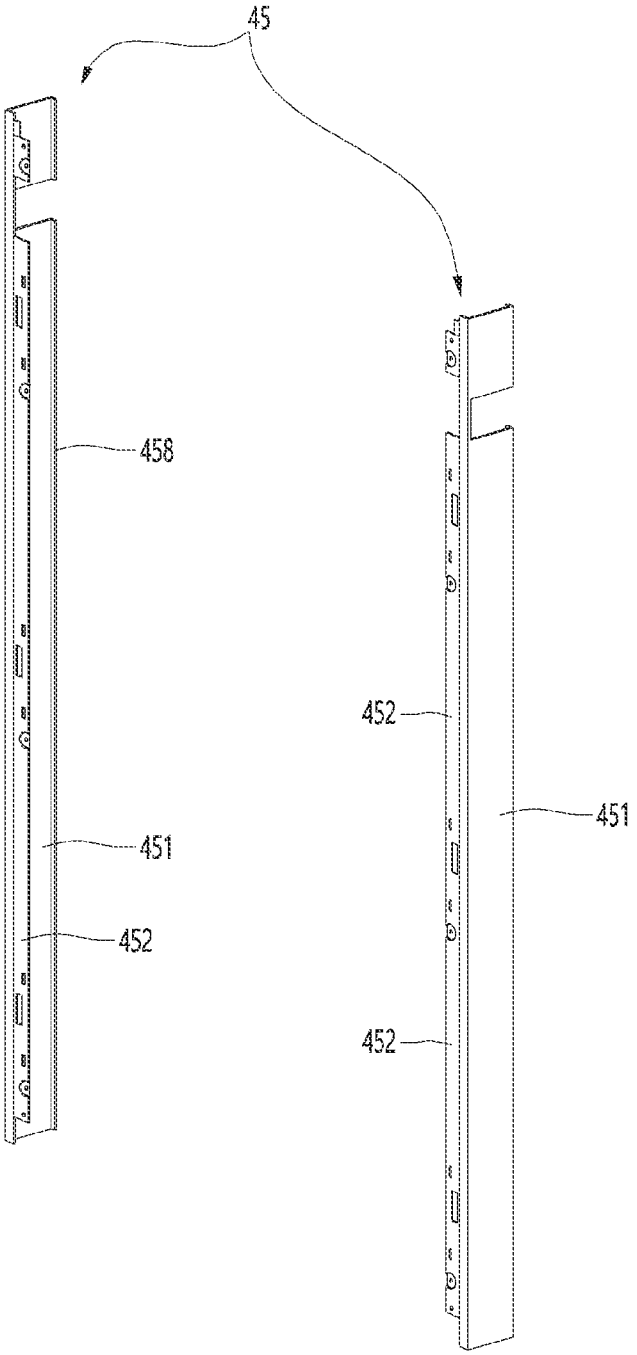
FIG. 9 is a perspective view illustrating a side frame that is one component of the door body.

FIG. 9 is a perspective view illustrating a side frame that is one component of the door body.

As illustrated in the drawing, the side frame 45 may connect the upper cap decoration 42 to the lower cap decoration 44 and may connect the front plate 41 to the door liner 47. The side frame 45 may define both side surfaces of the door body 40.

The side frame 45 may extend lengthily in the vertical direction and may be formed through extrusion of a metal material. For example, the side frame 45 may be made of an aluminum material. Thus, the side frame 45 may allow an outer appearance of a side surface of the door 20 to be more luxurious. Also, the side frame 45 may reinforce strength of the door 20 to prevent the door 20 from being deformed. Particularly, the accommodation member 46 coupled to the panel fixing member 55 may be mounted on the side frame 45, and the side frame 45 may firmly support the portion, on which the panel assembly is mounted, to maintain a stably mounted state of the panel assembly 50 and prevent the door body 40 from being deformed.

The side frames 45 at both left and right sides may have the same shape and may be disposed in a direction facing each other. That is, the side frames 45 disposed on both sides may be disposed to be symmetrical horizontally with respect to the center of the door body 40. Thus, to avoid overlapping descriptions, the side frame 45 on one of both the left and right sides will be described.

Referring to the detailed structure of the side frame 45, the side frame 45 may include a frame side surface 451, a frame front surface 452, and a front rear surface 458.

In detail, the frame side surface 451 may define a surface exposed to a side of the door body 40 and be provided in a flat shape. An upper end of the frame side surface 451 may be in contact with the upper cap decoration 42, and a lower end of the frame side surface 451 may be in contact with the lower cap decoration 44.

The frame front surface 452 may extend inward from a front end of the frame side surface 451. The frame front surface 452 may support both left and right side ends of the front plate 41. The frame front surface 452 may extend from an upper end to a lower end of the side frame 45 and be disposed perpendicular to the frame side surface 451.

Hereinafter, the panel assembly 50 will be described in more detail with reference to the drawings.

Figure 10:
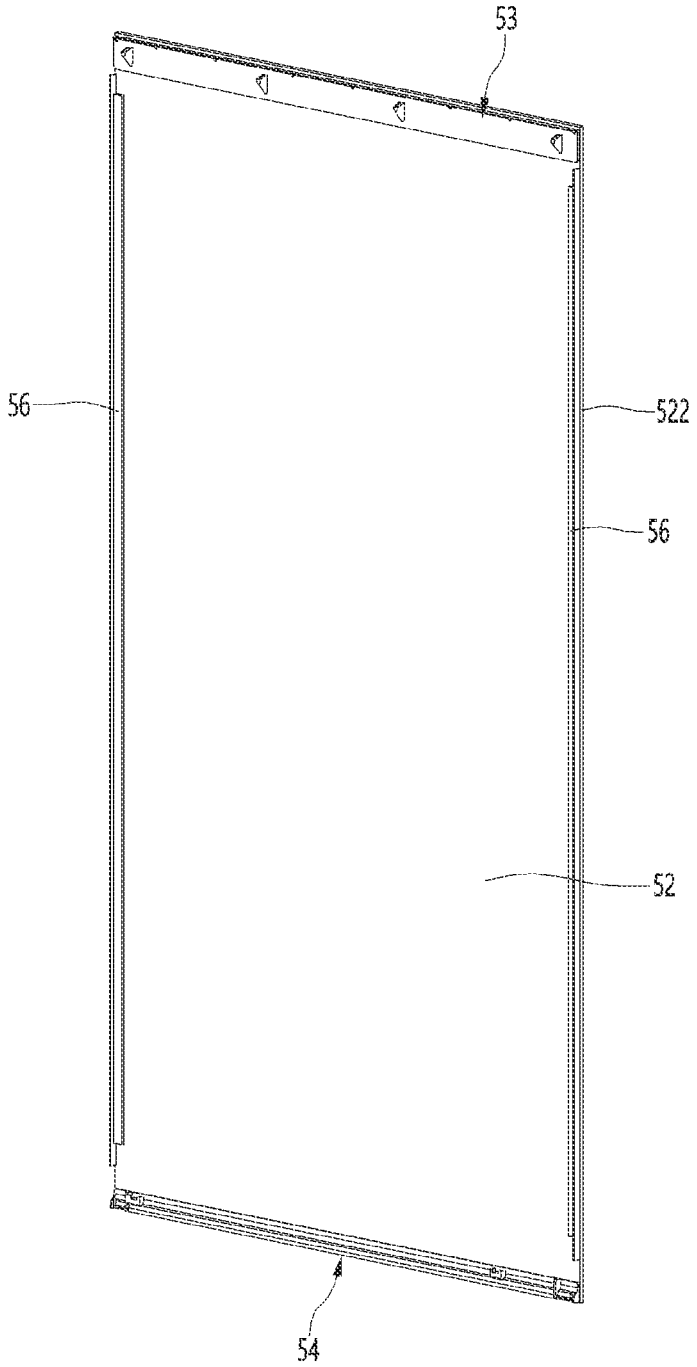
FIG. 10 is a rear perspective view of the panel assembly according to an embodiment of the present invention.
Figure 11:
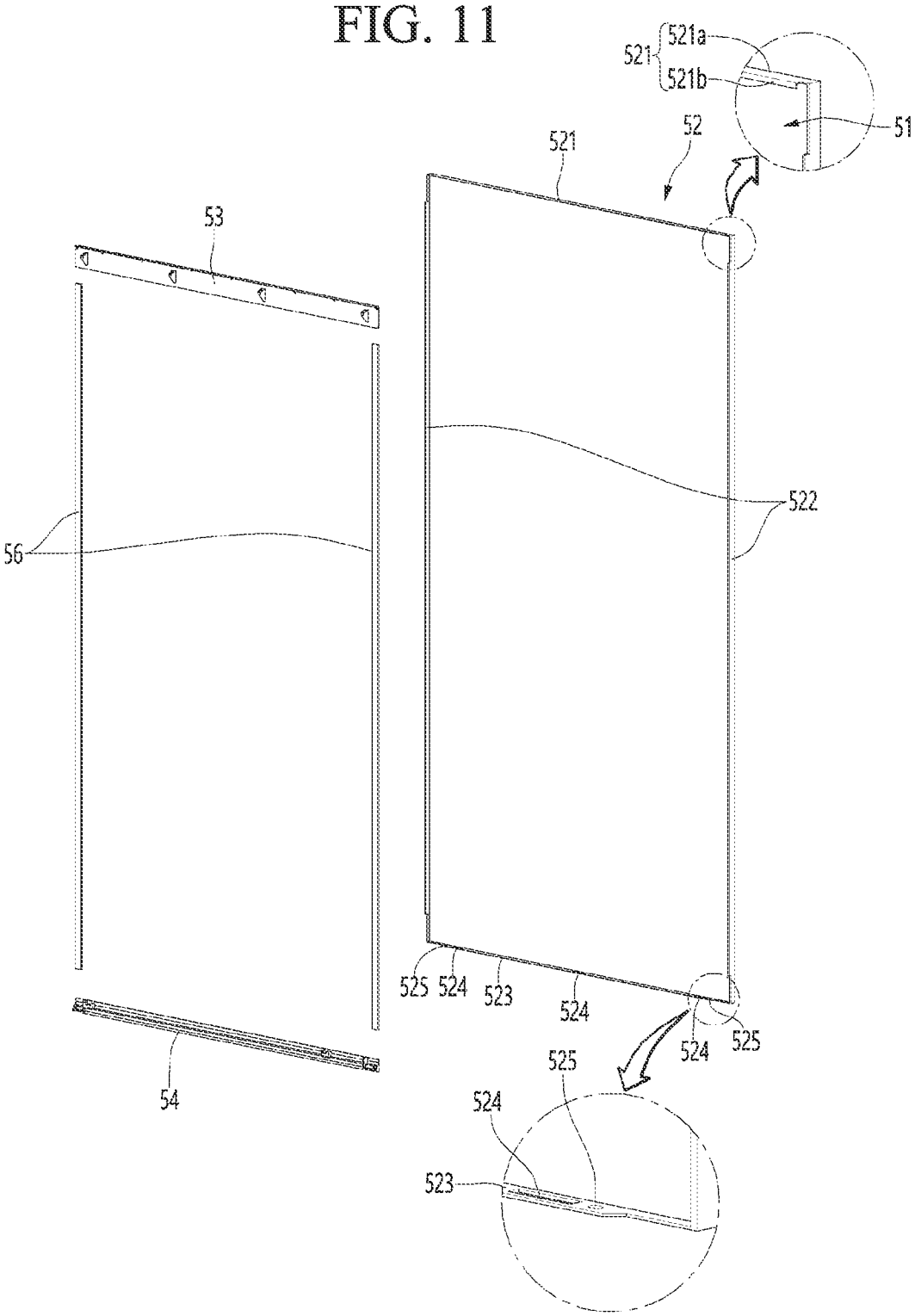
FIG. 11 is an exploded perspective view of the panel assembly.

FIG. 10 is a rear perspective view of the panel assembly according to an embodiment. FIG. 11 is an exploded perspective view of the panel assembly.

As illustrated in the drawing, the panel assembly 50 may have a size corresponding to that of a front surface of the door body 40 and be configured to define an outer appearance of an entire front surface of the door 20 in a state of being mounted on the door body 40.

The panel assembly 50 may include a plate-shaped panel 52 defining an outer appearance, and upper and lower brackets 53 and 54 for fixing upper and lower ends of the panel 52. The panel assembly 50 may further include a magnet 56 so that a rear surface of the panel 52' and a front surface of the door body 40 are attached to each other.

In detail, the panel 52 may be made of a rectangular plate-shaped material having a predetermined thickness and may be made of a material that is capable of being harmonized with the furniture or wall O or the home appliance disposed therearound.

For example, the panel 52 may be made of a plate-shaped metal material such as stainless steel. Printing, coating treatment, or film attachment may be performed on the front surface of the panel 52 to have a color or pattern, thereby defining the outer appearance of the door 20.

The panel 52 may be maintained in a stable support state when mounted on the door body 40, and bent portions 521, 522, and 523 may be disposed along a circumference so that a cross-section of the panel 52 is not exposed to the outside. Thus, the outer appearance of the circumferential surface of the panel 52 may be defined by the bent portions 521, 522, and 523. When the panel assembly 50 is mounted, the panel assembly 50 may be in contact with or disposed adjacent to an upper support end 422 of the upper cap decoration 42, a lower support end 445 of the lower cap decoration 44, and a side support end 451*a* of the side frame 45. An extending length of each of the bent portions 521, 522, and 523, i.e., a thickness of the circumferential surface of the panel 52 may be greater than a protruding height of each of the upper support end 422, the lower support end 445, and the side support end 451*a*. Thus, when viewed from a front side, the entire outer appearance of the front surface of the door 20 may be visible by the panel 52, and the upper support end 422, the lower support end 445, and the side support end 451*a* may be prevented from being prominently exposed to the outside.

Each of the bent portions 521, 522, and 523 may include an upper bent portion 521 disposed on a circumference of an upper end of the panel 52, a side bent portion 522 disposed on each of both left and right ends of the panel 52, and a lower bent portion 523 disposed on a circumference of a lower end of the panel 52.

In detail, the upper bent portion 521 includes a first bent portion 521*a* that is bent rearward from an upper end of the panel 52 and a second bent 521*b* downward from the extending end of the first bent portion 521*a*. Thus, when the panel assembly 50 is mounted, a sharp end of the panel 52 may be prevented from being in direct contact with the upper cap decoration 42 by the second bent portion 521*b* to prevent the upper cap decoration 42 from being damaged.

The side bent portion 522 may be bent backward from each of both left and right side ends of the panel 52 and also may protrude backward by the same height as each of the upper bent portion 521 and the lower bent portion 523.

The lower bent portion 523 may be bent backward from the lower end of the panel 52. The lower bent portion 523 may have a bent portion opening 524 into which the lower protrusion 445*a* is inserted. The bent portion opening 524 may be defined along the lower bent portion 523 and may be provided in plurality at positions corresponding to the plurality of lower protrusions 445*a* protruding from the lower support end 445. A bent portion screw hole 525 may be further defined in the lower bent portion 523. The bent portion screw hole 525 may be a hole through which the lower coupling member 545*b* coupled to the lower bracket 54 passes and be provided in plurality at positions corresponding to the lower coupling boss 545 of the lower bracket 54.

An upper bracket 53 and a lower bracket 54 may be provided on upper and lower ends of the rear surface of the panel 52, respectively. The upper bracket 53 and the lower bracket 54 may be configured so that the upper and lower ends of the panel assembly 50 are fixedly mounted to the door body 40.

The upper bracket 53 and the lower bracket 54 may extend along upper and lower ends of the panel 52, respectively, and each of the upper bracket 153 and the lower bracket 154 may have a length corresponding to a horizontal width of the panel 52. When the panel assembly 50 is mounted, the panel assembly 50 may be coupled to each of the upper cap decoration 42 and the lower cap decoration 44. The upper bracket 53 and the lower bracket 54 may be referred to as an upper fixing portion and a lower fixing portion, respectively.

A magnet 56 may be provided at each of both left and right ends of the panel 52. The magnet 56 may be attached to the rear surface of the panel 52 by an adhesive or magnetic force. The magnet 56 may extend from an upper end to a lower end of the panel 52. When the panel assembly 50 is mounted on the door body 40 in a state in which the magnet is attached to the panel 52 the magnet 56 may be attached to the front panel 52 by the magnetic force. That is, the mounting of the panel assembly 50' may be assisted by the magnet 56.

Hereinafter, the structure of the upper bracket 53 will be described in detail with reference to the drawings.

Figure 12:
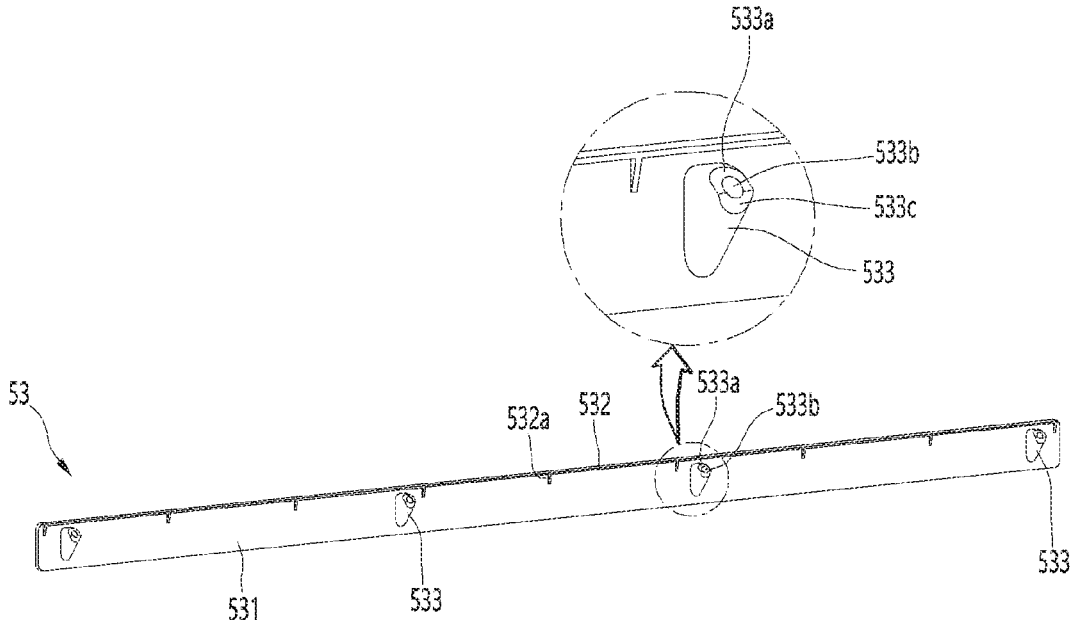
FIG. 12 is a perspective view of the upper bracket that is one component of the panel assembly.
Figure 13:
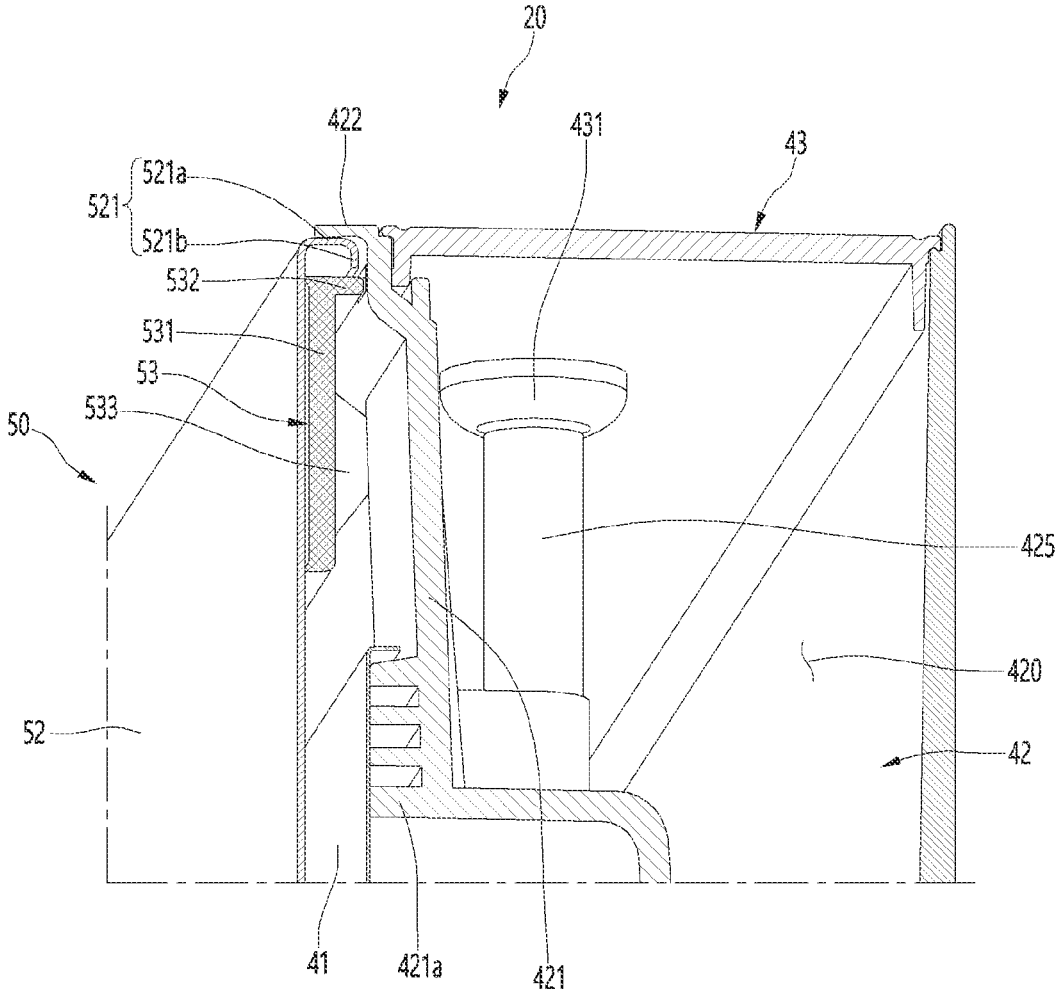
FIG. 13 is a cutaway perspective view taken along line XIII-XIII' of FIG. 2.
Figure 14:
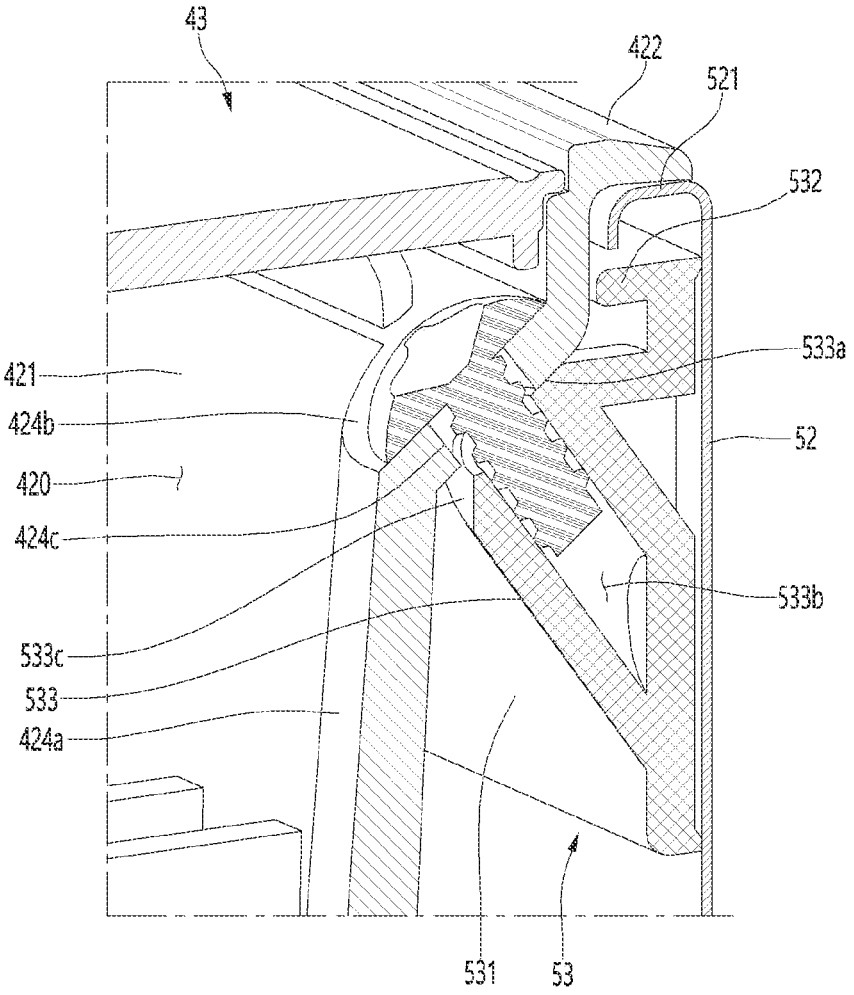
FIG. 14 is a cutaway perspective view taken along line XIV-XIV' of FIG. 2.

FIG. 12 is a perspective view of the upper bracket that is one component of the panel assembly. FIG. 13 is a cutaway perspective view taken along line XIII-XIII' of FIG. 2. FIG. 14 is a cutaway perspective view taken along line XIV-XIV' of FIG. 2.

As illustrated in the drawings, the upper bracket 53 may be mounted on an upper end of the panel 52 and may have a length corresponding to a horizontal width of the panel 52. The upper bracket 53 may be injection-molded by using a plastic material and may include an upper adhesion portion 531 having a planar shape, an upper rib 532 at an upper end of the upper adhesion portion 531, and an upper coupling protrusion 533 provided on the upper adhesion portion 531.

In detail, a front surface of the upper adhesion portion 531 may be provided in a planar shape and may adhere to the upper end of the rear surface of the panel 52. Here, an adhesive may be applied to the front surface of the upper adhesion portion 531, and the upper bracket 53 may be firmly fixed to the panel 52 by the adhesive.

The upper bracket 53 may have a predetermined vertical width, the upper rib 532 may be disposed on the upper end of the upper adhesion portion 531, and the first bracket 53 may have a width so that the upper coupling protrusion 533 is disposed below the upper rib 532. The upper end of the upper bracket 53 may be disposed at a position adjacent to the upper end of the panel 52 and may be disposed at a slightly spaced position so as not to interfere with the upper support end 422.

The upper rib 532 may be disposed along an upper end of the upper bracket 53. The upper rib 532 may protrude backward and be in contact with the front surface of the upper cap decoration 42. Thus, the upper end of the panel assembly 50 may be supported by the upper cap decoration 42. In the state in which the upper rib 532 is in contact with the front surface of the upper cap decoration 42, the upper coupling protrusion 533 may be in contact with the upper coupling portion 424 to facilitate the coupling of the upper coupling member 424*d*.

A reinforcing portion 532*a* connecting the upper rib 532 to the upper adhesion portion 531 may be disposed on a bottom surface of the upper rib 532. A plurality of reinforcing portions 532*a* may be continuously disposed at predetermined intervals along the upper rib 532.

The upper coupling protrusion 533 may protrude backward from the rear surface of the upper adhesion portion 531 and may protrude from a position corresponding to the upper coupling portion 424 of the upper cap decoration 42. The upper coupling protrusion 533 may protrude further backward than the upper rib 532 and may be in contact with the upper coupling portion 424 when the panel assembly 50 is mounted.

In detail, the upper coupling protrusion 533 may protrude from the upper adhesion portion 531 so as to be inclined backward and upward. The upper coupling protrusion 533 may be provided to have a cross-sectional area that gradually decreases backward from the upper adhesion portion 531.

The upper coupling protrusion 533 may be inserted into the upper extension portion 424*a* disposed on the front surface of the upper cap decoration 42 when the panel assembly 50 is coupled. That is, the upper coupling protrusion 533 may correspond to a recessed shape of the upper extension portion 424*a*.

A protrusion inclined surface 533*a* disposed to be inclined may be disposed on an top surface of the upper coupling protrusion 533. The protrusion inclined surface 533*a* may have a downward inclination that gradually decreases backward. The protrusion inclined surface 533*a* may have an inclination corresponding to the upper inclined surface 1424*b*. Thus, in a state in which the panel assembly 50 is accurately mounted on the front surface of the door body 40, the protrusion inclined surface 533*a* may be in close contact with the upper inclined surface 424*b*.

The screw hole 533*b* may be defined in the protrusion inclined surface 533*a*. An upper coupling member 424*d* passing through the upper coupling portion 424 may be coupled to the screw hole 533*b*. Thus, when the upper coupling member 424*d* is coupled to pass through the upper coupling portion 424 in the state in which the upper end of the panel assembly 50 is disposed on the front surface of the door body 40, the upper coupling member 424*d* may be coupled to the screw hole 533*b* of the upper coupling protrusion 533 so that the protrusion inclined surface 533*a* and the upper inclined surface 424*b* are in close contact with each other. In this state, the upper end of the panel assembly 50 may be firmly fixed to the door body 40.

An evacuation portion 533*c* may be further disposed on the top surface of the upper coupling member 424*d*. The evacuation portion 533*c* may be shaped to be stepped on the top surface of the upper coupling member 424*d*. In detail, the evacuation portion 533*c* may be inclined downward from the rear end of the protrusion inclined surface 533*a*. Here, the inclination of the evacuation portion 533*c* may have a greater than that of the protrusion inclined surface 533*a*, and thus, when the panel assembly 50 is mounted on the door body 40, the upper cap decoration 42 may not interfere with the protruding portion of the upper coupling member 424*d*.

The upper bracket 53 may be disposed at an upper end of the panel 52, and a height from the upper end of the panel 52 to the upper bracket 53 may be greater than a height from the upper end of the panel 52 to the gasket 48.

Thus, the upper bracket 53 may be disposed substantially outside the gasket 48, and thus, the thermal insulation performance of the storage space may not be affected. That is, even if the corresponding front surface of the upper cap decoration 42 is inclined and recessed to provide a structure having a relatively thin thickness due to the mounting of the upper bracket 53, the corresponding position may not be affected by cold air within the refrigerator, and thus, dew condensation may not be generated, and also, the thermal insulation performance of the door 20 may not be deteriorated. That is, the upper bracket 53 may be disposed outside the gasket 48 and also be disposed outside a thermal insulation region.

Hereinafter, the structure of the lower bracket 54 will be described in more detail with reference to the drawings.

Figure 15:
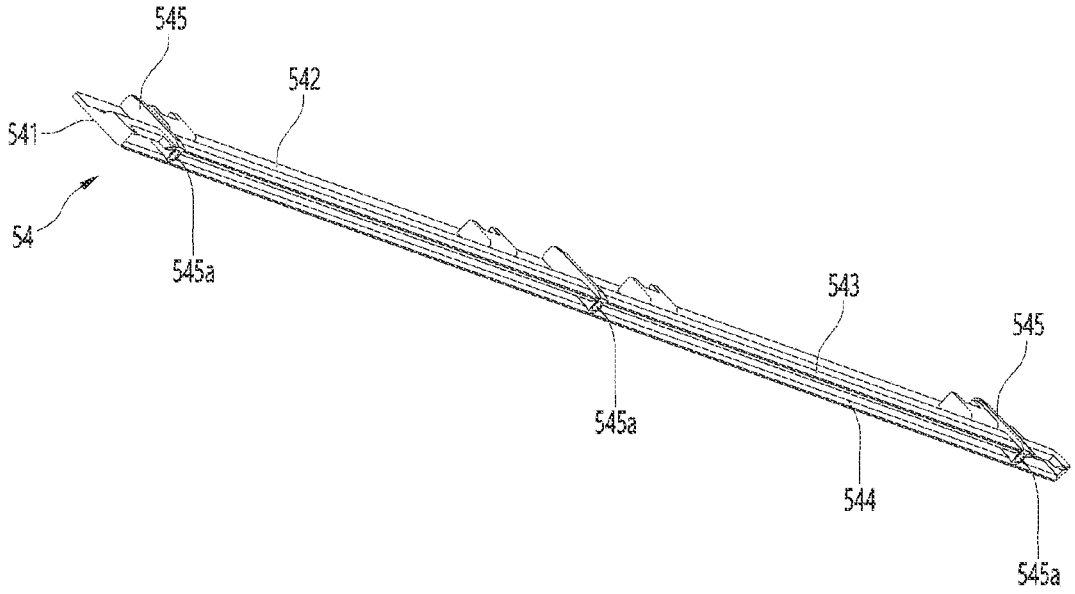
FIG. 15 is a perspective view of the lower bracket that is one component of the panel assembly.
Figure 16:
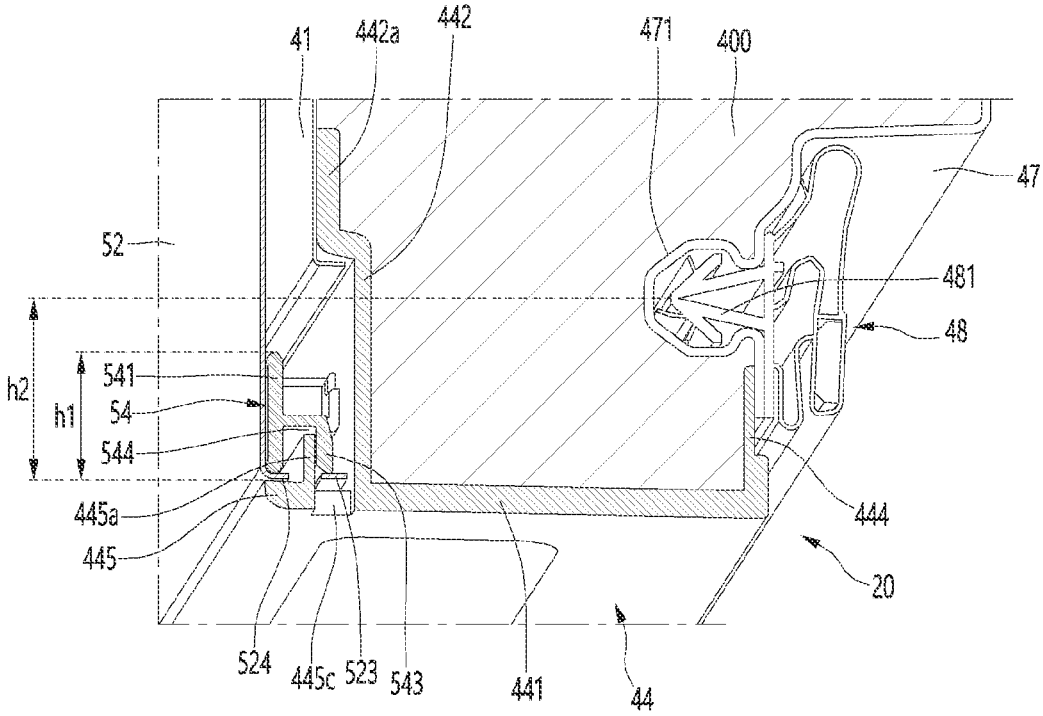
FIG. 16 is a cutaway perspective view taken along line XVI-XVI' of FIG. 2.
Figure 17:
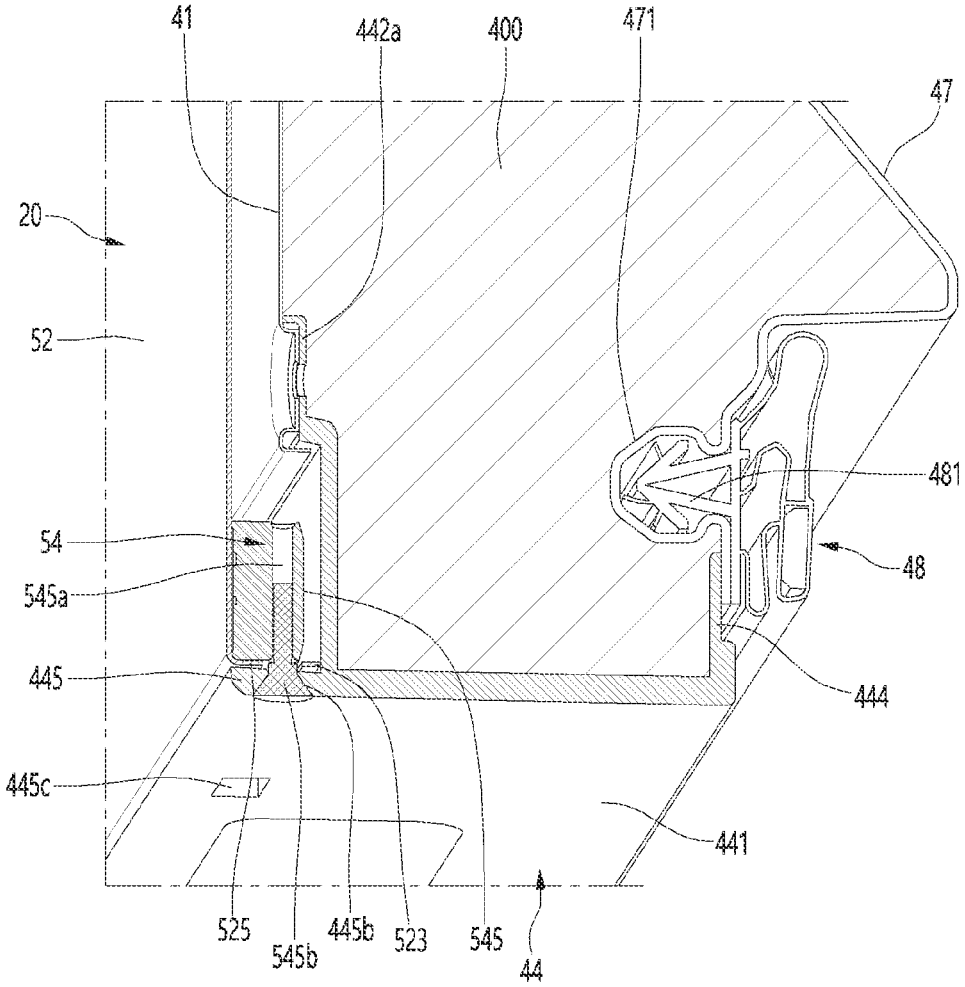
FIG. 17 is a cutaway perspective view taken along line XVII-XVII' of FIG. 2.

FIG. 15 is a perspective view of the lower bracket that is one component of the panel assembly. FIG. 16 is a cutaway perspective view taken along line XVI-XV1' of FIG. 2. FIG. 17 is a cutaway perspective view taken along line XVII-XVII' of FIG. 2.

As illustrated in the drawings, the lower bracket 54 may be injection-molded by using a plastic material and may be provided on the lower end of the panel 52. The lower bracket 54 may extend to a length corresponding to the horizontal width of the panel 52. The lower bracket 54 may to have a vertical width at which at least a lower coupling boss 545 is disposed.

The lower bracket 54 may be hooked to be restricted by the lower cap decoration 44, and a lower coupling member 545*b* passing through the lower cap decoration 44 may be coupled, and thus, the lower end of the panel assembly 50 may be firmly fixed to the door body 40. For example, the lower coupling member 545*b* may be a screw.

In detail, the lower bracket 54 may be provided with a lower adhesion portion 541 mounted on the rear surface of the panel 52. The lower adhesion portion 541 may be provided in a flat shape and may be attached to the rear surface of the panel 52 by an adhesive. The lower bracket 54 may be disposed at a position corresponding to the lower end of the panel 52 in a state in which the lower adhesion portion 541 is attached to the rear surface of the panel 52.

A lower protrusion 543 protruding backward from the lower adhesion portion 541 may be disposed backward from the lower adhesion portion 541. The lower protrusion 543 may extend from one side of the lower adhesion portion 541 to a position corresponding to the lower end of the lower adhesion portion 541.

A lower insertion portion 544 having an opened bottom surface may be disposed on a bottom surface of the lower protrusion 543. That is, the lower insertion portion 544 may be provided in a shape that is recessed downward from the bottom surface of the lower bracket 54 so that the lower protrusion 445*a* of the lower cap decoration 44 is inserted. The lower insertion portion 544 may be disposed over the entire bottom surface of the lower bracket 54. The lower insertion portion 544 may be defined at a position facing the bent portion opening 524 defined in the lower bent portion 523 of the panel 52.

Thus, when the panel assembly 50 is mounted at a fixed position of the door body 40, the lower protrusion 445*a* may be inserted into the lower insertion portion 544 by passing through the bent portion opening 524, and the lower end of the panel assembly 50 may be fixed. The state in which the lower protrusion 445*a* is inserted into the bent portion opening 524 and the lower insertion portion 544 may be referred to as a temporarily fixed state because of a re-detachable state when the panel assembly 50 is lifted before the coupling members 424*d* and 545*b* are coupled.

A lower coupling boss 545 may be disposed on the lower adhesion portion 541. The lower coupling boss 545 may protrude from a rear surface of the lower adhesion portion 541 to extend from the lower end to upper end of the lower bracket 54.

A screw hole 545*a* may be defined in a bottom surface of the lower coupling boss 545. The lower coupling boss 545 may pass through the lower protrusion 543 to extend downward. Thus, the screw hole 545*a* defined in the top surface of the lower coupling boss 545 may be disposed at a position corresponding to the position of the opened bottom surface of the lower insertion portion 544.

The screw hole 545*a* may be defined at a position corresponding to the screw hole 445*b* defined in each of the lower cap decoration 44 and the bent portion screw hole 525 defined in the lower bent portion 523. Thus, the lower coupling boss 545 may be disposed at a position corresponding to each of the bent portion screw hole 525 and the screw hole 445*b* and may be provided as many as a corresponding number. For example, three lower coupling bosses 545 may be provided on a center and both left and right sides of the lower bracket 54, respectively.

When the panel assembly 50 is mounted on the door body 40 so that the lower protrusion 445*a* is inserted into the bent portion opening 524 and the lower insertion portion 544, the screw hole 445*b* of the lower cap decoration 44, the bent portion screw hole 525, and the screw hole 545*a* may be aligned with each other. In this state, when the screw 545*b* is coupled to pass through the screw hole 445*b* of the lower cap decoration 44 and the bent portion screw hole 525, the screw 545*b* may be coupled to the screw hole 545*a* of the lower bracket 54 so that the lower end of the panel assembly 50 is firmly fixed to the lower bracket 54.

The lower bracket 54 may be disposed at the lower end of the panel 52, and a height h1 from the lower end of the panel 52 to the lower bracket 54 may be less than a height h2 of the gasket 48. Here, the height of the gasket 48 may be a height from the lower end of the panel 52 to a center of the gasket mounting portion 481.

Thus, the lower bracket 54 may be disposed substantially outside the gasket 48, and thus, the thermal insulation performance of the storage space may not be affected. That is, even if the corresponding front surface of the lower cap decoration 44 is recessed to provide a structure having a relatively thin thickness due to the mounting of the lower bracket 54, the corresponding position may not be affected by cold air within the refrigerator, and thus, dew condensation may not be generated, and also, the thermal insulation performance of the door 20 may not be deteriorated. That is, the lower bracket 54 may also be disposed outside the thermal insulation region outside the gasket 48 to prevent the thermal insulation performance of the door 20 from being deteriorated.

Hereinafter an arrangement structure of the magnet 55 will be described in more detail with reference to the drawings.

Figure 18:
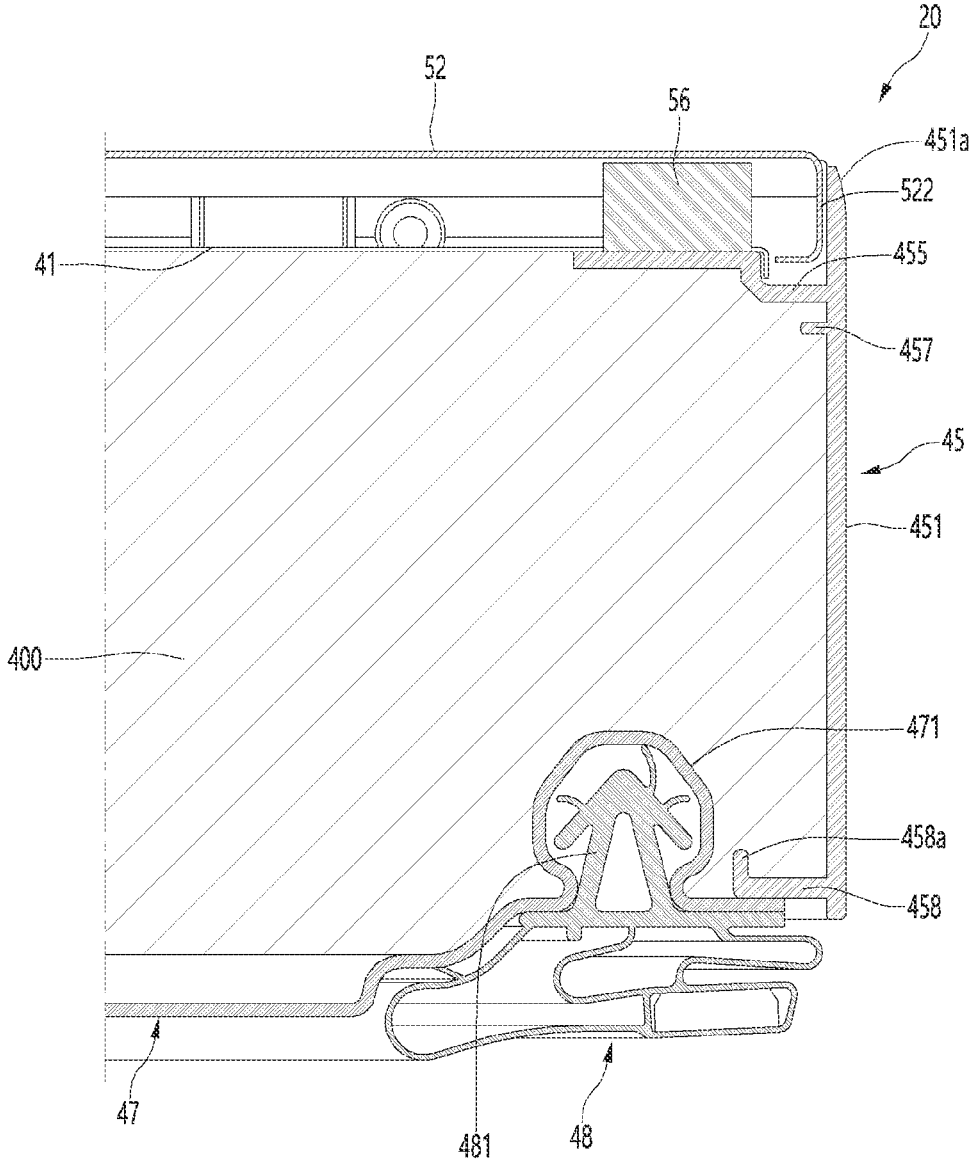
FIG. 18 is a cross-sectional view taken along line XVIII-XVIII' of FIG. 2.

FIG. 18 is a cross-sectional view taken along line XVIII-XVIII' of FIG. 2.

As illustrated in the drawing, a magnet 56 for assisting the mounting of the panel assembly 50 may be provided on the rear surface of the panel 52. The magnet 56 may extend lengthily in the vertical direction and may extends in the vertical direction along both left and right side ends of the panel 52.

One surface of the magnet 56 may adhere to the rear surface of the panel 52, and the other surface may be attached to the front plate 41 by magnetic force when the panel assembly 50 is mounted on the door body 40.

The magnet 56 may be disposed on each of the side portions 511 on both sides of the front plate 41. Therefore, a thickness of the magnet 56 may correspond to a distance between the rear surface of the panel 52 and the front panel 52, i.e., front surfaces of the side portions 511 when the panel assembly 50 is mounted.

The magnetic force may be applied to the panel assembly 50 and the front plate 41 in a direction in which the panel assembly 50 and the front plate 141 are close with respect to each other by the magnet 56. Thus, the panel assembly 50 may be maintained in a state of being further attached to the front surface of the door body 40.

The magnet 56 may be disposed in a space between the panel assembly 50 and the front plate 41. Thus, the thickness of the door body 40 may not be affected, and the thermal insulation performance of the door 20 may not be deteriorated.

Hereinafter, a process in which the panel assembly 50 is mounted on the door 20 of the refrigerator 1 having the above structure will be described in more detail with reference to the drawings.

Figure 19:
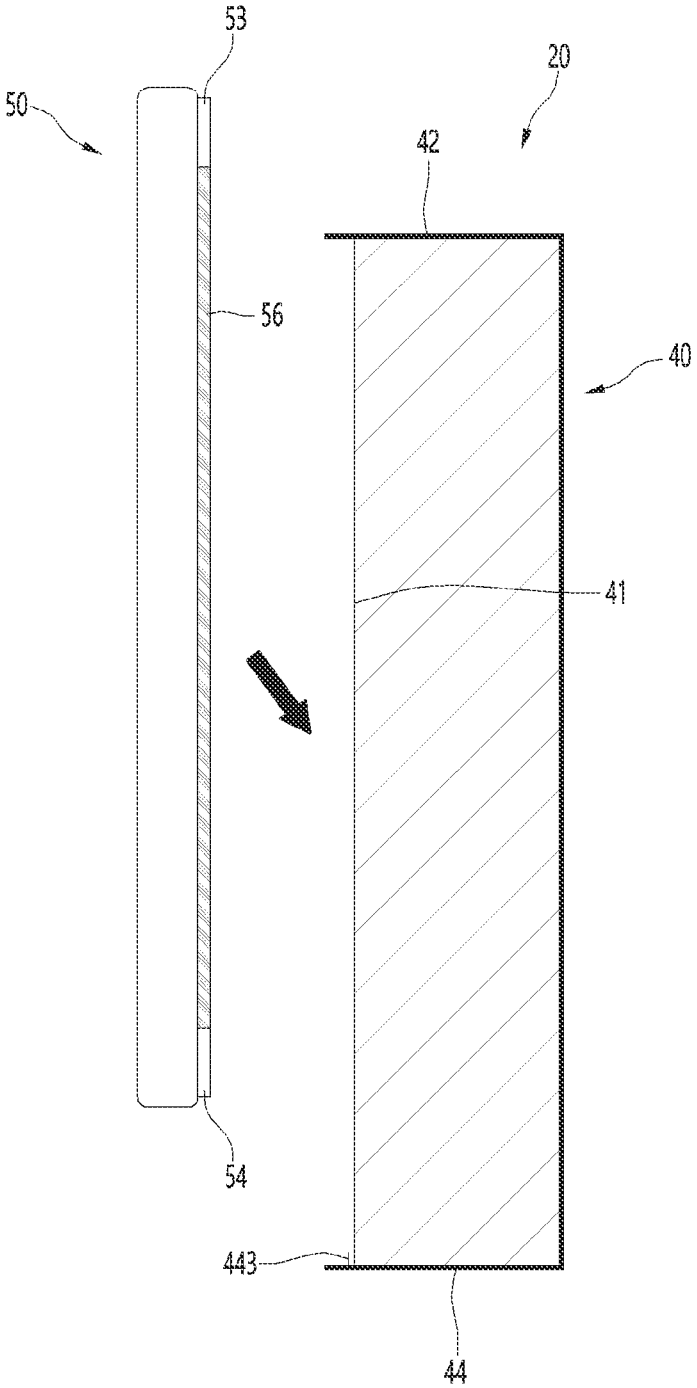
FIG. 19 is a schematic view illustrating a state before the panel assembly is mounted on the door body.

FIG. 19 is a schematic view illustrating a state before the panel assembly is mounted on the door body.

As illustrated in the drawing, the door 20 may be assembled by mounting the panel assembly 50 on the door body 40. For this, the panel assembly 50 may be completed by mounting the upper bracket 53, the lower bracket 55, and the panel fixing member 55 on the panel 52. After assembling the front panel 52 and the side frame 45, and the upper cap decoration 42, the lower cap decoration 44, and the accommodation member 46, an insulator 400 may be molded to complete the door body 40.

The panel assembly 50 may be disposed to be mounted on the front surface of the door body 40 in the assembled state. Here, the rear surface of the panel assembly 50 may be directed to the front surface of the door body 40, and the lower end of the panel assembly 50 may be disposed above the lower support end 445 to fix the panel. The hook portion 556 of the panel fixing member 55 may be disposed at a position at which the hook portion 556 is capable of being inserted through the plate opening 412 and the frame opening 453 in the front surface of the door body 40.

In detail, the panel assembly 50 may move backward from a front side to approach the front surface of the door body 40, and simultaneously, the panel assembly 50 may move to approach the front surface of the door body 40 while moving downward from an upper side.

Here, the lower protrusion 445*a* of the lower support end 445 may pass through the bent portion opening 524 and then be inserted into the lower insertion portion 544 to restrict the lower end of the panel assembly 50.

Thus, in the panel assembly 50, the downward movement may be restricted by the lower protrusion 445*a* and the lower bracket 54, and the forward and backward movement may be restricted by the panel fixing member 55.

That is, to mount the panel assembly 50, the panel assembly 50 may move to the front surface of the door body 40. Here, the lower end of the panel assembly 50 may be fixed to the lower support end 445 of the lower cap decoration 44.

As described above, the user may temporarily restrict the lower end of the panel assembly 50 to the door body 40 and then allow the upper end of the panel assembly 50 to be in close contact with the upper cap decoration 42.

When the panel assembly 50 is mounted, a state of the upper end of the panel assembly 50 will be described in more detail with reference to the drawings.

Figure 20:
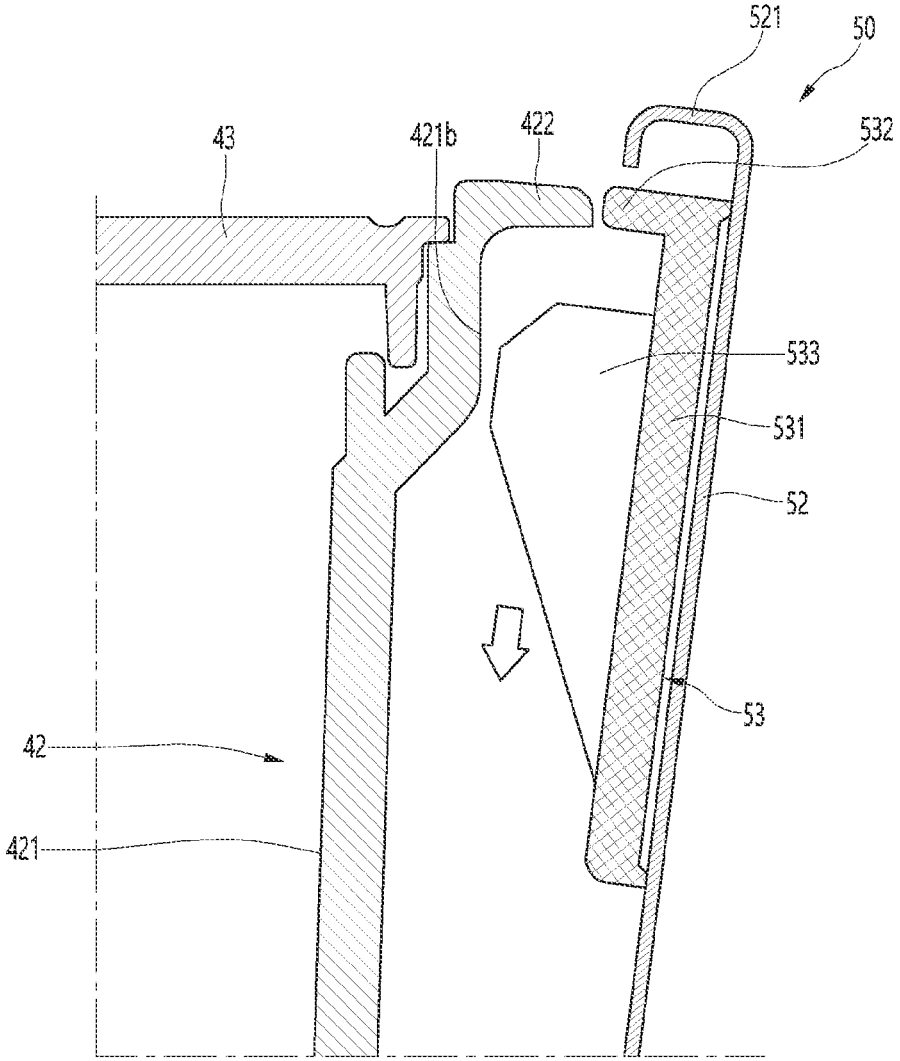
FIGS. 20 to 22 are views sequentially illustrating a change in position of the panel assembly when the panel assembly is mounted.
Figure 21:
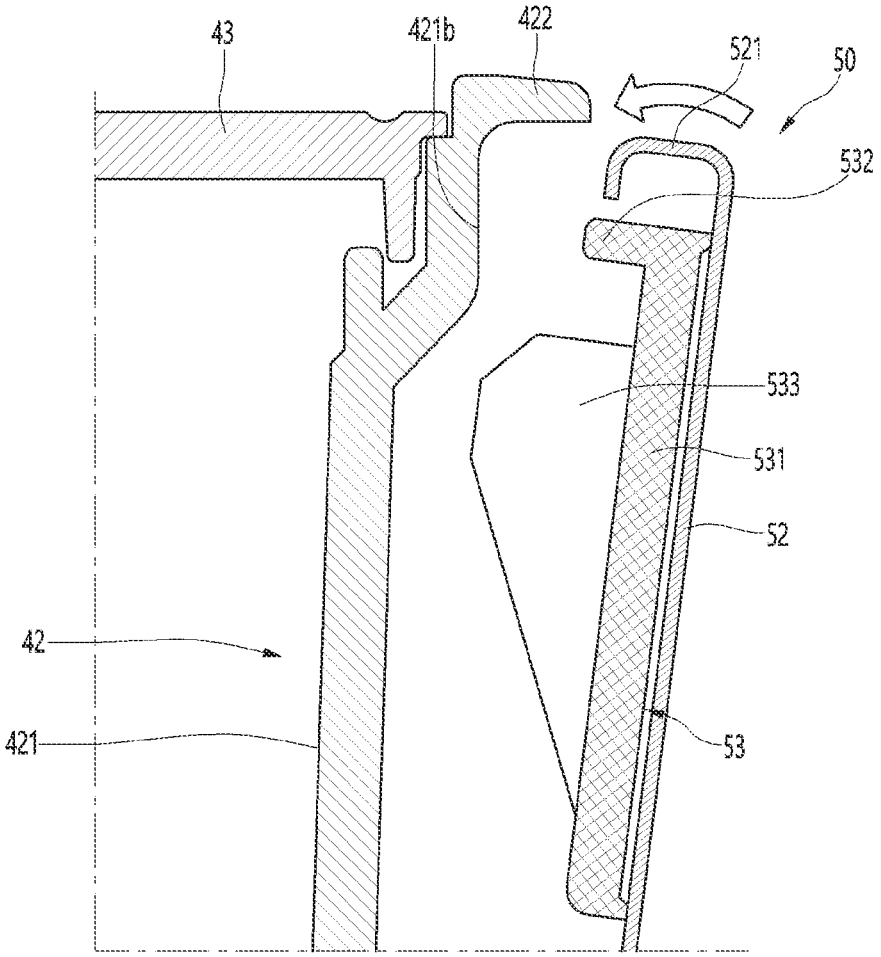
Figure 22:
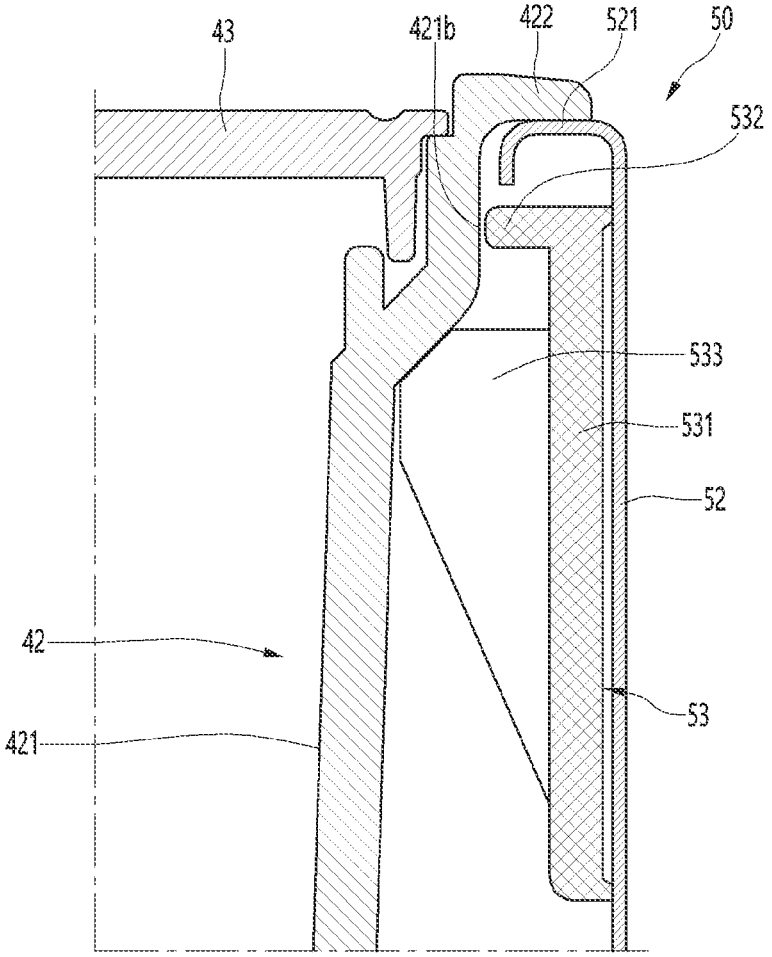

FIGS. 20 to 22 are views sequentially illustrating a change in position of the panel assembly when the panel assembly is mounted.

As illustrated in the drawings, when the panel assembly 50 is mounted, the lower protrusion 445*a* may move downward to be inserted into the lower insertion portion 544 of the lower bracket 54. Here, the lower end of the panel assembly 50 may move downward in a state of being inclined closer to the door body 40 than the upper end thereof, and the lower end of the panel assembly 50 may be temporarily fixed by being seated on the lower support end 445.

Here, the upper end of the panel assembly 50 may move downward to pass through the upper support end 422 as illustrated in FIG. 20. An upper rib 532 may protrude from an upper end of the rear surface of the panel assembly 50. The upper rib 532 may protrude further backward than the upper bent portion 521. Thus, the upper rib 1532 may be in contact with the upper support end 422 while the panel assembly 50 moves downward. Thus, a sharp upper end of the panel 52 may be prevented from being in contact with the upper support end 422 to prevent the upper support end 422 from being scratched or damaged.

When the lower protrusion 445*a* is completely inserted into the lower insertion portion 544, the upper end of the panel assembly 50 may be in a state as illustrated in FIG. 21, and the upper rib 532 and the upper bent portion 521 may be in a state of being disposed below the upper support end 422.

In a state in which the lower end of the panel assembly 50 is supported by the lower support end 445 and temporarily fixed, the user may allow the upper end of the panel assembly 50 to rotate to be in contact with the front surface of the upper cap decoration 42.

When the upper end of the panel assembly 50 completely rotates, as illustrated in FIG. 22, the upper bent portion 521 may be in contact with the upper support end 422. The upper bracket 53 may be in close contact with the upper cap decoration 42, and the upper coupling protrusion 533 may be in close contact with the upper coupling portion 424 so that the upper coupling member 424*d* is coupled.

Figure 23:
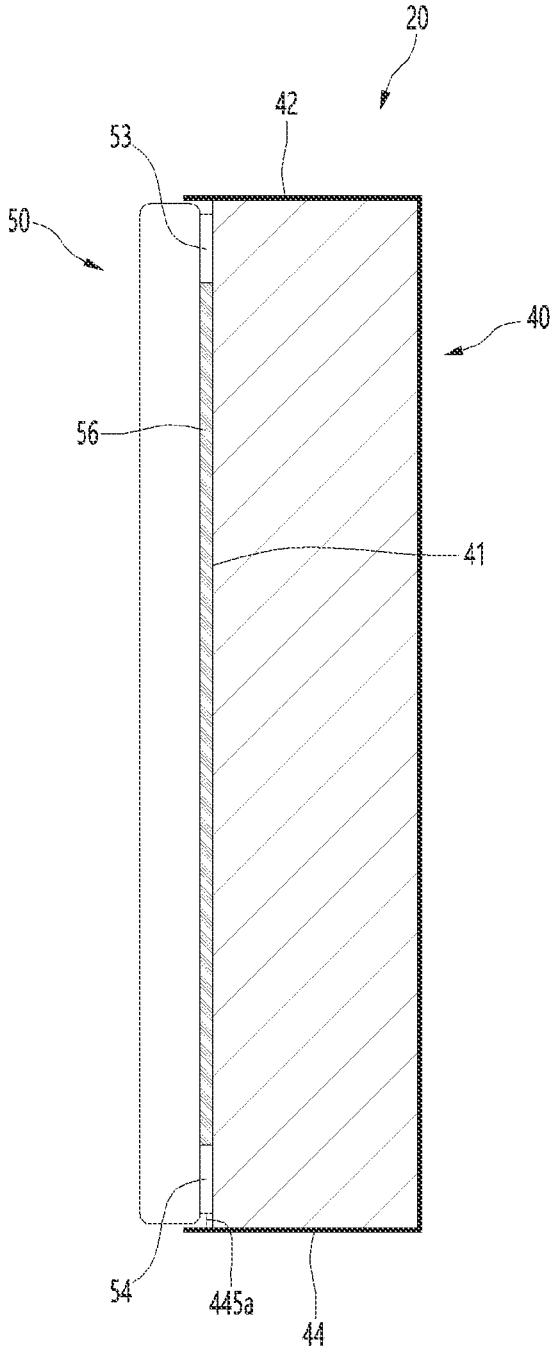
FIG. 23 is a schematic view illustrating a state in which the panel assembly is mounted on the door body.

FIG. 23 is a schematic view illustrating a state in which the panel assembly is mounted on the door body.

As illustrated in the drawing, when the panel assembly 50 is mounted on the front surface of the door body 40, the panel assemblies 50 may be disposed inside a region defined by the upper support end 422, the lower support end 445, and the side support end 451*a*, respectively, and may be disposed in contact with each other.

When the panel assembly 50 is mounted on the front surface of the door body 40, the lower protrusion 445*a* may pass through the lower bent portion 523 and be inserted into the lower bracket 54. Thus, the panel assembly 50 may not be easily separated by its own weight in the state in which the lower end of the panel assembly 50 is restricted. The upper end of the panel assembly 50 may be in a state in which the upper coupling protrusion 533 is in close contact with the upper coupling portion 424.

Particularly, the panel assembly 50 may be maintained in a state of being attached to the front surface of the door body 40 by the magnet 56 attached to the rear surface of the panel assembly 50. Thus, the panel assembly 50 may be temporarily fixed to the front of the door body 40.

Figure 24:
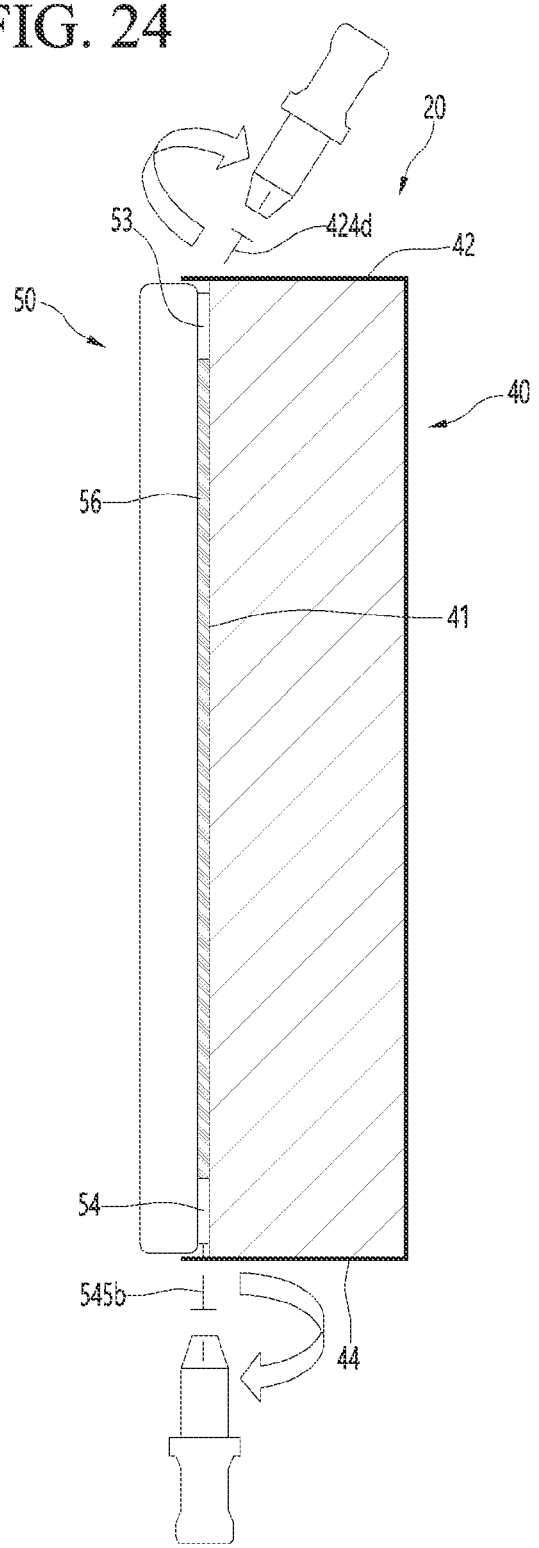
FIG. 24 is a schematic view illustrating a state in which the coupling member is coupled to the upper and lower ends of the panel assembly mounted on the door body.
Figure 25:
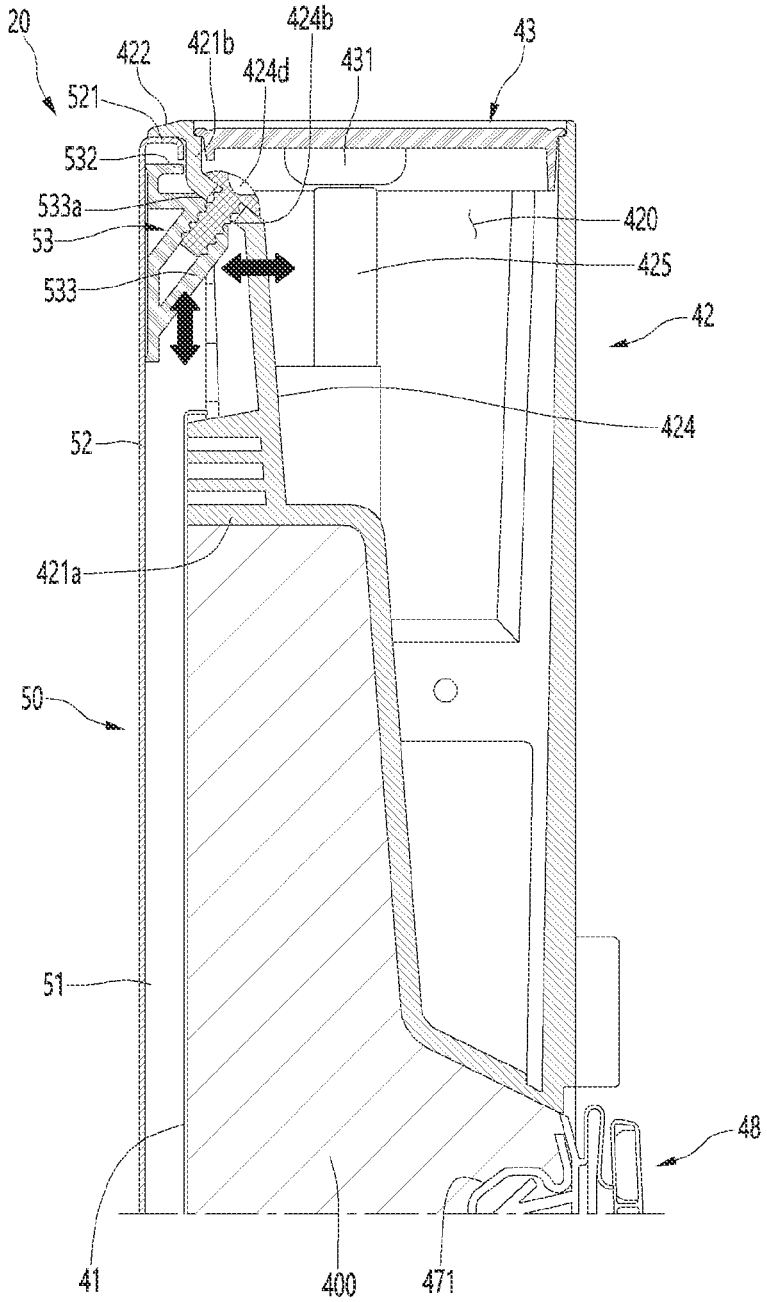
FIG. 25 is a view illustrating a state in which an upper end of a panel mounting portion is fixed.

FIG. 24 is a schematic view illustrating a state in which the coupling member is coupled to the upper and lower ends of the panel assembly mounted on the door body. FIG. 25 is a view illustrating a state in which an upper end of a panel mounting portion is fixed.

As illustrated in the drawings, in a state in which the panel assembly 50 is disposed on the front surface of the door body 40, coupling members 424*d* and 545*b* may be coupled to firmly fix the upper and lower ends of the panel assembly 50.

In detail, when the panel assembly 50 is mounted on the front surface of the door body 40, a screw hole 445*b* of the lower cap decoration 44, a bent portion screw hole 525 of the panel 52, and a screw holes 545*a* of the lower bracket 54 may be aligned with each other. In this state, when the screw 545*b* is coupled to pass through the screw hole 445*b* and the bent portion screw hole 525, the screw 545*b* may be coupled to the screw hole 545*a* of the lower bracket 54 so that the lower end of the panel assembly 50 is firmly fixed to the lower bracket 54.

When the panel assembly 50 is mounted on the front surface of the door body 40, the upper end of the upper bracket 53 may be in contact with the upper cap decoration 42. Particularly, the upper coupling protrusion 533 of the upper bracket 53 may be in contact with the upper coupling portion 424 of the upper cap decoration 42.

In detail, as illustrated in FIG. 25, when the panel assembly 50 is mounted, the upper coupling protrusion 533 may be inserted into the upper extension portion 424*a*. In the state in which the upper coupling protrusion 533 is inserted into the upper extension portion 424*a*, the protrusion inclined surface 533*a* of the upper coupling protrusion 533 may be in contact with the upper inclined surface 424*b* of the upper extension portion 424*a*. Also, the screw hole 533*b* of the protrusion inclined surface 533*a* and the screw hole 424*c* of the upper inclined surface 424*b* may be aligned with each other.

In this state, the user may couple the upper coupling member 424*d* through the recessed space 420 of the upper cap decoration 42. The upper coupling member 424*d* may pass through the screw hole 424*c* of the upper inclined surface 424*b* and be coupled to the screw hole 533*b* of the protrusion inclined surface 533*a*. The upper coupling member 424*d* may be coupled in a direction crossing the upper inclined surface 424*b* and the protruding inclined surface 533*a*. Thus, the panel assembly 50 may finely move upward and backward according to the coupling of the upper coupling member 424*d* and thus may be adjusted according to a degree of the coupling of the upper coupling member 424*d*.

The upper end of the panel assembly 50 may be fixed to the upper cap decoration 42 by coupling the upper coupling member 424*d*. The upper end of the panel assembly 50 may be in contact with the upper support end 422 or be maintained at a predetermined distance.

When the door body 40 is mounted in a state in which the door body 40 is laid down for assembly of the door 20, the upper coupling member 424*d* may be disposed to be inclined, and thus, the coupling of the upper coupling member 424*d* may be more easily performed through the recessed space 420.

The panel assembly 50 may constitute the front surface of the door 20, and not only the upper door 20 but also other doors 20*a*, 20*b*, 20*c*, and 30 may also have the same structure.

Figure 26:
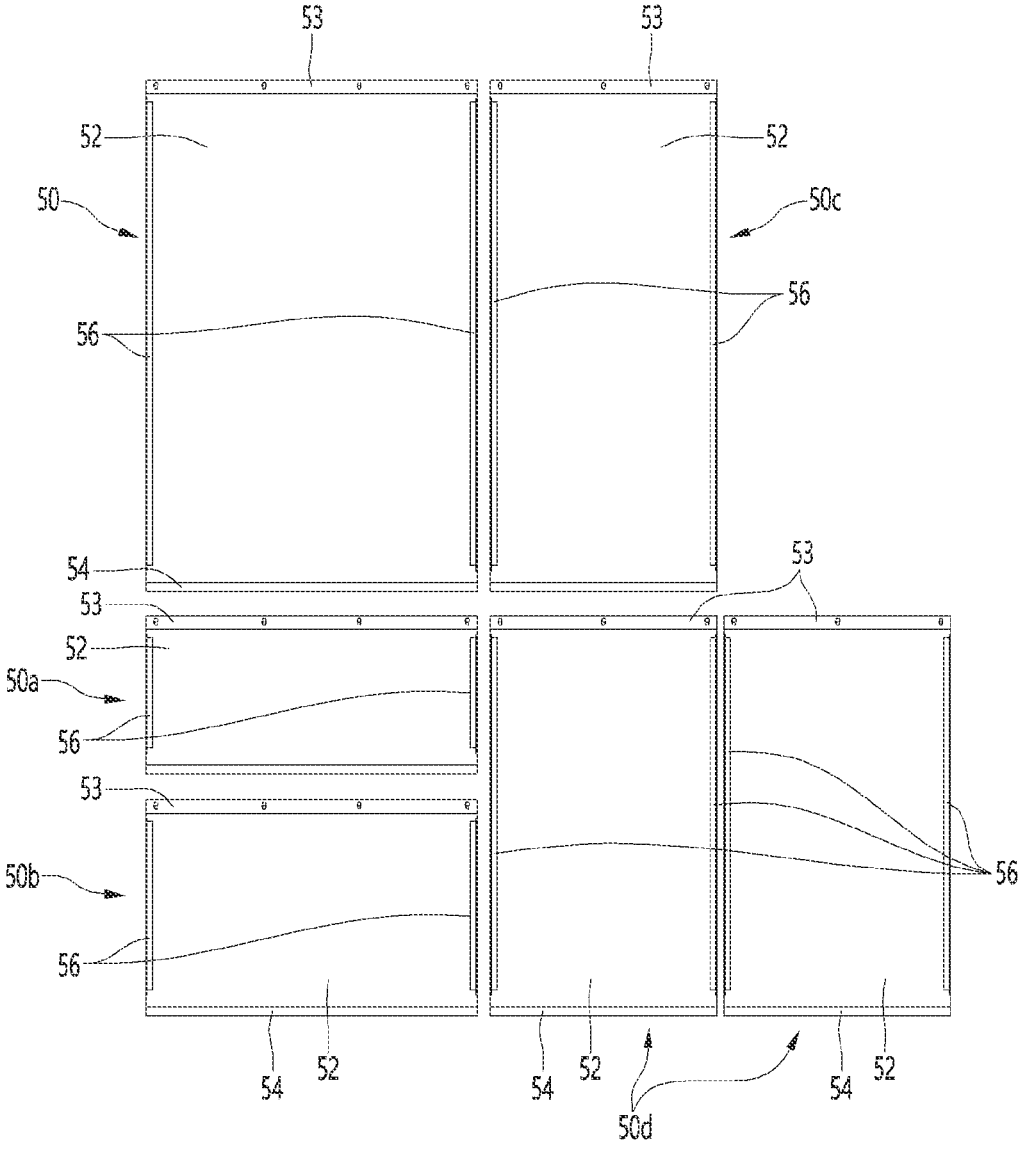
FIG. 26 is a rear cross-sectional view of the panel assembly mounted on each of the refrigerators of FIG. 1.

FIG. 26 is a rear cross-sectional view of the panel assembly mounted on each of the refrigerators of FIG. 1.

As illustrated in the drawing, a plurality of doors 20, 20*a*, 20*b*, 20*c*, and 30 constituting the refrigerators 1 and 1' according to an embodiment of the present invention may have the same panel assembly structure as the panel assemblies 50*a*, 50*b*, 50*c*, and 50*d*.

The doors 20, 20*a*, 20*b*, 20*c*, and 30 have a difference only in a horizontal width and a vertical length, but the configuration of the panel assemblies 50, 50*a*, 50*b*, 50*c*, and 50*d* may have the same structure. That is, an upper bracket 53 and a lower bracket 54 may be mounted at upper and lower ends of the panel 52, respectively, and the upper bracket 53 and the lower bracket 54 may have the same structure.

A panel fixing member 55 may be mounted at each of both left and right ends between the upper bracket 53 and the lower bracket 54. Here, only the number of panel fixing members 55 arranged in the vertical direction may be different according to the vertical length of the panel 52, but the structure may be the same.

Also, door bodies 40 constituting the doors 20, 20*a*, 20*b*, 20*c*, and 30 are not illustrated in detail, but all of the door bodies may have the same structure or may be coupled to the same panel assemblies 50, 50*a*, 50*b*, 50*c*, and 50*d*.

In addition to the foregoing embodiment, a refrigerator according to various embodiments may be exemplified. According to another embodiment of the present invention, a structure in which only a magnet and an upper bracket are provided in the panel assembly may be provided. Further another embodiment of the present invention is all the same as the above-described embodiment except for the constituents of the panel assembly, and thus, the same components will be denoted by the same reference numerals, and detailed descriptions thereof will be omitted.

Figure 27:
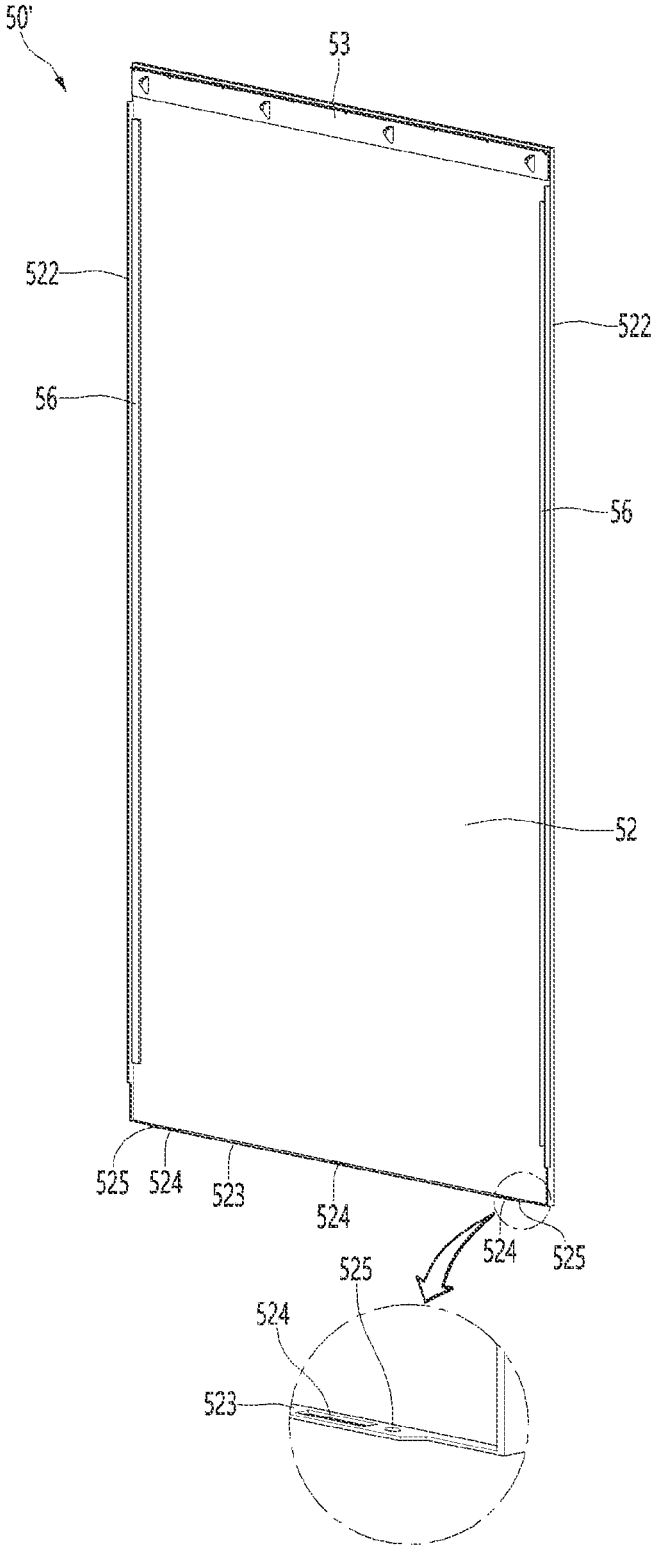
FIG. 27 is a rear perspective view of a panel assembly according to a second embodiment of the present invention.
Figure 28:
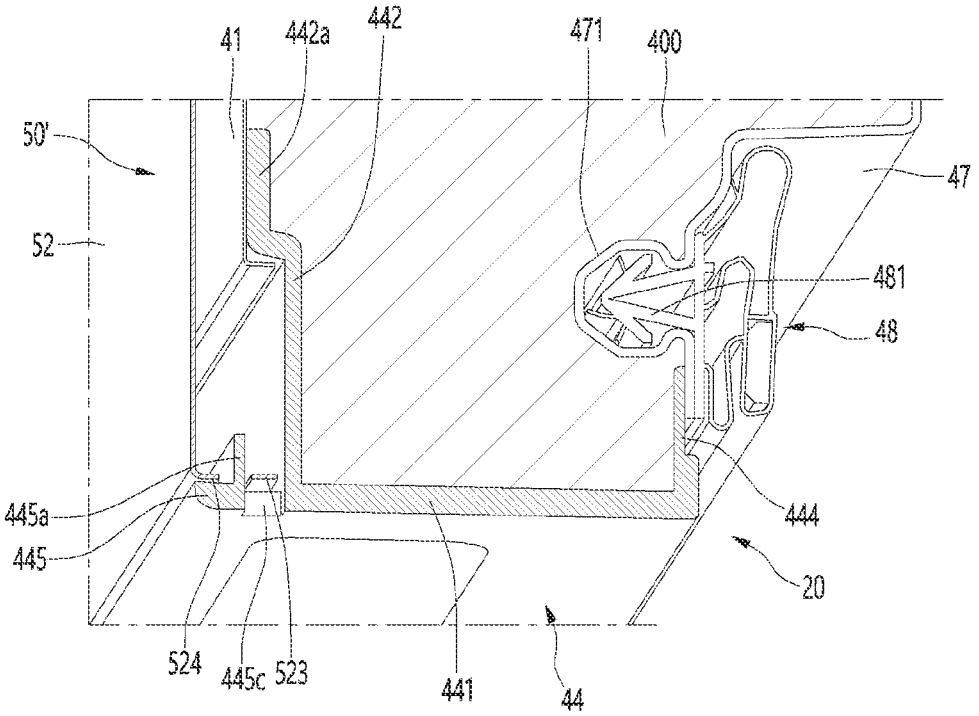
FIG. 28 is a cutaway perspective view illustrating a state in which the panel assembly is mounted.

FIG. 27 is a rear perspective view of a panel assembly according to a second embodiment of the present invention. FIG. 28 is a cutaway perspective view illustrating a state in which the panel assembly is mounted.

As illustrated in the drawing, a refrigerator door 20 according to a second embodiment of the present invention may include a door body 40 and a panel assembly 50' mounted on a front surface of the door body 40.

The panel assembly 50' may have a size corresponding to that of a front surface of the door body 40 and be configured to define an outer appearance of an entire front surface of the door 20 in a state of being mounted on the door body 40.

The panel assembly 50 may include a plate-shaped panel 52 defining an outer appearance and an upper bracket 53 for fixing upper and lower ends of the panel 52. The panel assembly 50 may further include a magnet 56 so that a rear surface of the panel 52' and a front surface of the door body 40 are attached to each other.

In detail, the panel 52 may be made of a rectangular plate-shaped material having a predetermined thickness and may be made of a material that is capable of being harmonized with the furniture or wall O or the home appliance disposed therearound.

For example, the panel 52 may be made of a plate-shaped metal material such as stainless steel. Printing, coating treatment, or film attachment may be performed on the front surface of the panel 52 to have a color or pattern, thereby defining the outer appearance of the door 20.

The panel 52' may be maintained in a stable support state when mounted on the door body 40, and bent portions 512, 522, and 523 may be disposed along a circumference so that a cross-section of the panel 52 is not exposed to the outside. Thus, the outer appearance of the circumferential surface of the panel 52 may be defined by the bent portions 512, 522, and 523.

Each of the bent portions 521, 522, and 523 may include an upper bent portion 521 disposed on a circumference of an upper end of the panel 52, a side bent portion 522 disposed on each of both left and right ends of the panel 52, and a lower bent portion 523 disposed on a circumference of a lower end of the panel 52.

The lower bent portion 523 may be bent backward from the lower end of the panel 52. The lower bent portion 523 may have a bent portion opening 524 into which the lower protrusion 445*a* is inserted. The bent portion opening 524 may be defined along the lower bent portion 523 and may be provided in plurality at positions corresponding to the plurality of lower protrusions 445*a* protruding from the lower support end 445. A bent portion screw hole 525 may be further defined in the lower bent portion 523. The bent portion screw hole 525 may be a hole through which the lower coupling member 545*b* coupled to the lower bracket 54 passes and be provided in plurality at positions corresponding to the lower coupling boss 545 of the lower bracket 54.

A magnet 56 may be provided at each of both left and right ends of the panel 52. The magnet 56 may be attached to the rear surface of the panel 52 by an adhesive or magnetic force. The magnet 56 may extend from an upper end to a lower end of the panel 52. When the panel assembly 50 is mounted on the door body 40 in a state in which the magnet is attached to the panel 52 the magnet 56 may be attached to the front panel 52 by the magnetic force. That is, the mounting of the panel assembly 50' may be assisted by the magnet 56.

The upper bracket 53 may extend along an upper end of the panel 52 and have a length corresponding to a horizontal width of the panel 52. When the panel assembly 50 is mounted, the panel assembly 50 may be coupled to the upper cap decoration 42, and then, an upper end of the panel assembly 50 may be restricted.

A lower end of the panel assembly 50 may be primarily fixed by inserting the lower protrusion 445*a* into the bent portion opening 524. The lower coupling member 545*b* may pass through the screw hole 525 of the lower cap decoration 44 and be coupled to the lower coupling boss 545 so that the lower end of the panel assembly 50 is secondarily fixed.

In addition to the foregoing embodiment, a refrigerator according to various embodiments may be exemplified. In further another embodiment, a panel of a panel assembly may be made of a tempered glass material. In further another embodiment, other configurations except for the panel are all the same as those of the above-described embodiment, and the same components are denoted by the same reference numerals, and detailed descriptions thereof will be omitted.

Figure 29:
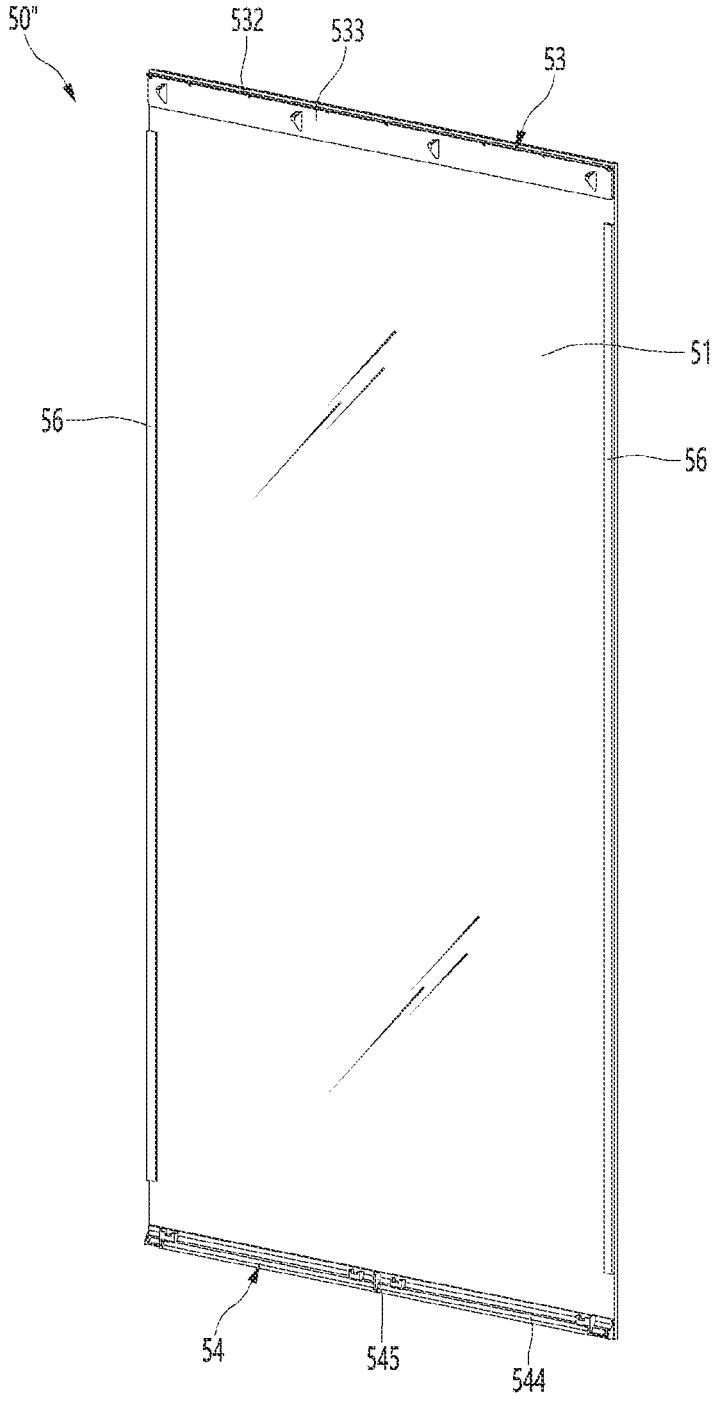
FIG. 29 is a rear perspective view of a panel assembly according to a third embodiment of the present invention.

FIG. 29 is a rear perspective view of a panel assembly according to a third embodiment of the present invention.

As illustrated in the drawing, a refrigerator door 20 according to a third embodiment of the present invention may include a door body 40 and a panel assembly 50" mounted on a front surface of the door body 40.

The door body 40 may include a front plate 41, a door liner 47, an upper cap decoration 42, a lower cap decoration 44, and a side frame 45 therein, and an accommodation member 46 may be mounted on a rear surface of the front plate 41. A structure of the door body 40 may be exactly the same as the structure of the above-described embodiment.

The panel assembly 50" may be mounted on a front surface of the door body 40 to define an outer appearance of a front surface of the door 20. The panel assembly 50" may include a panel 51, an upper bracket 53, a lower bracket 54, and a panel fixing member 55. Specific structures and shapes of the upper bracket 53, the lower bracket 54, and the panel fixing member 55 excluding the panel 51 may be the same as those of the above-described embodiment.

In detail, the panel 51 may be made of a rectangular plate-shaped material having a predetermined thickness and may be made of a material that is capable of being harmonized with the furniture or wall O or the home appliance disposed therearound. For example, the panel 51 may be made of a glass material. For example, the panel 51 may be made of a tempered glass material, and the outer appearance of the door 20 may be defined by printing or attaching a film so as to have a color or pattern.

The panel 51 may have a size so that, in the state in which the panel 51 is mounted on the door body 40, upper end lower ends of the panel 51 are supported by an upper support end 422 and a lower support end 445, respectively, and both side ends of the panel 51 are supported by side support ends 451*a*, respectively.

An upper bracket 53 and a lower bracket 54 may be provided on upper and lower ends of the rear surface of the panel 51, respectively. The upper bracket 53 and the lower bracket 54 may be configured so that the upper and lower ends of the panel assembly 50 are fixedly mounted to the door body 40.

The upper bracket 53 may be provided on an upper end of the panel 51 and may have a horizontal length that is equal to a horizontal length of the panel 51. An upper rib 532 may be disposed on a rear upper end of the upper bracket 53, and an upper coupling protrusion 533 may be disposed below the upper rib 532 so that the upper cap decoration 42 and the upper coupling member 424*d* are coupled.

The lower bracket 54 may be provided on a lower end of the panel 51 and may have a horizontal length that is equal to a horizontal length of the panel 51. A lower insertion portion 544 into which a lower protrusion 445*a* of the lower cap decoration 44 is inserted may be defined in a lower end of the lower bracket 54, and a lower coupling boss 545 to which a screw 545*b* through which the lower cap decoration 44 passes is coupled may be disposed.

A magnet 56 for assisting the mounting of the panel assembly 50 may be provided on the rear surface of the panel 51. The magnet 56 may extend lengthily in the vertical direction and may extends in the vertical direction along a side end of the panel fixing member 55. The magnet 56 may be provided with a pair on both left and right sides.

One surface of the magnet 56 may adhere to the rear surface of the panel 51, and the other surface may be attached to the front plate 41 by magnetic force when the panel assembly 50 is mounted on the door body 40.

Figure 30:
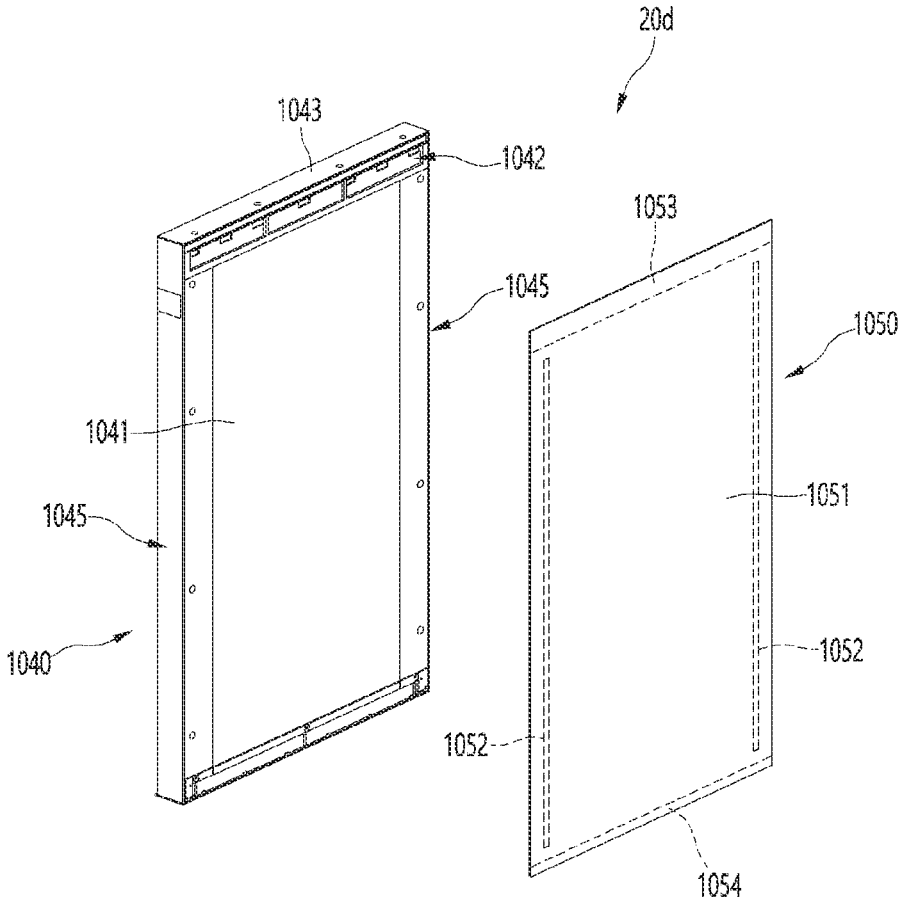
FIG. 30 is an exploded front perspective view of the door according to a fourth embodiment of the present invention.
Figure 31:
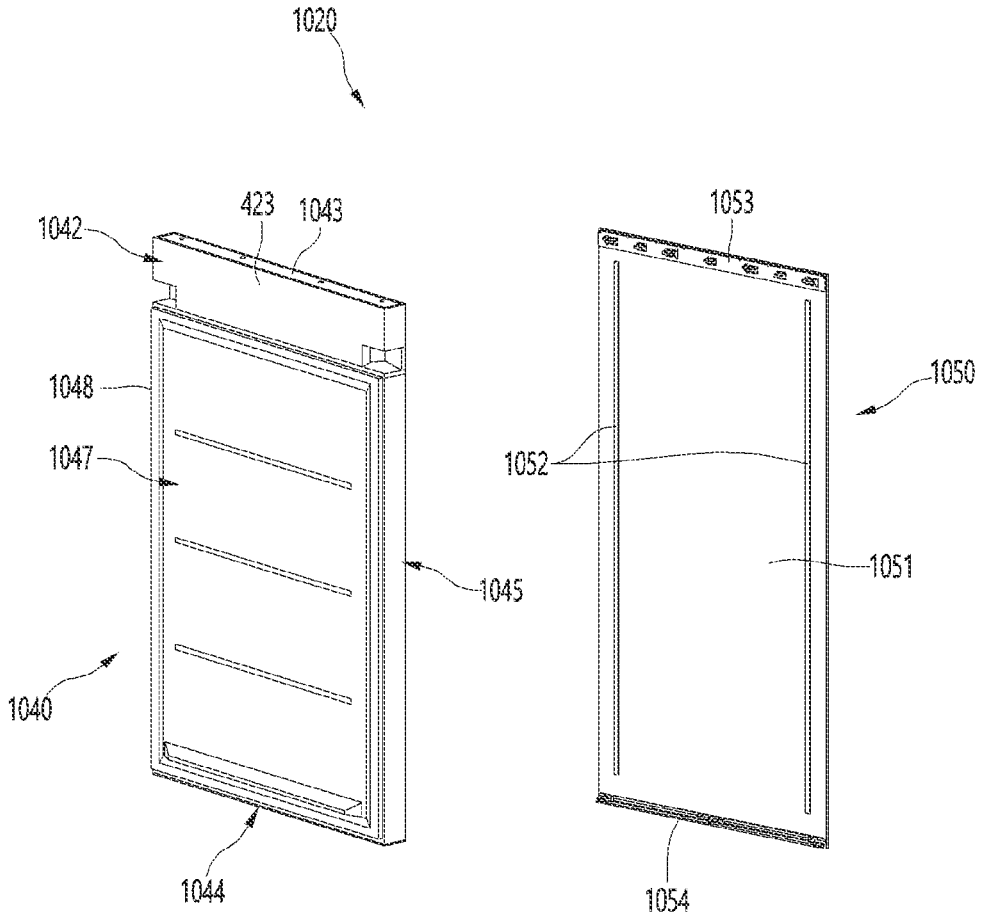
FIG. 31 is an exploded rear perspective view of the door.
Figure 32:
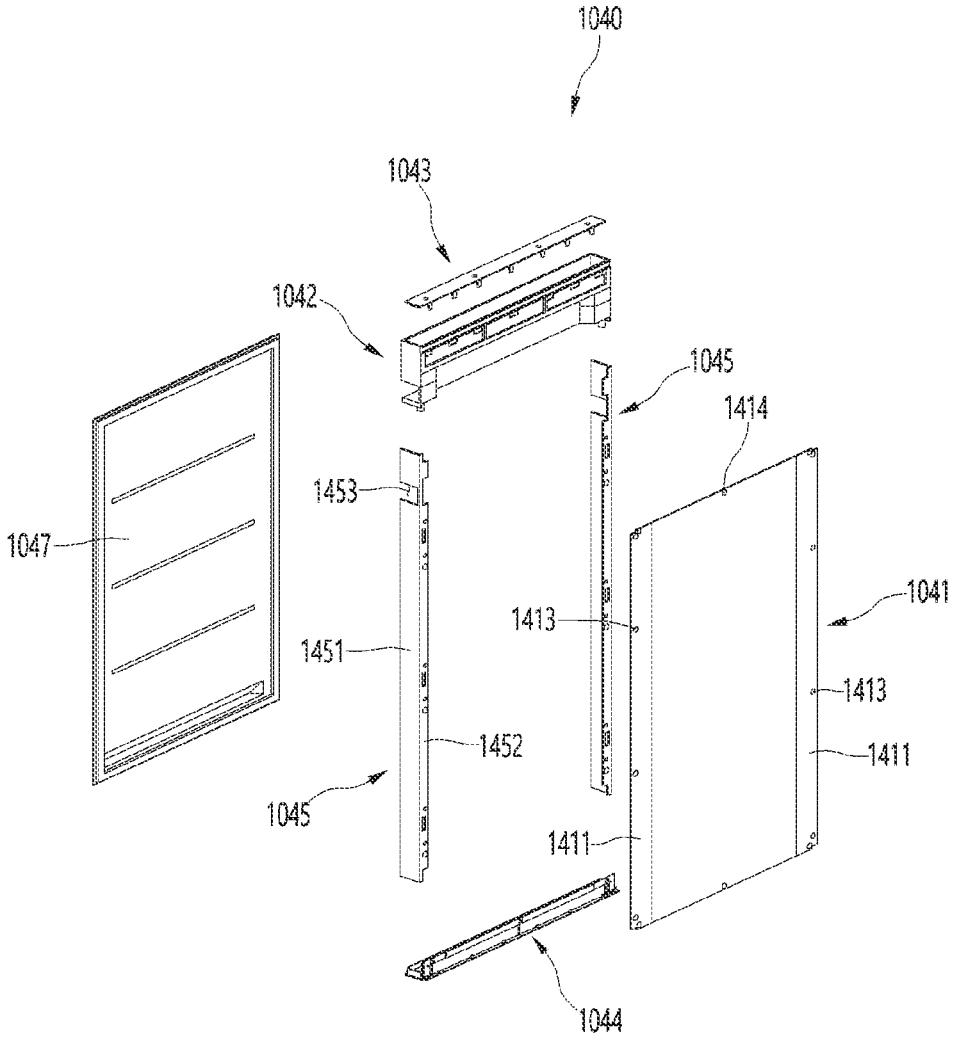
FIG. 32 is an exploded front perspective view illustrating a state in which a door body that is one component of the door is disassembled.

FIG. 30 is an exploded front perspective view of the door according to a fourth embodiment of the present invention. FIG. 31 is an exploded rear perspective view of the door. FIG. 32 is an exploded front perspective view illustrating a state in which a door body that is one component of the door is disassembled.

As illustrated in the drawings, the door 20*d* may be filled with an insulator 1049 (see FIG. 40) and may include a door body 1040 that substantially opens and closes the storage space and a panel assembly 1050 mounted on the door body 1040.

The door body 1040 may have a predetermined thickness, and the insulator 1049 may be filled therein to insulate the storage space. The panel assembly 1050 may be mounted on a front surface of the door body 1040 to define outer appearances of the front surfaces of the door 20*d* and the refrigerator 1. The panel assembly 1050 may be mounted to be easily detachable from the door body 1040, and the panel assembly 1050 may be easily detachable even when the door 20*d* is mounted on the cabinet.

The door body 1040 may include portions or all of a body plate 1041, a side frame 1045, a first cap decoration 1042, a second cap decoration 1044, a door liner 1047 as a whole.

The door body 1040 may be referred to as a frame assembly, the first cap decoration 1042 may be referred to as an upper frame, and the second cap decoration 1044 may be referred to as a lower frame. In addition, the body plate 1041 may be referred to as a front frame.

In detail, the body plate 1041 may define a front surface of the door body 1040 and be provided in a plate shape. The body plate 1041 may be made of a steel material and define a surface facing a rear surface of the panel assembly 1050.

A plurality of screw holes 1413 may be defined along a circumference of the body plate 1041. Screws coupled to the first cap decoration 1042, the second cap decoration 1044, and both the side frames 1045 may be coupled to the screw hole 1413.

A plate-stepped portion 1411 that is stepped rearward may be disposed on each of both side ends of the body plate 1041. The plate-stepped portion 1411 may define a space, in which the magnet 1052 is capable of being disposed when the panel assembly 1050 is mounted, and may extend in a vertical direction. The plate-stepped portion 1411 may be provided in a groove shape corresponding to a shape of the magnet 1052.

The first cap decoration 1042 and the second cap decoration 1044 may be respectively disposed at upper and lower ends of the body plate 1041 to define top and bottom surfaces of the door body 1040. The side frames 1045 may be coupled to both left and right side ends of the body plate 1041, respectively, and upper and lower ends of each of the side frames 1045 may be connected to the first cap decoration 1042 and the second cap decoration 1044, respectively.

The door liner 1047 may be coupled to rear surfaces of the first cap decoration 1042, the second cap decoration 1044, and the side frame 1045.

The gasket 1048 may be disposed along the circumference of the rear surface of the door liner 1047. The gasket 1048 may be in contact with a circumference of the cabinet while the door 20*d* is closed to seal the storage space.

The side frame 1045 may connect the first cap decoration 1042 to the second cap decoration 1044 and may connect the body plate 1041 to the door liner 1047.

The side frames 1045 at both left and right sides may have the same shape and may be disposed in a direction facing each other. The side frame 1045 may include a frame side surface 1451 and a frame front surface 1452.

In detail, the frame side surface 1451 may define a surface exposed to a side of the door body 1040 and be provided in a flat shape. An upper end of the frame side surface 1451 may be coupled to the first cap decoration 1042, and a lower end of the frame side surface 1451 may be coupled to the second cap decoration 1044.

A frame opening 1453 corresponding to a hinge mounting portion 1427 disposed on the first cap decoration 1042 may be defined in an upper portion of the frame side surface 1451. The frame opening 1453 may be provided in a shape corresponding to that of the opened side surface of the hinge mounting portion 1427.

The frame front surface 1452 may extend inward from a front end of the frame side surface 1451. The frame front surface 1452 may support both left and right side ends of the body plate 1041.

The first cap decoration 1042 may define a top surface of the door body 1040 and may be coupled to the body plate 1041, an upper end of the door liner 1047, and an upper end of each of the pair of side frames 1045. A decoration cover 1043 may be mounted on an opened top surface of the first cap decoration 1042.

The second cap decoration 1044 may define a bottom surface of the door body 1040 and may be coupled to the body plate 1041, a lower end of the door liner 1047, and a lower end of each of the pair of side frames 1045.

The body plate 1041, the door liner 1047, the side frame 1045, the first cap decoration 1042, and the second cap decoration 1044 may be coupled to each other so that the door body 1040 defines a closed space therein to define a space in which the insulator 1049 is filled.

Figure 33:
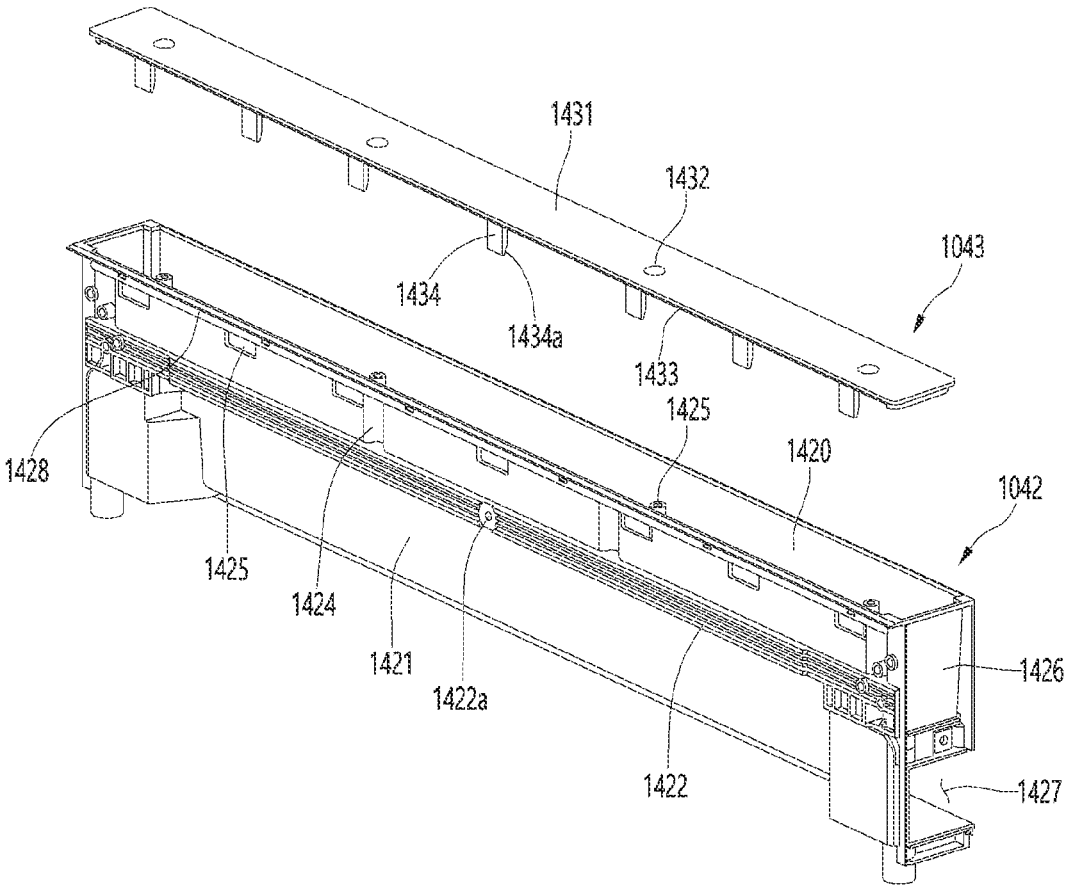
FIG. 33 is an exploded perspective view illustrating a state in which the first cap decoration and the decoration cover, each of which is one component of the door.
Figure 34:
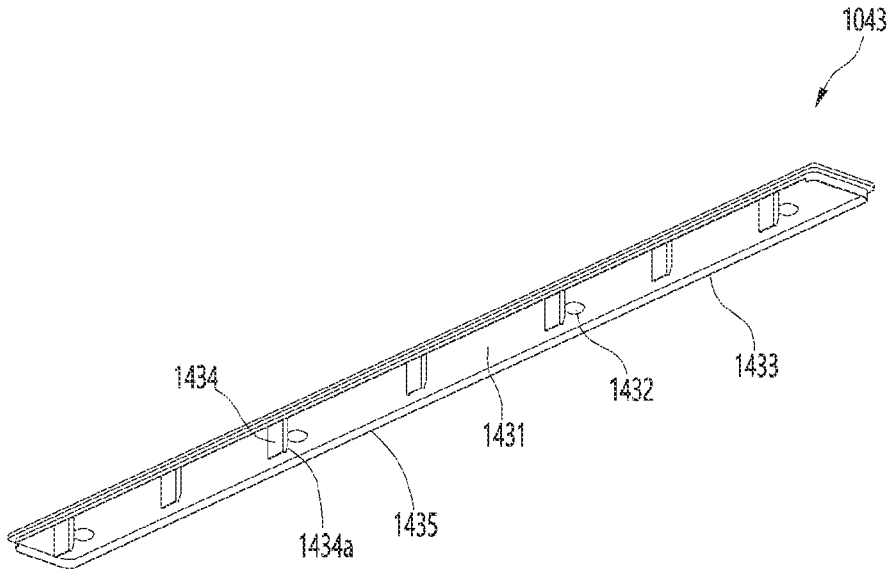
FIG. 34 is a perspective view of the decor cover.
Figure 35:
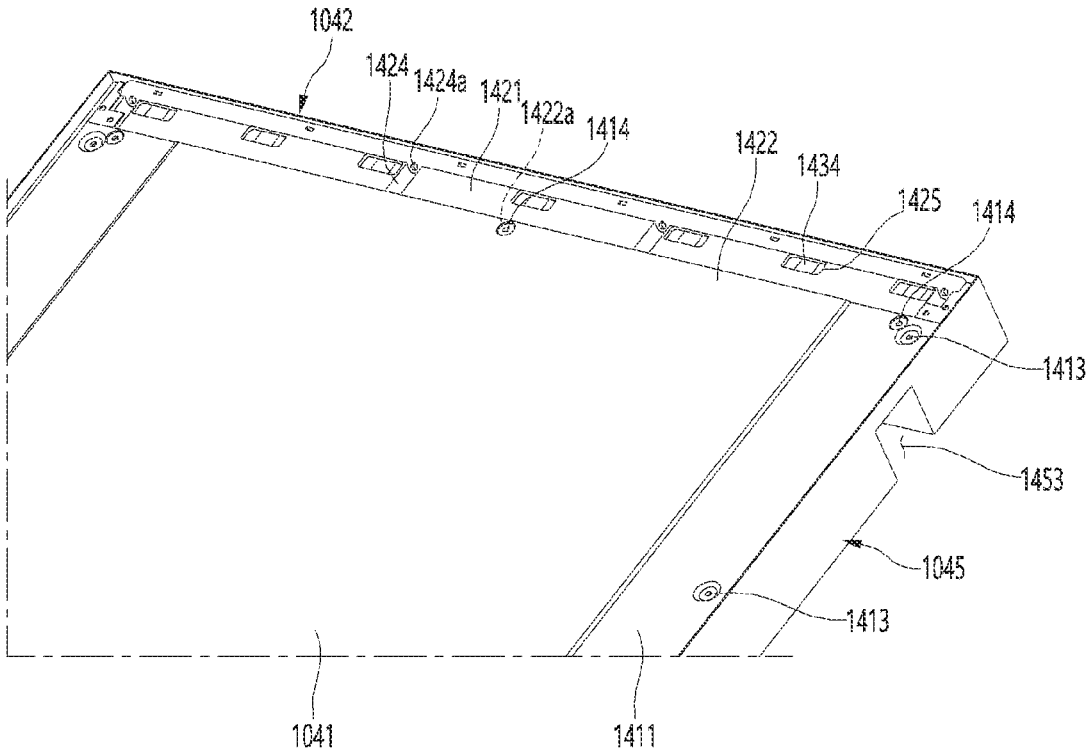
FIG. 35 is a partial perspective view illustrating a structure of an upper end of the door body.

FIG. 33 is an exploded perspective view illustrating a state in which the first cap decoration and the decoration cover, each of which is one component of the door. FIG. 34 is a perspective view of the decor cover. FIG. 35 is a partial perspective view illustrating a structure of an upper end of the door body.

As illustrated in the drawings, the first cap decoration 1042 may be configured to support the body plate 1041, the door liner 1047, and the upper end of the side frame 1045. Since the first cap decoration 1042 defines a top surface of the door 20*d*, the first cap decoration 1042 may be referred to as an upper cap decoration 42.

In detail, the first cap decoration 1042 may be made of a plastic material and may include a front surface 1421, a rear surface 1423, and both side surfaces 1426. The body plate 1041 may be coupled to the front surface 1421, the door liner 1047 may be coupled to the rear surface 1423, and the side frame 1045 may be coupled to each of both left and right side surfaces 1426.

A decoration recessed portion 1420 having an opened top surface may be defined in the first cap decoration 1042, and an upper end of the panel assembly 1050 may be restricted through the decoration recessed portion 1420.

A PCB or other electrical components for controlling the electronic components provided in the door 20*d* may be accommodated in the decoration recessed portion 420.

The decoration recessed portion 1420 may extend up to a lower end of the first cap decoration 1042, and when being injection-molded, the rear surface 1423 may be provided in a flat shape. The opened top surface of the decoration recessed portion 1420 may be shielded by the decoration cover 1043.

A decoration coupling portion 1428 extending upward may be disposed inside the decoration recessed portion 1420. The decoration coupling portion 1428 may support the decoration cover 1043 that shields the decoration recessed portion 1420 at a lower side. The decoration coupling portion 1428 may be configured so that a screw S passing through the cover hole 1432 of the decoration cover 1043 is coupled.

The front surface 1421 of the first cap decoration 1042 may be provided in a stepped shape by having a lower portion that is more recessed backward than an upper portion thereof. An upper plate coupling portion 1422 supporting the body plate 1041 at a rear side may be disposed on the front surface 1421 of the first cap decoration 1042. The upper plate coupling portion 1422 may extend from a left end to a right end of the first cap decoration 142, and also, a plurality of ribs and grooves may be continuously vertically disposed at regular intervals. Thus, even if the insulator 1049 is permeated, a space between the body plate 1041 and the upper plate coupling portion 1422 may be filled so that the upper plate coupling portion 1422 is more firmly fixed.

An upper end of the body plate 1041 may be coupled to the upper plate coupling portion 1422 by a screw. For this, a screw coupling portion may be disposed on the upper plate coupling portion 1422, and a screw hole 1414 through which the screw passes may be defined along an upper end of the corresponding body plate 1041.

A first support end 1428 protruding forward may be disposed on an upper end of a front surface of the first cap decoration 1042. The first support end 1428 may protrude forward and may support an upper end of the panel assembly 1050. A protruding length of the first support end 1428 may be less than a thickness of the panel assembly 1050. Thus, in a state in which the panel assembly 1050 is mounted, the first support end 1428 may not protrude forward from the panel assembly 1050. Thus, when viewed from a front side, the upper panel assembly 1050 may be completely exposed, and the first support end 1428 may be prevented from being excessively exposed.

An insertion hole 1425 may be defined between the first support end 1428 and the upper plate coupling portion 1422. The insertion hole may be opened so that an insertion protrusion 1534 of a first bracket 1053 to be described in detail below is inserted, and a plurality of insertion holes may be defined along a front surface of the first cap decoration 1042.

The insertion hole 1425 may be defined in a position facing the insertion protrusion 1534 and may be opened so that the insertion protrusion 1534 is inserted to protrude to the inside of the recess. The insertion hole 1425 may be provided in number corresponding to the insertion protrusion 1534 and may be spaced apart from one end to the other end of the first cap decoration 1042 at regular intervals in the horizontal direction.

The insertion hole 1425 may communicate with the decoration recessed portion 1420. Therefore, the insertion protrusion 1534 inserted into the insertion hole 1425 may protrude to the inside of the decoration recessed portion 1420 and be restricted by the restriction protrusion 1434 of the decoration cover 1043.

An upper coupling portion 1424 may be further disposed on the front surface of the first cap decoration 1042. The upper coupling portion 1424 may be configured to be coupled to the first bracket 1053 and may be disposed between the first support end 1428 and the upper plate coupling portion 1422.

The upper coupling portion 1424 may be recessed at a position corresponding to the upper coupling protrusion 1533 protruding from the first bracket 1053. For example, four upper coupling portions 1424 may be disposed at a pair of positions spaced apart from each other at left and right sides with respect to a center of the first cap decoration 1042. That is, the upper coupling portion 1424 may be disposed at each of both the side ends of the first cap decoration 1042 and may be further disposed at each of inner sides spaced apart from both the side ends.

The upper coupling portion 1424 may be recessed from a front surface corresponding to the decoration recessed portion 1420. Thus, the upper coupling protrusion 1533 may be inserted into the upper coupling portion 1424. The upper coupling portion 1424 may protrude to the inside of the decoration recessed portion 1420, and a screw hole 1424*a* through which a screw coupled through the decoration recessed portion 1420 passes may be defined. Thus, the screw passing through the screw hole 1424*a* may be coupled to the upper coupling portion 1424, and the upper end of the panel assembly 1050 may be firmly fixed to the first cap decoration 1042.

A hinge mounting portion 1427 may be opened at a side surface of the first cap decoration 1042. The hinge mounting portion 1427 may be opened to side and rear surfaces of the first cap decoration 1042, and a hinge may be mounted to allow the door 20*d* to rotate about a rotation axis of the hinge.

The decoration cover 1043 may shield the decoration recessed portion 1420 and simultaneously be coupled to the first bracket 1053 to restrict the upper end of the panel assembly 1050.

The decoration cover 1043 as a whole may include a cover portion 1431 that shields the decoration recessed portion 1420 and a restriction protrusion 1434 protruding downward from a bottom surface of the cover portion 1431. The cover portion 1431 may be provided in a plate shape and may have a size and shape corresponding to the opened top surface of the decoration recessed portion 1420. An edge portion 1435 extending downward along a circumference of the cover portion 1431 may be disposed to seal the decoration recessed portion 1420 when the decoration cover 1043 is mounted.

The restriction protrusion 1434 may be disposed at a position corresponding to the insertion hole 1425 and the insertion protrusion 1534, and a plurality of the restriction protrusions 434 may be disposed at regular intervals and be coupled to the insertion protrusion 1534 inserted by passing through the insertion hole 1425.

The restriction protrusion 1434 may be provided to further extend downward by passing through a through-hole 1534*a* of the insertion protrusion 1534 when the decoration cover 1043 is mounted. The restriction protrusion 1434 may have a width and thickness, which correspond to pass through the through-hole 1534*a*.

An inclined surface 1434*a* may be disposed on a lower end of a front surface of the restriction protrusion 1434. Thus, when the restriction protrusion 1434 is inserted into the through-hole 1534*a*, the inclined surface 1434*a* may be in contact with the inside of the through-hole 1534*a* so that the restriction protrusion is more smoothly inserted into the through-hole 1534*a* by the inclined surface 1434*a* and is more firmly hooked to be restricted by the insertion protrusion 1534 to allow the panel assembly 1050 to be firmly mounted.

A plurality of screw holes 1432 may be defined along the decoration cover 1043. A decoration coupling portion 1425 extending upward may be disposed inside the decoration recessed portion 1420 corresponding to the screw hole 1432. The decoration coupling portion 1425 may be disposed at a position corresponding to the screw hole 1432 and may extend to support the decoration cover 1043 at the lower side when the decoration cover 1043 is mounted. The screw passing through the screw hole 1432 may be coupled to a top surface of the decoration coupling portion 1425 so that the decoration cover 1043 is fixed.

The decoration cover 1043 may be maintained in a state of being firmly fixed to the top surface of the first cap decoration 1042 by the coupling of the screw. Here, the restriction protrusion 1434 of the decoration cover 1043 may also be maintained in the state of being restricted by the insertion protrusion 1534 so that the panel assembly 1050 is maintained in the state of being firmly mounted and is prevented from being arbitrarily separated.

Figure 36:
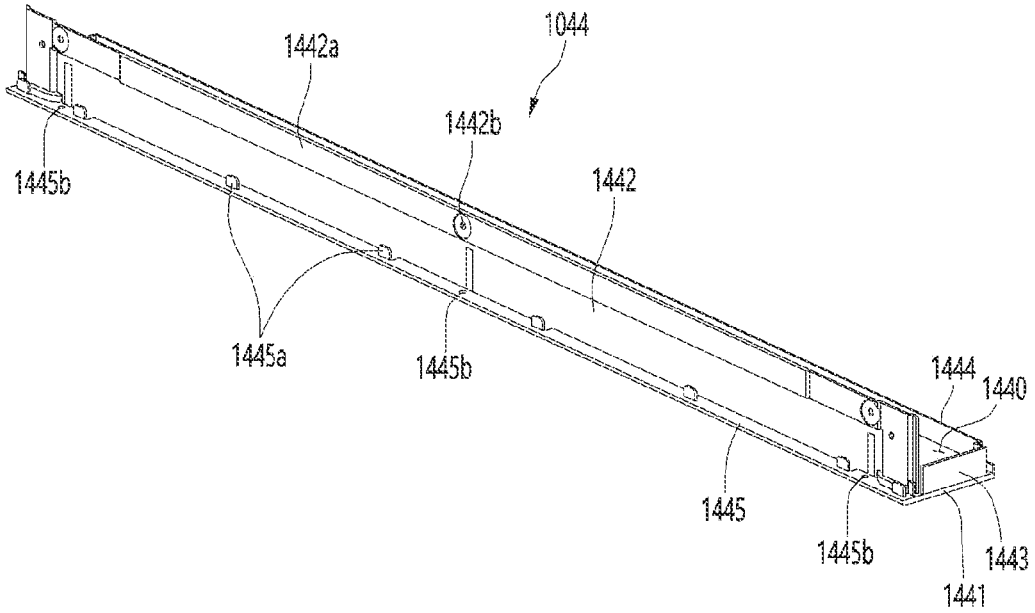
FIG. 36 is a perspective view of the second cap decoration that is one component of the door.

FIG. 36 is a perspective view of the second cap decoration that is one component of the door.

As illustrated in the drawings, the second cap decoration 1044 may be made of a plastic material may define a lower portion of the door body 1040 and also define a bottom surface of the door body 1040. Since the second cap decoration 1044 defines an outer appearance of a bottom surface of the door 20*d*, the second cap decoration 42 may be referred to as a lower cap decoration 42.

The second cap decoration 1044 may generally include a bottom surface 1441, a front surface 1442, a rear surface 1444, and both side surfaces 1443. The second cap decoration 1044 may define a space 1440 having an opened top surface, and the insulator 1049 may be filled in the space 1440.

The front surface 1442 may support the lower end of the body plate 1041 at the rear side. Both the side surfaces 1443 may support the lower end of the side frame 1045 at the inside. The rear surface 1444 may support the lower end of the door liner 1047 at a front side.

As described above, the closed space 1440 may be defined by the body plate 1041, the side frame 1045, and the door liner 1047, which are coupled to the front surface 1442, both the side surfaces 1443, and the rear surface 1444 of the second cap decoration 1044, and the insulator 1049 may be filled in the space 1440.

A lower plate coupling portion 1442*a* supporting the body plate 1041 at the rear side may be disposed on the front surface of the lower cap decoration 1044. The lower plate coupling portion 1442*a* may extend from a left end to a right end of the front surface and may protrude slightly forward to support the body plate 1041 at the rear side. A screw hole 1442*b* into which a plurality of screws passing through the body plate 1041 are coupled may be defined.

A second support end 1445 extending forward may be disposed on a lower end of the front surface 1442 of the second cap decoration 1044. The second support end 1445 may extend so that the bottom surface 1441 of the second cap decoration 1044 passes through a lower end of the front surface 1442 of the second cap decoration 1044.

The second support end 1445 may protrude to support the lower end of the panel assembly 1050, and a protruding length of the second support end 1445 may be less than the thickness of the panel assembly 1050. Thus, exposure of the second support end 1445 when viewed from the front side may be minimized so that the entire front surface of the door 20*d* is defined by the panel assembly 1050.

A restriction portion 1445*a* protruding upward may be disposed at a lower end of the second support end 1445. The restriction portion 1445*a* may be inserted into a second bracket 1054 to be described below to restrict the lower end of the panel assembly 1050.

A plurality of restriction portions 1445*a* may be disposed at regular intervals along the second support end 1445. Each of the restriction portion 1445*a* may be spaced apart from the front surface of the second cap decoration 1044.

A plurality of lower coupling holes 1445*b* may be defined in the second support end 1445. The lower coupling hole 1445*b* may pass through the second support end 1445 from the lower side so that the screw is coupled to the second bracket 1054. Thus, the lower end of the panel assembly 1050 seated on the second support end 1445 may be fixed more firmly.

A handle (see reference numeral 1446 in FIG. 40) may be further disposed on the bottom surface of the second cap decoration 1044 to allow the user to pull the door 20*d* and open the door 20*d* by inserting a hand.

Figure 37:
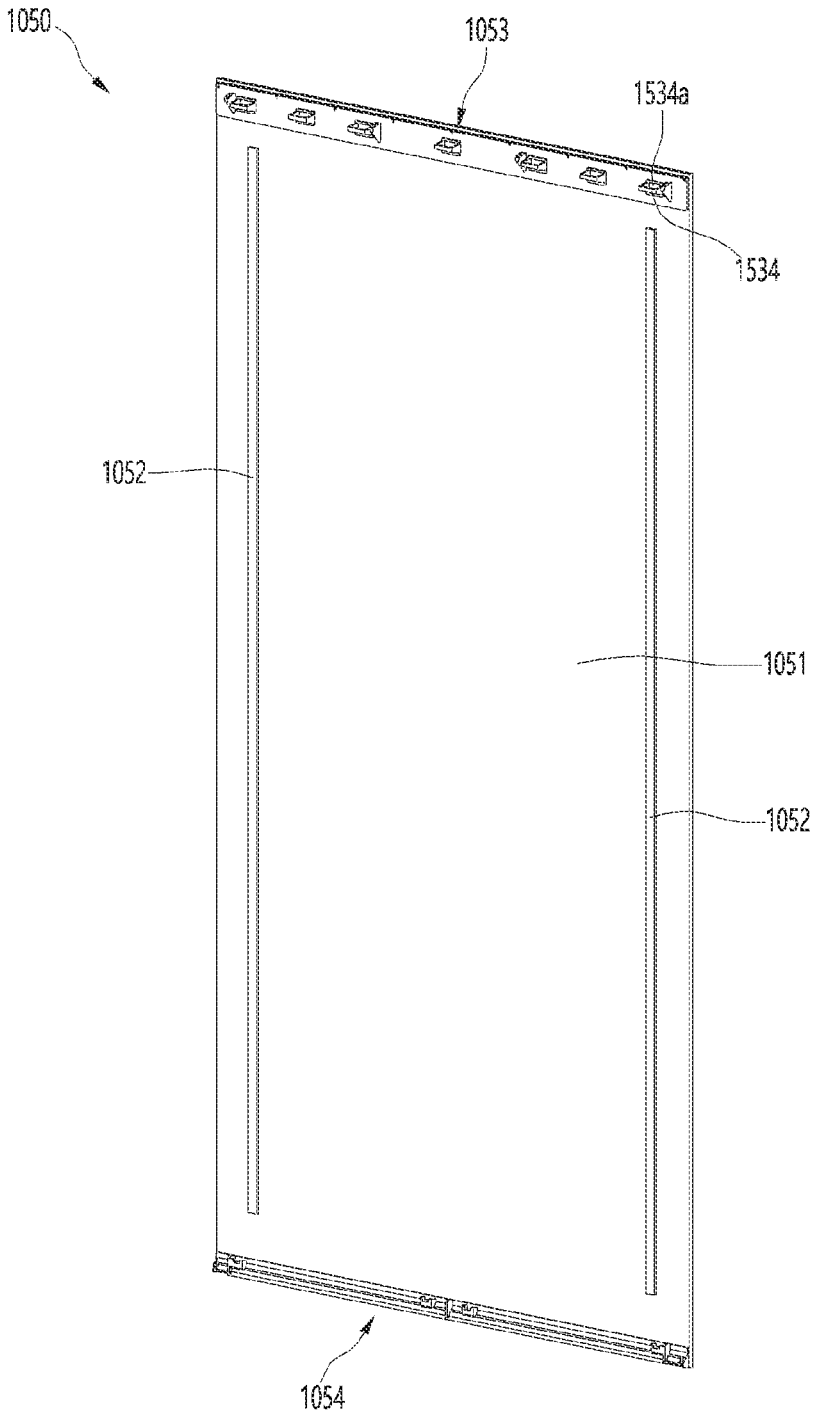
FIG. 37 is a perspective view of the panel assembly that is one component of the door.

FIG. 37 is a perspective view of the panel assembly that is one component of the door.

As illustrated in the drawing, the panel assembly 1050 may have a size corresponding to that of a front surface of the door body 1040 and be configured to define an outer appearance of an entire front surface of the door 20*d* in a state of being mounted on the door body 1040.

The panel assembly 1050 may include a plate-shaped panel 1051 defining an outer appearance, and first and second brackets 1053 and 1054 for fixing upper and lower ends of the panel 1051. The panel assembly 1050 may further include a magnet 1052 to be attached to a rear surface of the panel 1051 and a body plate 1041 of the door body 1040.

In detail, the panel 1051 may be made of a rectangular plate-shaped material having a predetermined thickness and may be made of a material that is capable of being harmonized with the furniture or wall or the home appliance disposed therearound. For example, the panel 1051 may be made of a glass material. For example, the panel 1051 may be made of a tempered glass material, and the outer appearance of the door 20*d* may be defined by printing or attaching a film so as to have a color or pattern.

The panel 1051 may have a size so that, in the state in which the panel 51 is mounted on the door body 1040, upper end lower ends of the panel 51 are supported by a first support end 1428 and a second support end 1445, respectively, and both side ends of the panel 51 may be supported by the side frame 1045.

A first bracket 1053 and a second bracket 1054 may be provided at upper and lower ends of the rear surface of the panel 1051, respectively. The first bracket 1053 and the second bracket 1054 may be configured so that the upper and lower ends of the panel assembly 1050 are fixedly mounted to the door body 1040.

The first bracket 1053 and the second bracket 1054 may extend along the upper and lower ends of the panel 1051 and may have a length corresponding to a left and right width of the panel 1051. When the panel assembly 1050 is mounted, the first bracket 1053 and the second bracket 1054 may be coupled to the first cap decoration 1042 and the second cap decoration 1044, respectively.

A magnet 1052 may be provided at each of both left and right ends of the panel 1051. The magnet 1052 may be attached to the rear surface of the panel 1051 by an adhesive or magnetic force. The magnet 1052 may extend from an upper end to a lower end of the panel 51. When the panel assembly 1050 is mounted on the door body 1040 in a state in which the magnet is attached to the panel 1051, the magnet 1052 may be attached to the body plate 1041 by the magnetic force. That is, the mounting of the panel assembly 1050' may be assisted by the magnet 1052.

Hereinafter, a structure of the first bracket 1053 will be described in detail with reference to the accompanying drawings.

Figure 38:
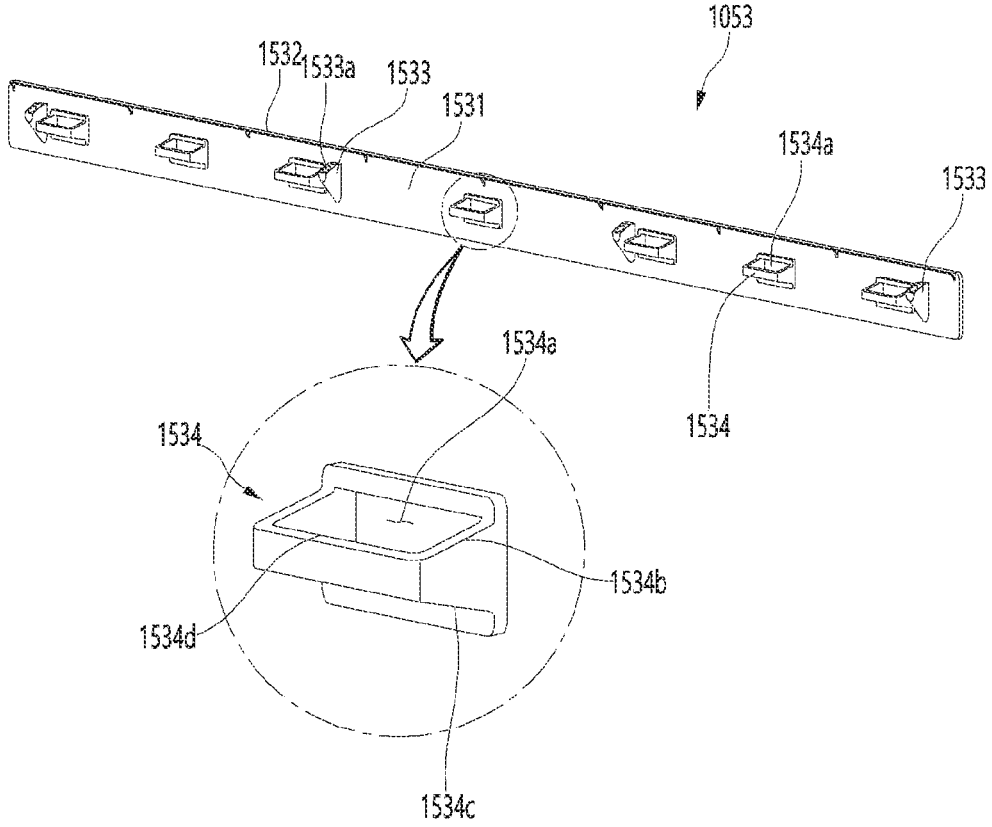
FIG. 38 is a perspective view of the first bracket that is one component of the panel assembly.
Figure 39:
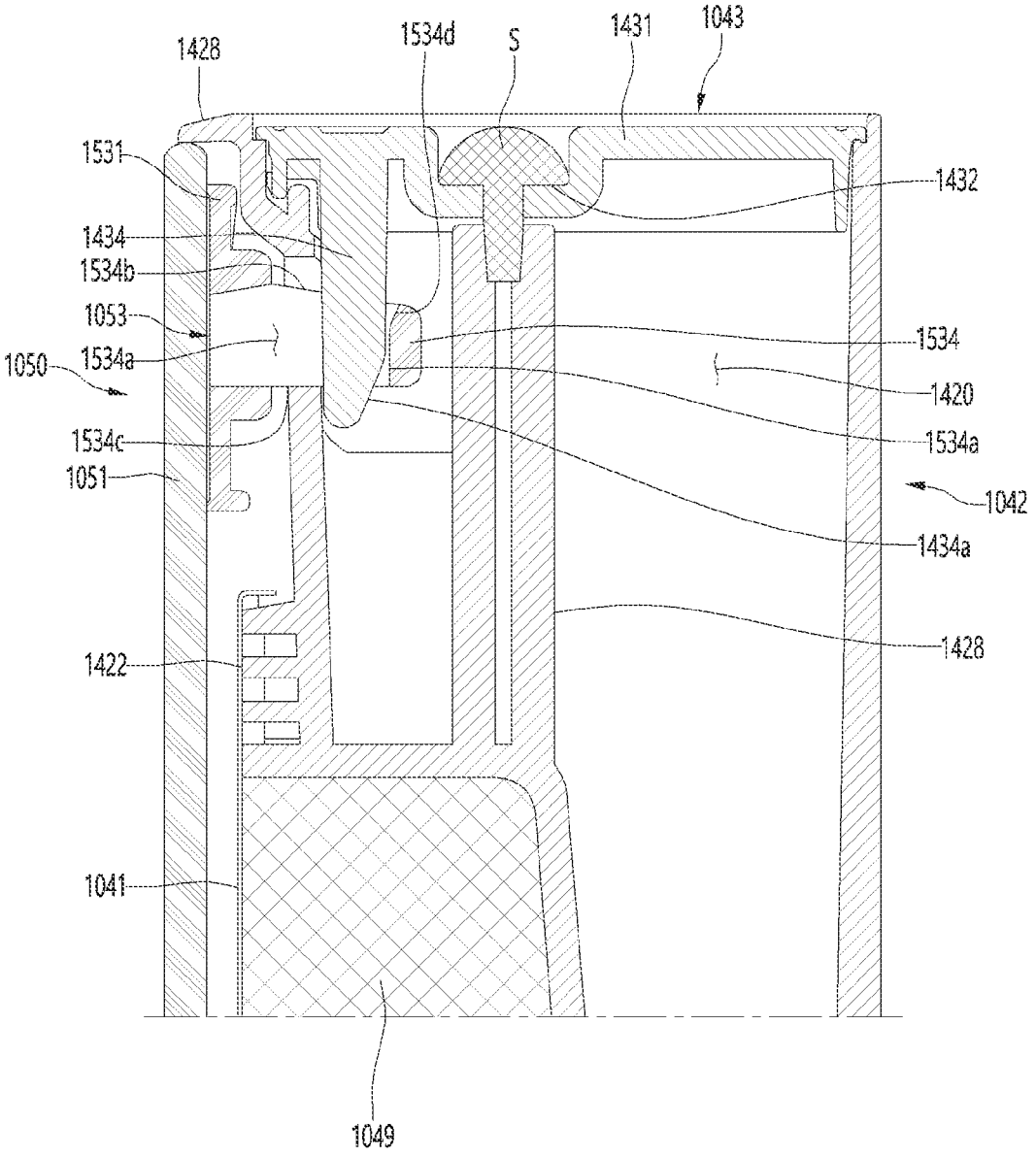
FIG. 39 is a cross-sectional view illustrating a coupling structure of an upper end of the door.

FIG. 38 is a perspective view of the first bracket that is one component of the panel assembly. FIG. 39 is a cross-sectional view illustrating a coupling structure of an upper end of the door.

As illustrated in the drawings, the first bracket 1053 may be mounted on the upper end of the panel 1051 and may have a length corresponding to a horizontal width of the panel 1051. Since the first bracket 1053 is disposed on the upper end of the panel 1051, the first bracket may be referred to as an upper bracket. The first bracket 1053 may be injection-molded by using a plastic material and may include an upper adhesion portion 1531 having a planar shape, an upper rib 1532 at an upper end of the upper adhesion portion 1531, and an insertion protrusion 1534 inserted into the insertion hole 1425. The first bracket 1053 may include an upper coupling protrusion 1533 provided on the upper adhesion portion 1531.

In detail, a front surface of the upper adhesion portion 1531 may be provided in a planar shape and may adhere to the upper end of the rear surface of the panel 1051. Here, an adhesive may be applied to the front surface of the upper adhesion portion 1531, and the first bracket 1053 may be firmly fixed to the panel 1051 by the adhesive.

The first bracket 1053 may have a predetermined vertical width, the upper rib 1532 may be disposed on the upper end of the upper adhesion portion 1531, and the first bracket 53 may have a width so that the insertion protrusion 1534 and the upper coupling protrusion 1533 are disposed below the upper rib 1532. The upper end of the first bracket 1053 may be disposed at a position adjacent to the upper end of the panel 1051 and may be disposed at a slightly spaced position so as not to interfere with the first support end 1428.

The upper rib 1532 may be disposed along an upper end of the first bracket 1053. The upper rib 1532 may protrude backward and be in contact with the front surface of the first cap decoration 1042. Thus, the upper end of the panel assembly 1050 may be supported by the first cap decoration 1042. Also, when the upper rib 1532 is in contact with the front surface of the first cap decoration 1042, the insertion protrusion may be in a state in which the insertion protrusion is maximally inserted into the insertion hole.

Also, in a state in which the upper rib 1532 is in contact with the front surface of the first cap decoration 1042, the upper coupling protrusion 1533 may be inserted into the upper coupling portion 1424 and thus aligned to facilitate the coupling of the screw. For this, a screw hole 1533*a* into which the screw is coupled may be defined in a top surface of the upper coupling protrusion 1533.

A plurality of insertion protrusions 1534 may be disposed on the upper adhesion portion 1531. The plurality of insertion protrusions 1534 may be disposed along the upper adhesion portion 1531 at regular intervals. The plurality of insertion protrusions 1534 may be disposed at positions corresponding to the insertion hole 1425 and the restriction protrusion 1434.

The insertion protrusion 1534 may protrude vertically backward from a rear surface of the upper adhesion portion 1531, and in a state in which the panel assembly 1050 is mounted, a rear end of the insertion protrusion 1534 may extend to be disposed behind the restriction protrusion 1434.

The insertion protrusion 1534 may be provided in a protrusion shape having a predetermined width and thickness, and a through-hole 1534*a* into which the restriction protrusion 1434 is inserted may be defined at a center of the insertion protrusion 534. The through-hole 1534*a* may be defined in a rectangular shape and may have a size corresponding to a cross-section of the restriction protrusion 1434. Thus, in a state in which the restriction protrusion 1434 is inserted into the through-hole 1534*a*, the panel assembly 1050 may be firmly fixed without moving.

An inclined portion 1534*d* may be defined at an upper end of a rear surface of an inner side of the through-hole 1534*a*. The inclined portion 1534*d* may be inclined backward as it goes upward. Thus, when the restriction protrusion 1434 is initially inserted, the restriction protrusion 1434 may be easily guided into the through-hole 1534*a*. Particularly, the inclined surface 1434*a* and the inclined portion 1534*d*, which are disposed at the lower end of the restriction protrusion 1434, may have inclinations corresponding to each other, respectively. Thus, when the restriction protrusion 1434 is inserted, the restriction protrusion 1434 may be in contact with each other so that the restriction protrusion 1434 is more easily inserted into the through-hole 1534*a*, and while the restriction protrusion 434 is inserted, the panel assembly 1050 may be pulled backward so that the panel assembly 1050 is in close contact with the front surface of the door body 1040.

A bottom surface 1534*c* of the insertion protrusion 1534 may extend perpendicular to the upper adhesion portion 1531 and the panel 1051, and a top surface 1534*b* of the insertion protrusion 1534 may be inclined. That is, the insertion protrusion 1534 may have a vertical width that gradually decreases backward and also gradually decreases as the top surface 1534*b* of the insertion protrusion 1534 extends backward.

Thus, when the panel assembly 1050 rotates by using the second bracket 1054 as an axis so as to be mounted on or separated from the door body 1040, the insertion protrusion 1534 having a relatively large rotation radius may be easily inserted into the insertion hole 1425. That is, when the insertion protrusion 1534 is initially inserted into the insertion hole 1425, the insertion protrusion 534 may be prevented from colliding with an outer end of the insertion hole 1425. The bottom surface 1534*c* of the insertion protrusion 1534 may be supported in contact with a lower end of the insertion hole 1425.

The first bracket 1053 may be disposed at an upper end of the panel 1051, and a height from the upper end of the panel 1051 to the first bracket 1053 may be greater than a height from the upper end of the panel 1051 to the gasket 1048.

Thus, the first bracket 1053 may be disposed substantially outside the gasket 1048, and thus, the thermal insulation performance of the storage space may not be affected. That is, even if the corresponding front surface of the first cap decoration 1042 is inclined and recessed to provide a structure having a relatively thin thickness due to the mounting of the first bracket 1053, the corresponding position may not be affected by cold air within the refrigerator, and thus, dew condensation may not be generated, and also, the thermal insulation performance of the door 20*d* may not be deteriorated. That is, the first bracket 1053 may be disposed outside the gasket 1048 and also be disposed outside a thermal insulation region.

Hereinafter, the structure of the second bracket 1054 will now be described in more detail with reference to the accompanying drawings.

Figure 40:
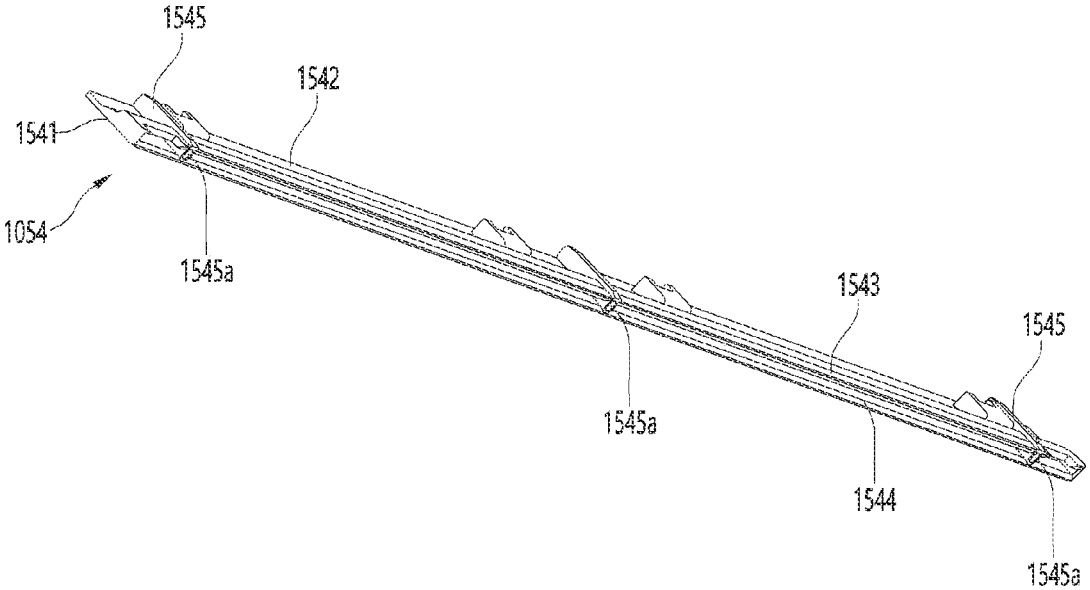
FIG. 40 is a perspective view of the second bracket that is one component of the panel assembly.
Figure 41:
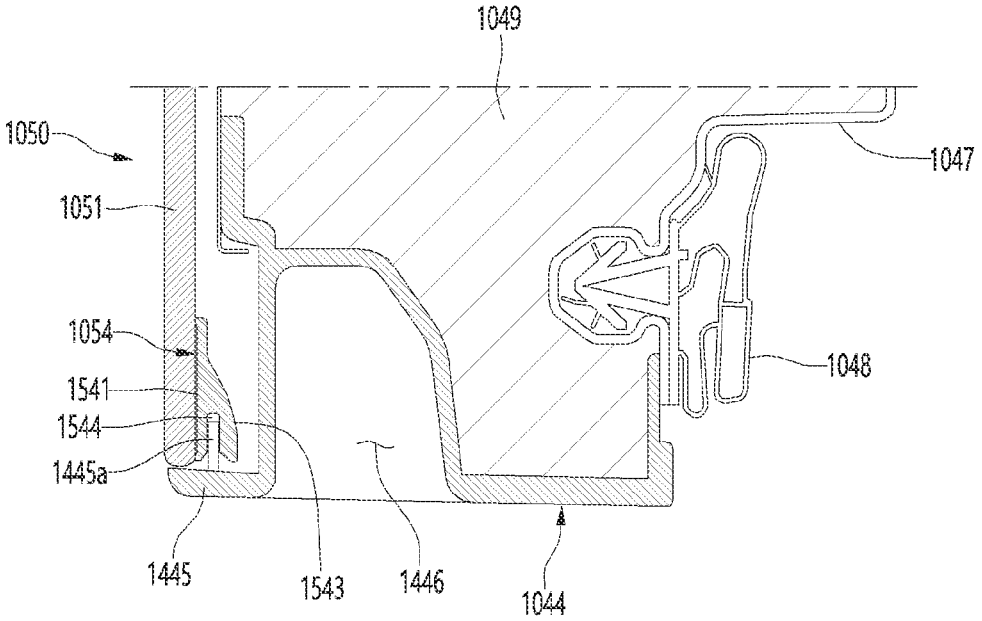
FIG. 41 is a cross-sectional view illustrating a coupling structure of a lower end of the door.

FIG. 40 is a perspective view of the second bracket that is one component of the panel assembly. FIG. 41 is a cross-sectional view illustrating a coupling structure of a lower end of the door.

As illustrated in the drawings, the second bracket 1054 may be injection-molded by using a plastic material and may be provided on the lower end of the panel 1051. Since the second bracket 1054 is provided at the lower end of the panel 1051, the second bracket may be referred to as a lower bracket.

The second bracket 1054 may extend to a length corresponding to the horizontal width of the panel 1051. The second bracket 1054 may to have a vertical width at which at least a lower coupling boss 1545 is disposed.

The second bracket 1054 may be hooked to be restricted by the second cap decoration 1044. The second bracket 1054 may allow the screw passing through the second cap decoration 1044 to be coupled to the screw hole 1545*a* of the lower coupling boss 1545, and thus, the lower end of the panel assembly 1050 may be more firmly fixed to the door body 1040.

In detail, the second bracket 1054 may include a lower adhesion portion 1541 mounted on the rear surface of the panel 1051. The lower adhesion portion 1541 may be provided in a flat shape and may be attached to the rear surface of the panel 1051 by an adhesive. The second bracket 1054 may be disposed at a position corresponding to the lower end of the panel 1051 in a state in which the lower adhesion portion 1541 is attached to the rear surface of the panel 1051.

A lower protrusion 1543 protruding backward from the lower adhesion portion 1541 may be disposed backward from the lower adhesion portion 1541. The lower protrusion 1543 may extend from one side of the lower adhesion portion 1541 to a position corresponding to the lower end of the lower adhesion portion 1541.

A lower insertion portion 1544 having an opened bottom surface may be disposed on a bottom surface of the lower protrusion 1543. That is, the lower insertion portion 1544 may be provided in a shape that is recessed upward from the bottom surface of the second bracket 1054 so that the restriction portion 1445*a* of the second cap decoration 1044 is inserted. The lower insertion portion 1544 may be disposed over the entire bottom surface of the second bracket 1054.

Thus, when the panel assembly 1050 is mounted at a fixed position of the door body 1040, the restriction portion 1445*a* may be inserted into the lower insertion portion 1544, and the lower end of the panel assembly 1050 may be fixed. The state in which the restriction portion 1445*a* is inserted into the lower insertion portion 1544 may be referred to as a temporarily fixed state because of a re-detachable state when the panel assembly 1050 is lifted before the screw is coupled.

Of course, the lower end of the panel assembly 1050 may be maintained in a state of being seated on the second support end 1445 by a weight of the panel assembly 1050. That is, the restriction portion 1445*a* may be maintained in the state of being inserted into the lower insertion hole 1425, and when the insertion protrusion 1534 is restricted by the restriction protrusion 1434, the panel assembly 1050 may not move, and thus, the panel assembly 1050 be may maintained in the firmly mounted state without coupling the screw.

A height from the lower end of the panel 1051 to the second bracket 1054 may be less than that of the gasket 1048. Here, the height of the gasket 1048 may be a height from the lower end of the panel 1051 to a center of the gasket mounting portion 1481.

Thus, the second bracket 1054 may be disposed substantially outside the gasket 1048, and thus, the thermal insulation performance of the storage space may not be affected. That is, even if the corresponding front surface of the second cap decoration 1044 is recessed to provide a structure having a relatively thin thickness due to the mounting of the second bracket 1054, the corresponding position may not be affected by cold air within the refrigerator, and thus, dew condensation may not be generated, and also, the thermal insulation performance of the door 20*d* may not be deteriorated. That is, the second bracket 1054 may also be disposed outside the thermal insulation region outside the gasket 1048 to prevent the thermal insulation performance of the door 20 from being deteriorated.

Figure 42:
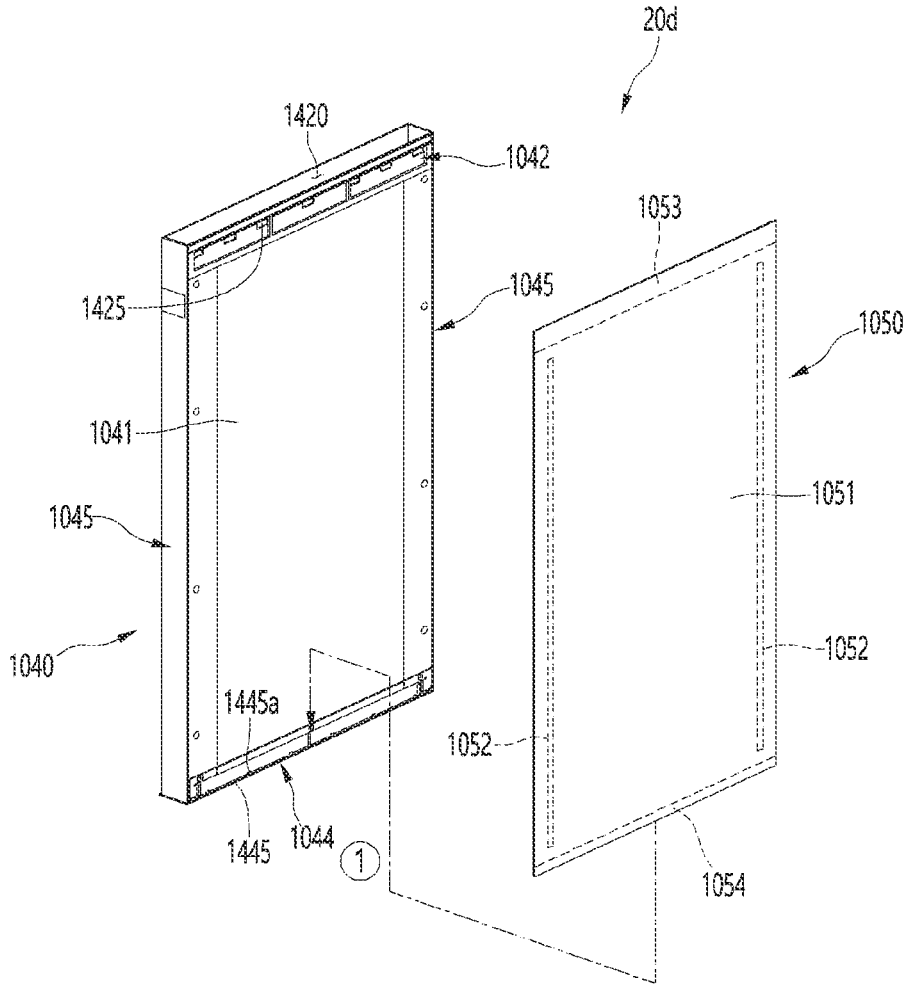
FIG. 42 is a view illustrating a state before the panel assembly is mounted on the door body.
Figure 43:
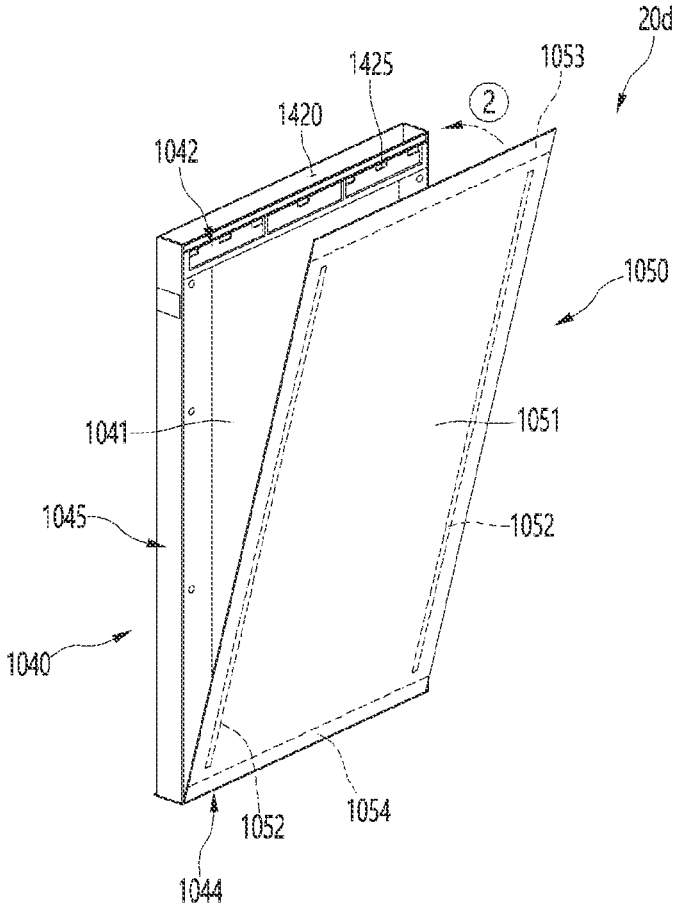
FIG. 43 is a view illustrating a process of restricting a lower end of the panel assembly.
Figure 44:
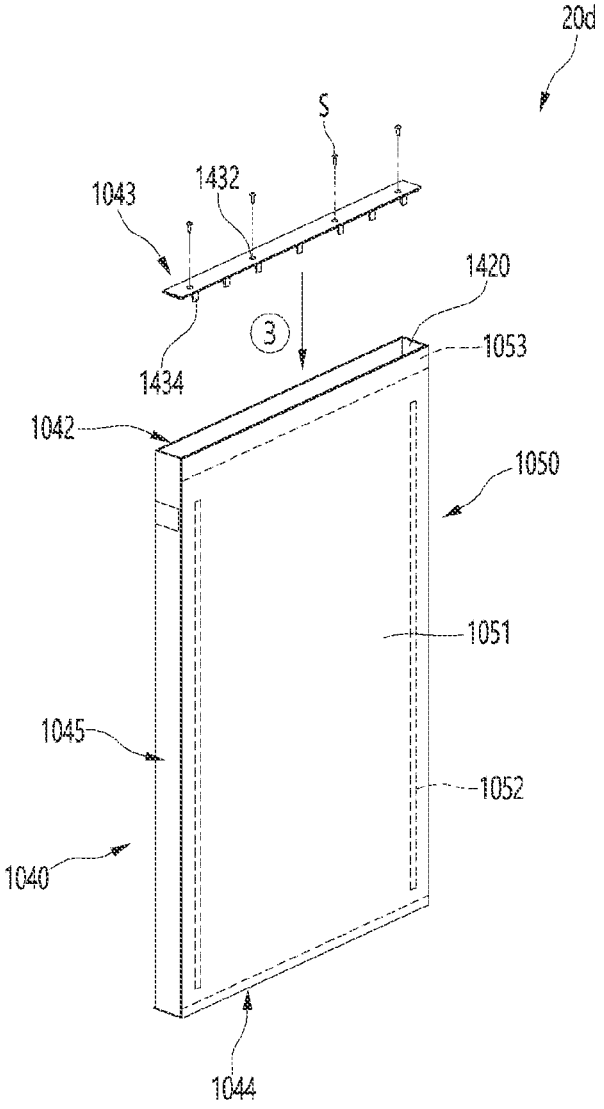
FIG. 44 is a view illustrating a process of restricting an upper end of the panel assembly.
Figure 45:
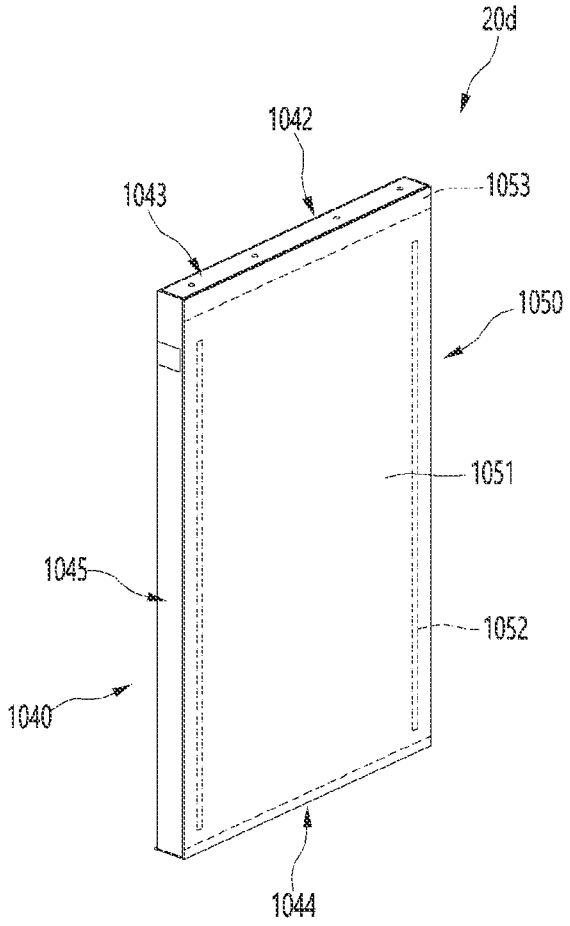
FIG. 45 is a view illustrating a state in which the panel assembly is completely mounted.

FIG. 42 is a view illustrating a state before the panel assembly is mounted on the door body. FIG. 43 is a view illustrating a process of restricting a lower end of the panel assembly. FIG. 44 is a view illustrating a process of restricting an upper end of the panel assembly. FIG. 45 is a view illustrating a state in which the panel assembly is completely mounted.

As illustrated in FIG. 42, the door 20*d* may be assembled by mounting the panel assembly 1050 on the door body 1040. For this, the panel assembly 1050 may be completed by mounting the first bracket 1053 and the second bracket 1054 on the panel 1051. After assembling the front panel 1051 and the side frame 1045, and the first cap decoration 1042, and the second cap decoration 1044, an insulator 1049 may be molded to complete the door body 1040.

The panel assembly 1050 may be disposed to be mounted on the front surface of the door body 1040 in the assembled state. Here, the rear surface of the panel assembly 1050 may be directed to the front surface of the door body 1040, and the lower end of the panel assembly 1050 may be disposed above the second support end 1445 so that the restriction portion 1445*a* is disposed in a position of being inserted into the lower insertion portion 1544.

In detail, the panel assembly 1050 may move backward from a front side to approach the front surface of the door body 1040, and simultaneously, the lower end of the panel assembly 1050 may move to be seated on the second support end 1445 while moving downward from an upper side.

As illustrated in FIG. 43, the restriction portion 1445*a* of the second support end 1445 may be inserted into the lower insertion portion 1544 so that the lower end of the panel assembly 1050 is restricted. Thus, the panel assembly 1050 may be in a state in which the downward movement is restricted by the restriction portion 1445*a*.

As described above, the user may temporarily restrict the lower end of the panel assembly 1050 to the door body 1040 and then allow the upper end of the panel assembly 1050 to rotate so as to be in close contact with the first cap decoration 1042.

In a state in which the lower end of the panel assembly 1050 is supported by the second support end 1445 and temporarily fixed, the user may allow the upper end of the panel assembly 1050 to rotate to be in contact with the front surface of the first cap decoration 1042.

Here, the insertion protrusion 1534 disposed at the top end of the panel assembly 1050 may be inserted into the insertion hole 1425. When the upper end of the panel assembly 1050 completely rotates, the insertion protrusion 1534 may be inserted into the inside of the decoration recessed portion 1420 through the insertion hole 1425.

While the panel assembly 1050 rotates, the magnet 1052 may be attached to the body plate 1041 by magnetic force, and the state in which the panel assembly 1050 is attached to the front surface of the door body 1040 until the panel assembly 50 is mounted may be maintained.

When the panel assembly 1050 completely rotates, the upper end of the panel assembly 1050 may be in contact with the first support end 1428. The panel assembly 1050 may be accommodated in a space in front of the door body 1040 defined by the first support end 1428, the second support end 1445, and front ends of both left and right side frames 1045.

When the panel assembly 1050 is mounted at the fixed position, the upper coupling protrusion 1533 and the upper coupling portion 1424 may be aligned with each other, and the screw may be coupled to the upper coupling portion 1424 inside the decoration recessed portion 1420 to more firmly couple the first bracket 1053 to the first cap decoration 1042.

Next, as illustrated in FIG. 44, the decoration cover 1043 may be mounted to shield the opened top surface of the decoration recessed portion 1420. The decoration cover 1043 may be seated on the opened top surface of the decoration recessed portion 1420 while moving downward from the upper side.

Here, while the decoration cover 1043 moves downward, the restriction protrusion 1434 of the decoration cover 1043 may pass through the through-hole 1534*a* of the insertion protrusion 1534 inserted into the decoration recessed portion 1420.

When the decoration cover 1043 is completely mounted on the decoration recessed portion 1420, the restriction protrusion 1434 may pass through the insertion protrusion 1534 as illustrated in FIG. 39, and the insertion protrusion 1534 and the restriction protrusion 1434 may be in the restricted with each other.

In the state in which the decoration cover 1043 is mounted on the decoration recessed portion 1420, a screw S may be coupled to the decoration cover 1043 to more firmly fix the decoration cover 1043 to the first cap decoration 1042. In this state, the panel assembly 1050 may be maintained in close contact with the front of the door body 1040, and the panel assembly 1050 may be in a state of being firmly mounted on the door body 1040 as illustrated in FIG. 45.

The screw may be coupled to the second cap decoration 1044 so that the second cap decoration 1044 is more firmly coupled to the second bracket 1054.

To separate the panel assembly 1050 mounted on the door body 1040, the above-described process may be performed in a reverse order.

Particularly, to separate the panel assembly 1050, when the decoration cover 1043 is separated, the decoration recessed portion 1420 may be exposed, and in this state, the user may put the hand into the decoration recessed portion 1420 to press the insertion protrusion 1534.

When the insertion protrusion 1534 is pressed, the lower end of the panel assembly 1050 may be restricted, and thus, the panel assembly 1050 may rotate by using the lower end of the panel assembly 1050 as an axis, and the insertion protrusion 1534 may be separated from the restriction portion 1445*a*.

That is, the upper end of the panel assembly 1050 may rotate outward via the first support end 1428, and in this state, the panel assembly 1050 may be lifted to separate the panel assembly 1050 from the door body 1040.

Of course, in this process, when the screw is coupled to the first bracket 1053 or the second bracket 1054, the operation of removing the screw may be further performed.

In addition to the foregoing embodiment, a refrigerator according to various embodiments may be exemplified. Another embodiment is characterized in that a panel constituting a panel assembly is made of a metal material. Further another embodiment is all the same as the above-described embodiment except for a structure of the panel, and thus, the same components will be denoted by the same reference numerals, and detailed descriptions thereof will be omitted.

Figure 46:
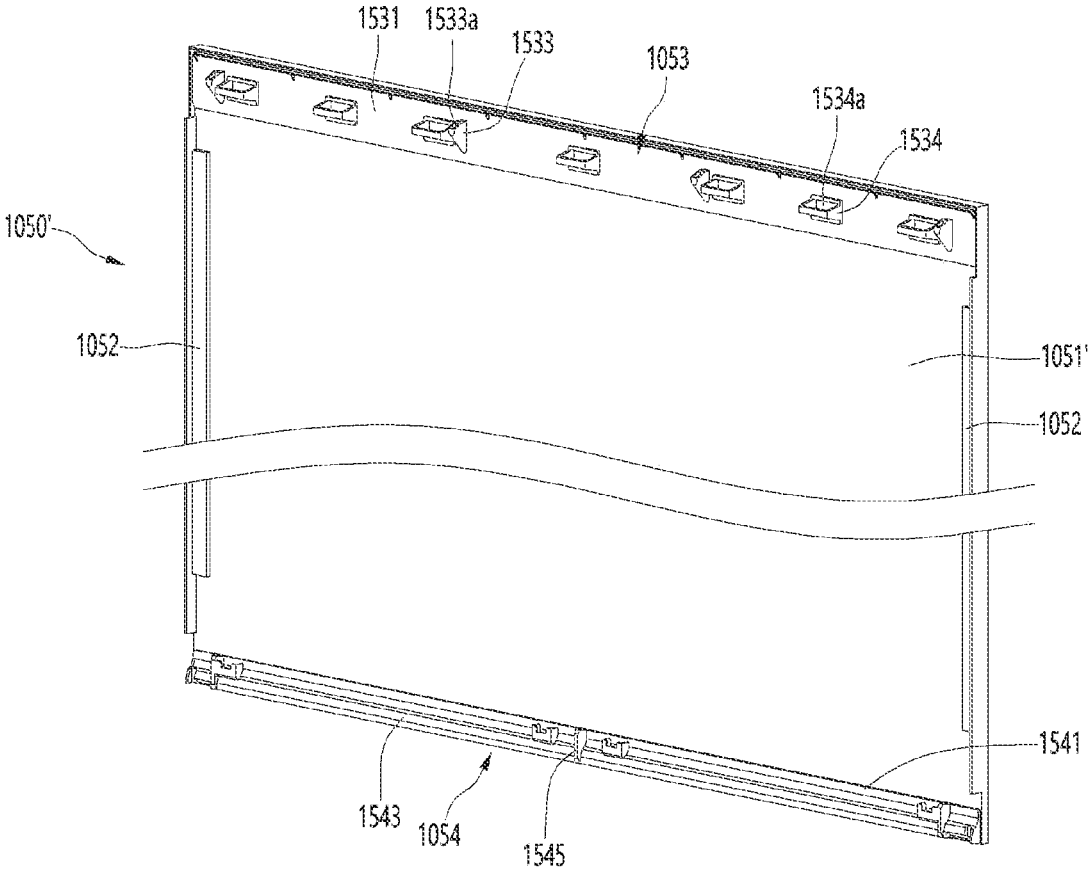
FIG. 46 is a rear perspective view of a panel assembly according to a fifth embodiment of the present invention.

FIG. 46 is a rear perspective view of a panel assembly according to a fifth embodiment of the present invention.

As illustrated in the drawing, a refrigerator door according to a fifth embodiment of the present invention may include a door body 1040 and a panel assembly 1050" mounted on a front surface of the door body 1040.

The panel assembly 1050 may have a size corresponding to that of a front surface of the door body 1040 and be configured to define an outer appearance of an entire front surface of the door in a state of being mounted on the door body 1040.

The panel assembly 1050' may include a plate-shaped panel 1051 defining an outer appearance and first and second brackets 1053 and 1054 for fixing upper and lower ends of a panel' 1051. The panel assembly 50 may further include a magnet 1052 so that a rear surface of the panel 1051' and a front surface of the door body 1040 are attached to each other.

In detail, the panel 1051' may be made of a rectangular plate-shaped material having a predetermined thickness and may be made of a material that is capable of being harmonized with the furniture or wall or the home appliance disposed therearound.

For example, the panel 1051' may be made of a plate-shaped metal material such as stainless steel. Printing, coating treatment, or film attachment may be performed on the front surface of the panel 1051 to have a color or pattern, thereby defining the outer appearance of the door.

The panel 1051' may be maintained in a stable support state when mounted on the door body 1040, and a bent portion 1511 may be disposed along a circumference so that a cross-section of the panel 1051' is not exposed to the outside. Thus, the outer appearance of the circumferential surface of the panel 1051' may be defined by the bent portion 1511. Also, the first bracket 1053, the second bracket 1054, and the magnet 1052, which are mounted on a rear surface of the panel 1051', may be shielded by the bent portion 1511, and thus, the panel 1051' may be prevented from being exposed to the outside.

A magnet 1052 may be provided at each of both left and right ends of the panel 1051'. The magnet 1052 may be attached to the rear surface of the panel 1051' by an adhesive or magnetic force. The magnet 1052 may extend from an upper end to a lower end of the panel 1051'. When the panel assembly 1050 is mounted on the door body 1040 in a state in which the magnet is attached to the panel 1051 the magnet 1052 may be attached to the front panel 1051 by the magnetic force. That is, the mounting of the panel assembly 1050' may be assisted by the magnet 1052.

The first bracket 1053 may extend along an upper end of the panel 1051' and have a length corresponding to a horizontal width of the panel 1051'. When the panel assembly 1050' is mounted, the panel assembly 1050' may be coupled to the first cap decoration 1042 to restrict an upper end of the panel assembly 50'.

The second bracket 1054 may be provided on a lower end of the panel 1051' and may have a horizontal length that is equal to a horizontal length of the panel 1051'. A lower insertion portion 1544 into which the restriction portion 1445*a* of the second cap decoration 1044 is inserted may be defined in a lower end of the second bracket 1054. Thus, the lower end of the panel assembly 1050' may be fixed by inserting the restriction portion 1445*a* into a bent portion opening 1524.

In addition to the foregoing embodiment, a refrigerator according to various embodiments may be exemplified. In further another embodiment, a panel of a panel assembly may be made of a FENIX material. In further another embodiment, other configurations except for the panel are all the same as those of the above-described embodiment, and the same components are denoted by the same reference numerals, and detailed descriptions thereof will be omitted.

Figure 47:
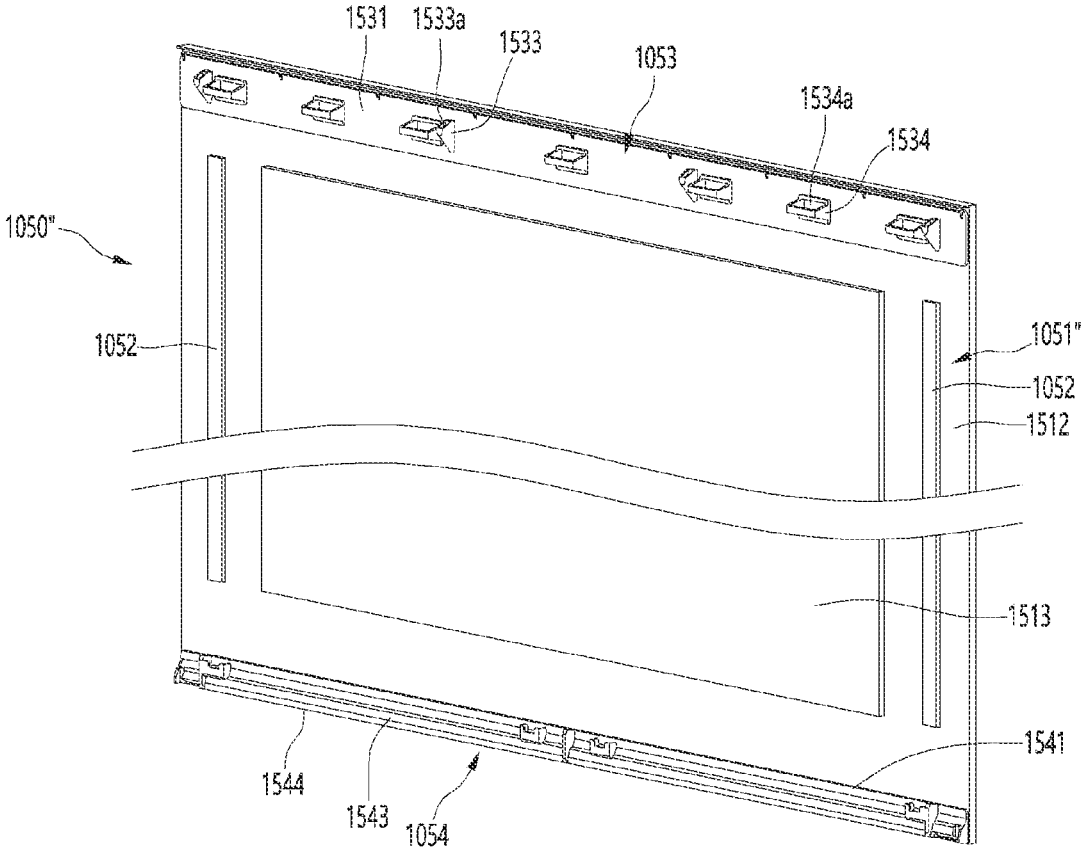
FIG. 47 is a rear perspective view of a panel assembly according to a sixth embodiment of the present invention.

FIG. 47 is a rear perspective view of a panel assembly according to a sixth embodiment of the present invention.

As illustrated in the drawing, a refrigerator door according to further another embodiment of the present invention may include a door body 1040 and a panel assembly 1050" mounted on a front surface of the door body 1040.

The panel assembly 1050" may be mounted on a front surface of the door body 1040 to define an outer appearance of a front surface of the door. The panel assembly 1050" may include a panel 1051", a first bracket 1053, and a second bracket 1054. The panel assembly 1050" may further include a magnet 1052 attached to the body plate 1041.

In detail, the panel 1051 may be made of a rectangular plate-shaped material having a predetermined thickness and may be made of a material that is capable of being harmonized with the furniture or wall or the home appliance disposed therearound.

For example, the panel 1051" may be made of a FENIX material having a predetermined thickness. A pattern may be disposed on a front surface of the panel 1051" to realize surface texture or may be surface-treated such as coating to define the outer appearance of the door. Of course, the panel 1051" may be made of ceramic, tile, composite material, stone, or the like having a similar thickness, not the FENIX material.

The panel 1051" made of the FENIX material may have a thickness greater than or equal to a set thickness in consideration of workability and strength for use in the door. Thus, the thickness of the panel 1051" may be thicker than that of each of the panels 1051 and 1051' made of a glass or metal material described above.

In this state, when the first bracket 1053, the second bracket 1054, and the magnet 1052 are disposed on a rear surface of the panel 1051", the thickness of the panel assembly 1050" may be excessively thick to deteriorate the outer appearance of the door or prevent a normal assembly structure from being applied. As a result, a recessed panel seating portion 1512 may be defined in a circumference of a rear surface of the panel 1051".

In detail, in the rear surface of the panel 1051", a central portion 1513 of the rear surface of the panel 151" may protrude backward, and the panel seating portion 1512 recessed along the circumference of the central portion 1513 may be provided. The panel 1051" may be provided in a plate shape having the same thickness as the central portion 1513, and a recessed panel seating portion 1512 may be provided by processing the panel seating portion 1512.

The panel seating portion 1512 may have a predetermined width so that the first bracket 1053, the second bracket 1054, and the magnet 1052 are mounted. When the panel assembly 1050 is mounted, the first bracket 1053 and the second bracket 1054 may be coupled to the first cap decoration 1042 and the second cap decoration 1044 as in the above-described embodiment, and the magnet may have a thickness to be attached to the body plate 1041.

That is, the panel mounting portion 1512 may be provided to be stepped from the central portion 1513 and have a thickness less than that of the central portion 1513 so that the first bracket 1053, the second bracket 1054, and the magnet 1052 are disposed.

If necessary, the panel seating portion 1512 may not be stepped, but only an area on which the first bracket 1053, the second bracket 1054, and the magnet 1052 are mounted may be recessed in a corresponding shape.

A magnet 1052 may be provided at each of both left and right ends of the panel 1051". The magnet 1052 may be attached to the rear surface of the panel 1051' by an adhesive or magnetic force. The magnet 1052 may extend from an upper end to a lower end of the panel 1051", When the panel assembly 1050 is mounted on the door body 1040 in a state in which the magnet is attached to the panel 1051" the magnet 1052 may be attached to the front panel 1051" by the magnetic force. That is, the mounting of the panel assembly 1050" may be assisted by the magnet 1052.

The first bracket 1053 may extend along an upper end of the panel 1051' and have a length corresponding to a horizontal width of the panel 1051". Also, when the panel assembly 1050" is mounted, the panel assembly 1050" may be coupled to the first cap decoration 1042, and then, an upper end of the panel assembly 50" may be restricted.

The second bracket 1054 may be provided on a lower end of the panel 1051" and may have a horizontal length that is equal to a horizontal length of the panel 1051". A lower insertion portion 1544 into which the restriction portion 1445*a* of the second cap decoration 1044 is inserted may be defined in a lower end of the second bracket 1054. Thus, the lower end of the panel assembly 1050" may be fixed by inserting the restriction portion 1445*a* into the bent portion opening 1524.

Figure 48:
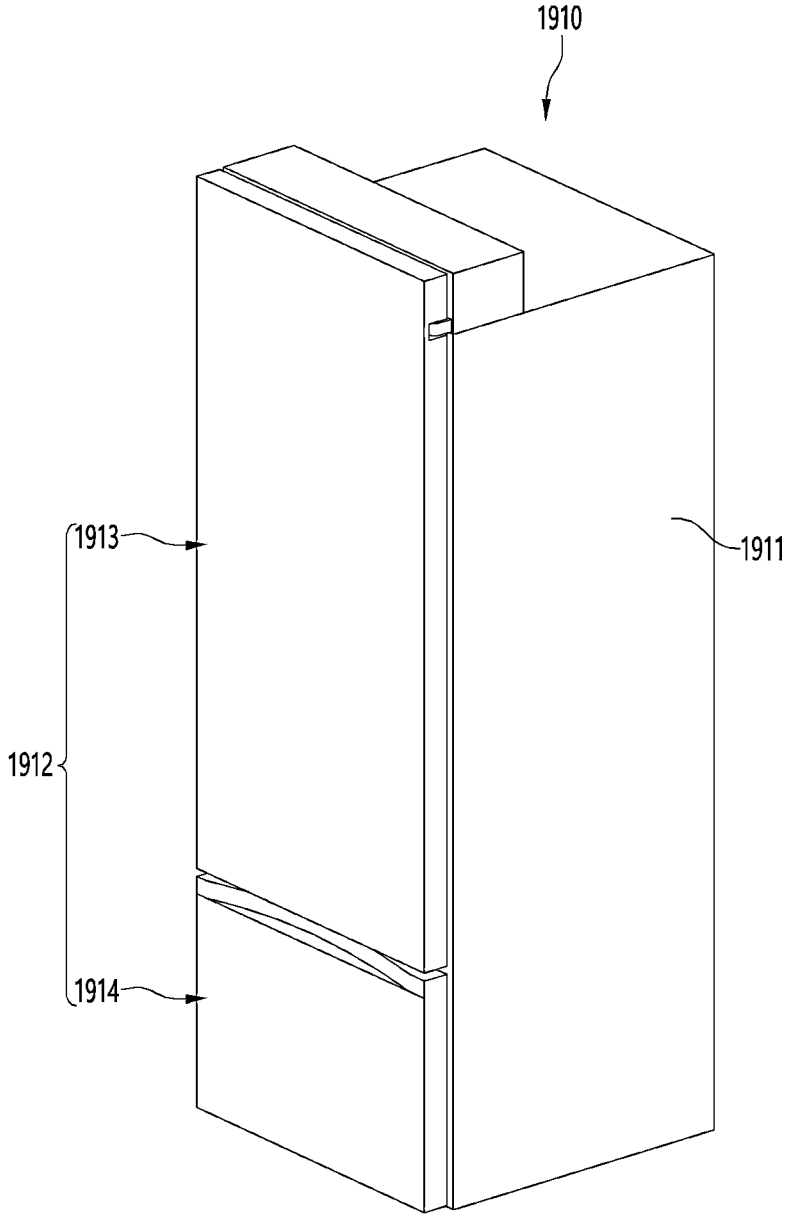
FIG. 48 is a perspective view of a refrigerator according to a seventh embodiment of the present invention.
Figure 49:
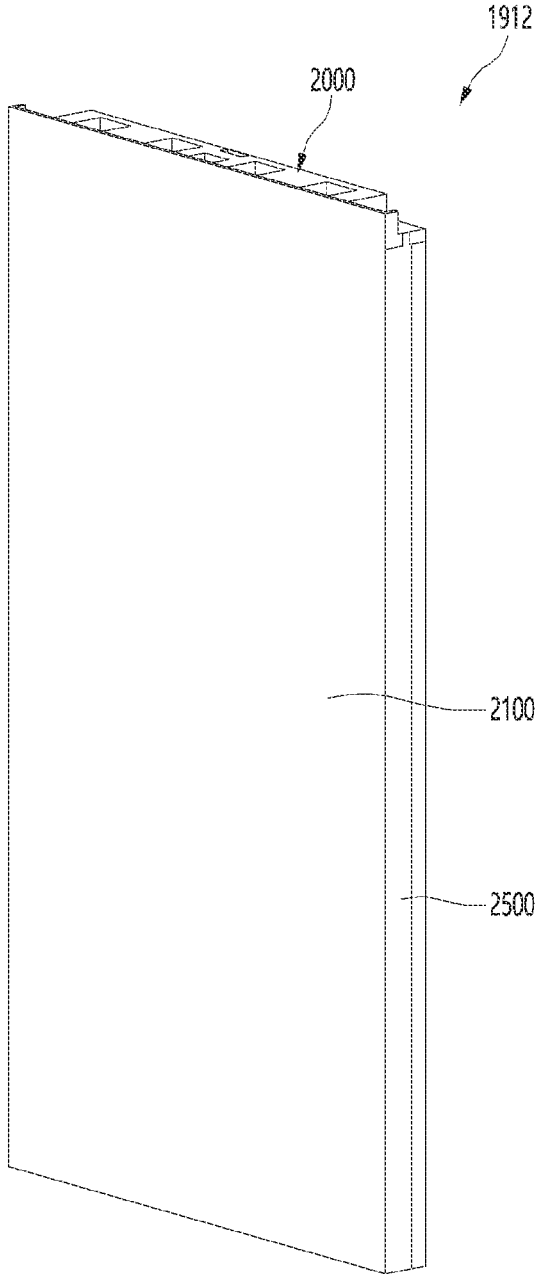
FIG. 49 is a perspective view of a refrigerator door according to the seventh embodiment of the present invention.

FIG. 48 is a perspective view of a refrigerator according to a seventh embodiment of the present invention. FIG. 49 is a perspective view of a refrigerator door according to the seventh embodiment of the present invention.

Referring to FIGS. 48 and 49, a refrigerator 1910 according to this embodiment may be placed independently or together with another refrigerator in a kitchen or living room.

The refrigerator 1910 may include a cabinet 1911 having a storage compartment and a refrigerator door 1912 for opening and closing the storage compartment.

The refrigerator door 1912 may include a plurality of doors 1913 and 1914 spaced apart from each other in a vertical direction. Some or all of the plurality of doors 1913 and 1914 may open and close the storage compartment in a sliding or rotating manner.

The refrigerator door 1912 may include a frame assembly 2000 defining an outer appearance and a front panel 2100 detachably coupled to the frame assembly 2000.

The front panel 2100 may form at least a portion or all of the outer appearance of the front surface of the refrigerator door 1912. The outer appearance of the front surface of the refrigerator door 1912 may substantially define the outer appearance of the front surface of the refrigerator 1910.

Thus, the user may see the front surface of the front panel 2100 at the front side of the refrigerator 1910. The front of the front panel 2100 may serve as a decorative panel at a place on which the refrigerator 1910 is installed. In this embodiment, the front panel 2100 may be replaced according to a user's preference.

Hereinafter, the refrigerator door 912, which is not only easy to replace the front panel 2100 but also allows replacement of the front panel 2100 without space restriction even when the refrigerator 910 is accommodated inside the furniture or wall, will be described.

Figure 50:
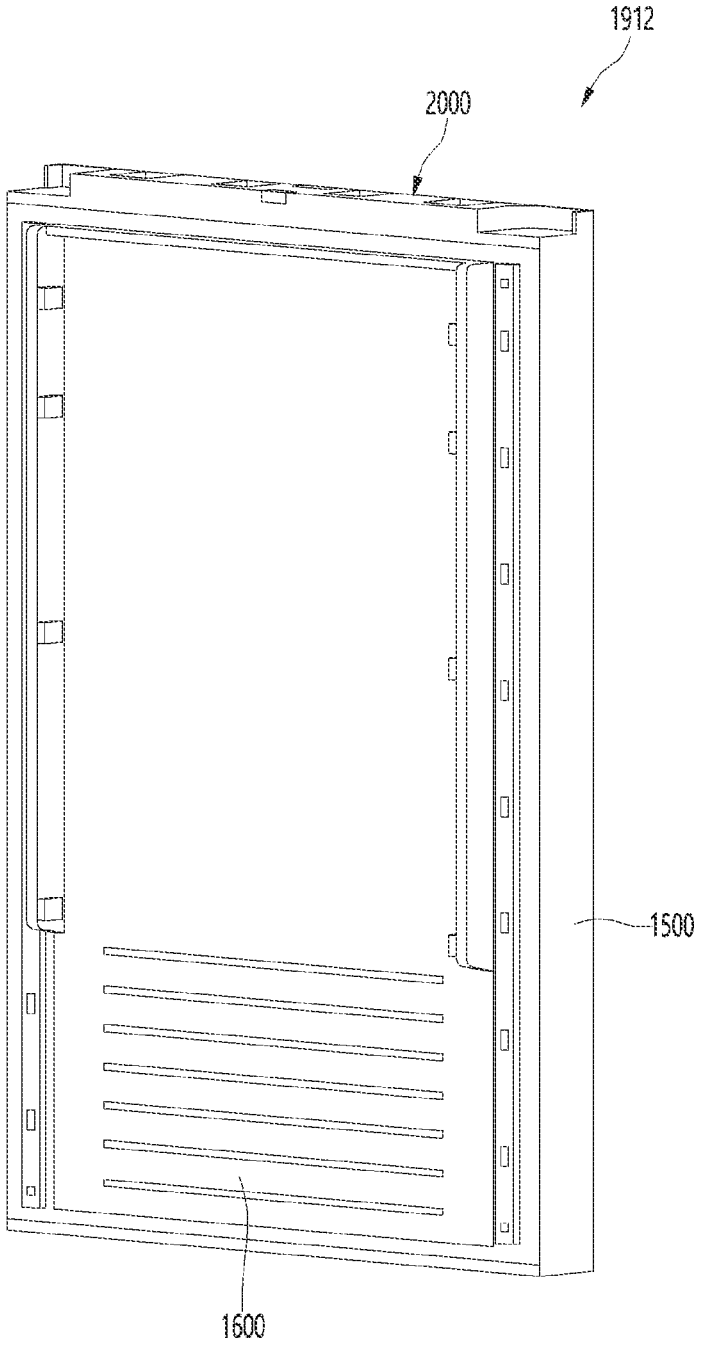
FIG. 50 is a rear perspective view of the refrigerator door.
Figure 51:
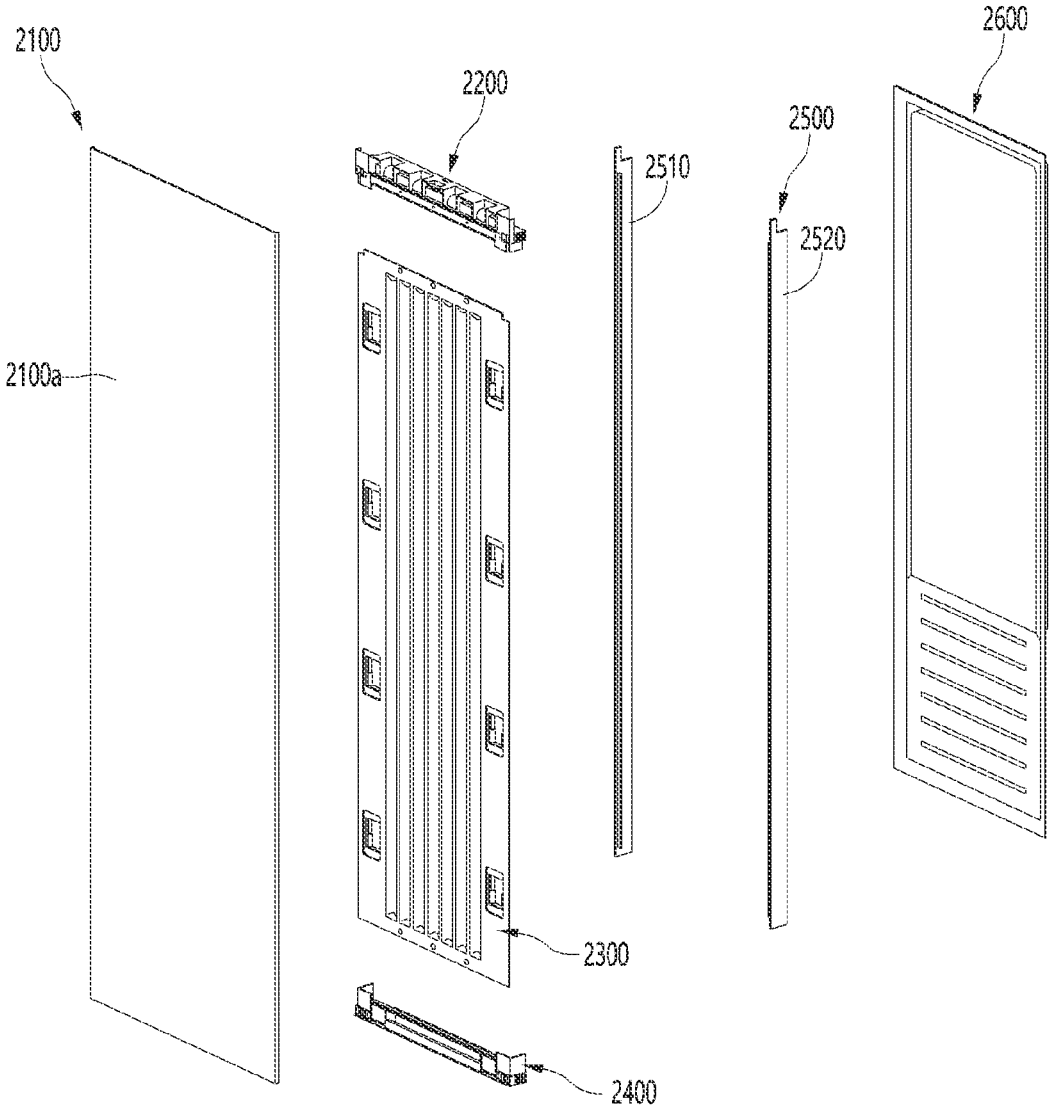
FIG. 51 is an exploded perspective view of the refrigerator door.

FIG. 50 is a rear perspective view of the refrigerator door, and FIG. 51 is an exploded perspective view of the refrigerator door.

Referring to FIGS. 48 to 51, the refrigerator door 1912 may include the frame assembly 2000 and the front panel 2100 detachably connected to the frame assembly 2000 as described above.

The frame assembly 2000 may include a front frame 2300 and a door liner 2600 disposed behind the front frame 2300.

The front panel 2100 may define an outer appearance of the front surface of the refrigerator 1910 and thus may be made of a steel or glass material.

The front panel 2100 may be provided to be replaceable so as to satisfy user's desire to change the design and to easily change the outer appearance. For example, the front panel 2100 is detachable from the frame assembly 2000.

In detail, the front panel 2100 may include one or more fixing portions that are detachably fixed to the frame assembly 2000.

The fixing portion may include a first fixing portion 2110, a second fixing portion 2120, and a third fixing portion 2130 disposed on a rear surface portion 2100*b* of the front panel 2100.

The first fixing portion 2110 may be referred to as an upper bracket, the third fixing portion 2130 may be referred to as a lower bracket, and the second fixing portion 2120 may be referred to as a panel fixing member.

For example, the first fixing portion 2110 may be provided at an upper end of the front panel 2100 and may be coupled to an upper frame 2200 to be described later.

In addition, at least one pair of the second fixing portions 2120 may be provided on the rear surface portion 2100*b* of the front panel 2100 and may be coupled to a front frame 2300 to be described later.

The third fixing portion 2130 may be provided at a lower end of the rear surface portion 2100*b* of the front panel 2100 and coupled to a lower frame 2400 to be described later.

A portion of the door liner 2600 may be coupled to the front frame 2300 while being spaced apart from the front frame 2300. Thus, an insulating space for accommodating an insulator may be defined between the front frame 2300 and the door liner 2600.

The door liner 2600 may define a rear surface of the door 1912 to cover an opened front surface of the cabinet 1911 when the door 1912 is closed.

The frame assembly 2000 may further include an upper frame 2200, a lower frame 2400, and a side frame 2500.

The upper frame 2200 may be coupled to an upper end of the front frame 2300, and the lower frame 2400 may be coupled to a lower end of the front frame 2300.

The upper frame 2200 may cover an upper side of the insulating space, and the lower frame 2400 may cover a lower side of the insulating space.

In addition, the side frame 2500 may be coupled to each of both ends of the front frame 2300. For example, the side frame 2500 may include a first side frame 2510 coupled to one of the side ends of the front frame 2300 and a second side frame 2520 coupled to the other one.

Each of the side frames 2510 and 2520 may directly connect the front frame 2300 to the door liner 2600 or cover a connection portion between the front frame 2300 and the door liner 2600.

The fixing portions 2110, 2120, and 2130 of the front panel 2100 will be described in detail with reference to FIG. 52.

Figure 52:
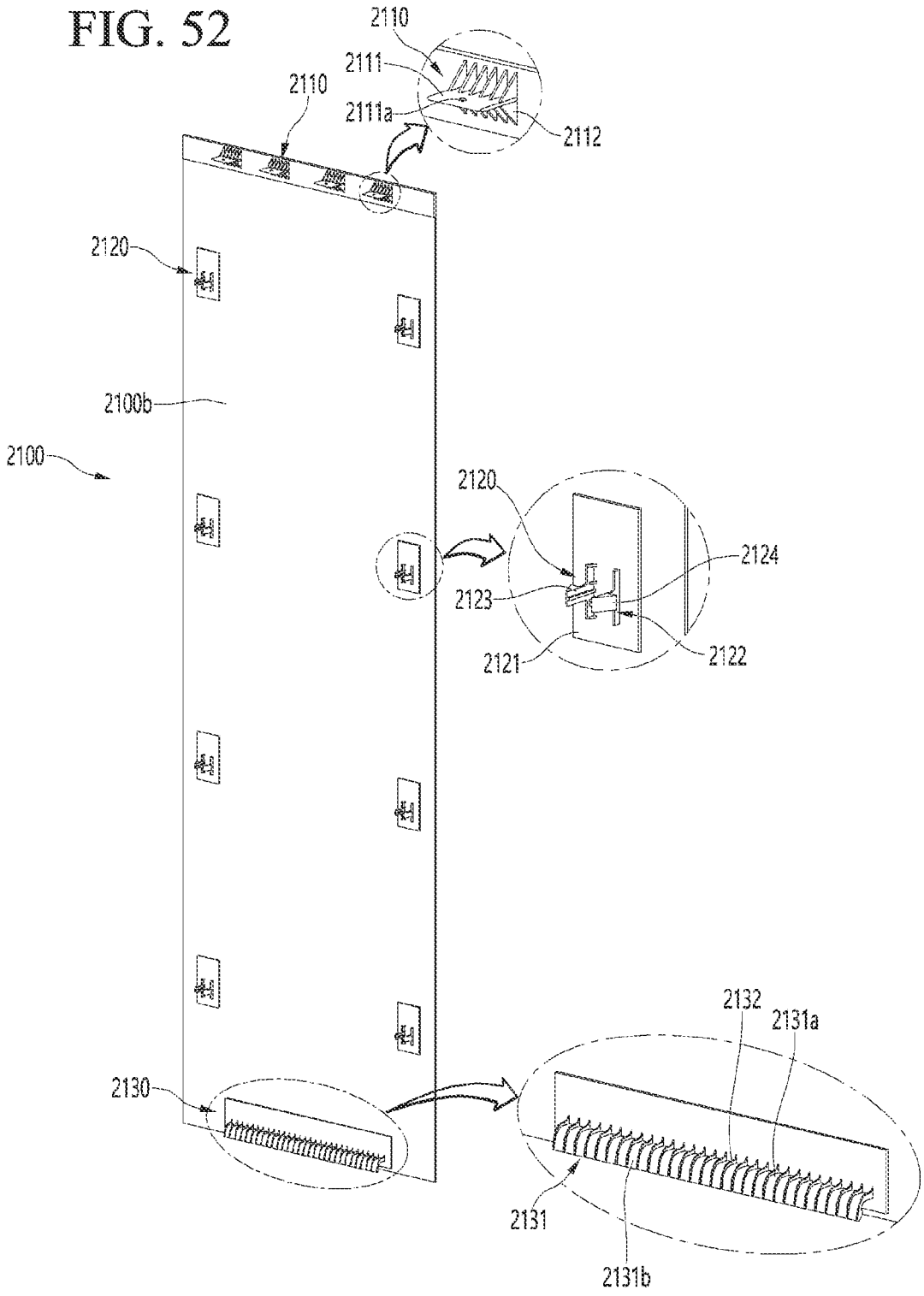
FIG. 52 is a perspective view of a front panel.

FIG. 52 is a perspective view of a front panel.

The fixing portions 2110, 2120, and 2130 may be attached to the rear surface portion 2100*b* of the front panel 2100, and through this, the front panel 2100 may be detachable regardless of whether the front panel 1100 is made of steel or glass.

The first fixing portion 2110 may be injection-molded and attached to an upper end of the front panel rear surface portion 2100*b*. The first fixing portion 2110 may be referred to as an upper fixing portion.

In detail, the first fixing portion 2110 may include a protruding seating portion 2111 that is capable of being inserted into the upper frame 2200. The seating portion 2111 may have a plate shape to protrude vertically from the front panel rear surface portion 2100*b*.

In addition, a plurality of support ribs 2112 may be disposed above and below the seating portion 2111. The support rib 2112 may be coupled to the front panel rear portion 2100*b* and the seating portion 2111 in the form of a right-angled triangle.

In addition, the seating portion 2111 may further include a coupling hole 2111*a* disposed to correspond to an upper coupling hole 2223 (see FIG. 53) of the upper frame 2200 to be described later. A fixing member (not shown) such as a screw may be inserted through the upper coupling hole 2223 and the coupling hole 2111*a* so that the upper frame 2200 and the first fixing portion 2110 are coupled to each other.

The coupling hole 2111*a* may be disposed at one end of the seating portion 2111. In detail, the coupling hole 2111*a* may be disposed at the farthest end from the front panel rear surface portion 2100*b* of the seating portion 2111.

The second fixing portion 2120 may be injection-molded and attached to the front panel rear surface portion 2100*b* and may be provided in a pair. The second fixing portion 2120 may be referred to as a hook.

For example, the second fixing portion 2120 may have a hook shape to protrude from the rear surface portion 2100*b* of the front panel 2100.

In addition, the second fixing portion 2120 may be provided in a pair disposed on left and right sides of the front panel rear surface portion 2100*b*, and a plurality of pairs may be arranged in the vertical direction.

In detail, the second fixing portion 2120 may include a plate 2121 attached to the front panel rear surface portion 2100*b*. A hook member 2122 may be provided on the plate 2121.

The plate 2121 may have a size corresponding to the hook coupling portion 2320 of the front frame 2300 to be described later.

The hook member 2122 may be provided in a shape biased to one side of the plate 2121, which is to facilitate coupling and separation according to the hook shape.

The hook member 2122 may include an extension portion 2123 extending perpendicularly to the plate 2121 and may include a hook portion 2124 extending by being bent from the extension portion 2123.

That is, the extension portion 2123 extending perpendicularly to the front panel rear surface portion 2100*b* and the hook portion 2124 extending from the extension portion 2123 in parallel to the front panel rear surface portion 2100*b* may define the hook shape.

The hook portions 2124 may extend in a direction away from each other.

In detail, the hook member 2122 may be provided in the shape of a pair of arrows provided to be spaced apart from each other.

In addition, the hook portion 2124 may have a right-angled triangular cross-section along the extending direction of the extension portion 2123. For example, one surface of the hook portion 2124 may be fixed to be in contact with one surface of an inclined protrusion 2322 to be described later.

The third fixing portion 2130 may be injection-molded and attached to a lower end of the front panel rear surface portion 2100*b*. The third fixing portion 2130 may be referred to as a lower fixing portion.

For example, the third fixing portion 2130 may protruded from a lower end of the front panel rear surface portion 2100*b* to extend to left and right sides.

In detail, the third fixing portion 2130 may include an insertion portion 2131 inserted into a lower recessed portion 2430 of a lower frame 2400 to be described later.

The insertion portion 2131 may protrude from the front panel rear surface portion 2100*b*, and for example, may include a first extension portion 2131*a* extending vertically from the front panel rear surface portion 2100*b* and a second extension portion 2131*b* that is bent from the first extension portion 2131*a* to extend.

The second extension portion 2131*b* may extend toward a lower portion of the front panel 2100. In addition, the third fixing portion 2130 may include one or more support ribs 2132 to surround the insertion portion 2131.

Figure 53:
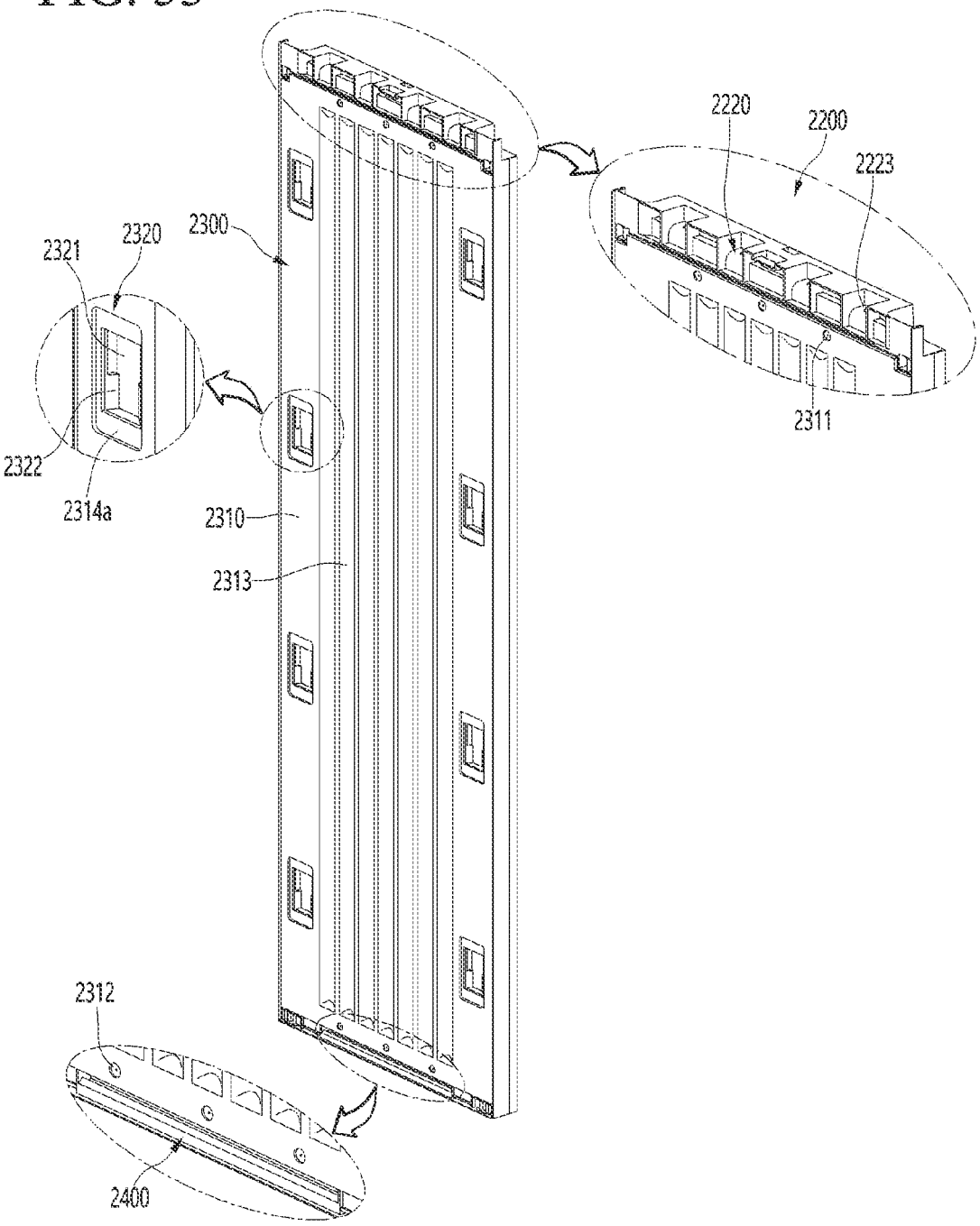
FIG. 53 is a perspective view of a frame assembly.

FIG. 53 is a perspective view of a frame assembly.

Hereinafter, the frame assembly 2000 will be described in detail with reference to FIGS. 53 to 56.

The frame assembly 2000 includes a front frame 2300 that is spaced a predetermined distance from the door liner 2600 and disposed at a front side, an upper frame 2200 coupled to an upper portion of the front frame 2300, and a lower frame 2400 coupled to a lower portion of the front frame 300.

The frame assembly 2000 may further include a pair of side frames 2500 disposed between the front frame 2300 and the door liner 2600.

In addition, a thermal insulating space may be defined through the frame assembly 2000, and an insulator may be filled in the thermal insulating space.

Figure 54:
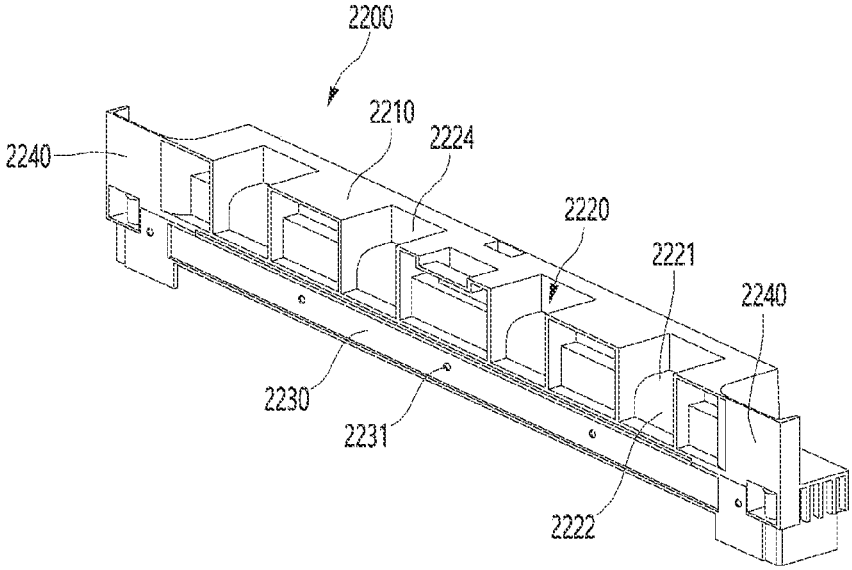
FIG. 54 is a perspective view of an upper frame.
Figure 55:
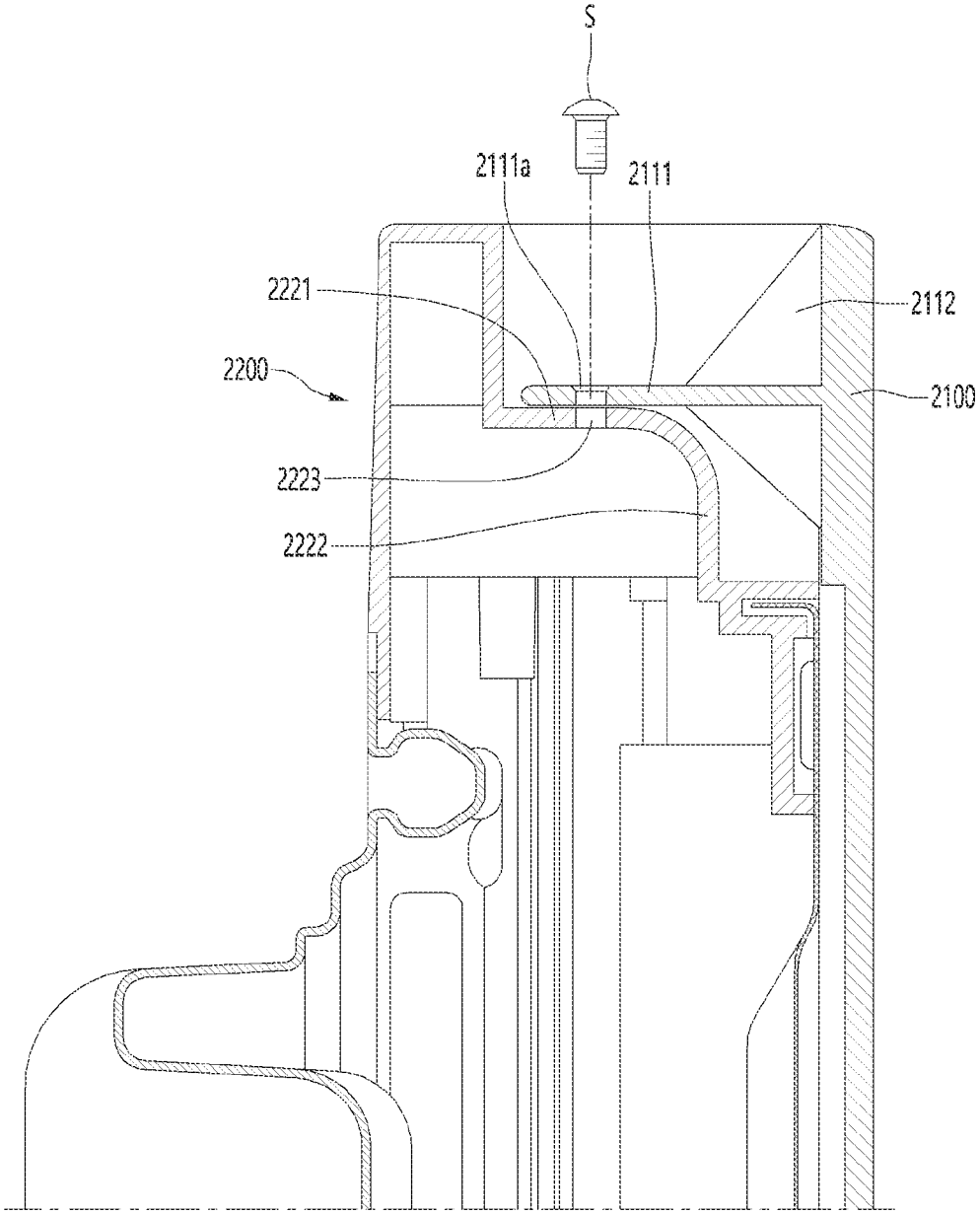
FIG. 55 is a cross-sectional view illustrating a state in which the upper frame and a front panel are coupled to each other.

FIG. 54 is a perspective view of an upper frame, and FIG. 55 is a cross-sectional view illustrating a state in which the upper frame and a front panel are coupled to each other.

The structure of the upper frame 2200 and the coupling between the upper frame 2200 and the first fixing portion 2110 will be described with reference to FIGS. 43 and 44.

The upper frame 2200 may include a panel support portion 2220 which is coupled to an upper portion of the front frame 2300 and on which a seating portion 2111 of the first fixing portion 2110 is seated.

In addition, both ends 2240 to which a hinge (not shown) or a magnet (not shown) for opening and closing the door 1912 are coupled may be provided on both sides of the upper frame 2200, respectively.

In detail, one of both the ends 2240 of the upper frame 2200 may be provided with a hinge, and the other may be provided with a magnet, which may vary depending on which any side of the left and right sides of the refrigerator door 1912 is coupled.

The panel support portion 2220 may be in a shape recessed from a top surface 2210 of the upper frame 2200 and may be disposed to correspond to the plurality of first fixing portions 2110.

For example, the panel support portion 2220 may be disposed symmetrically to correspond to a position of the first fixing portion 2110 that is arranged symmetrically with respect to left and right sides.

In detail, the panel support portion 2220 may include a first surface 2221 that is depressed downward from the top surface 2210 of the upper frame 2200 and a second surface 2222 that is bent to extend from the first surface 2221 and is perpendicular to the top surface 2210 of the upper frame 2200.

The first surface 2221 may be recessed downward from the top surface 2210 of the upper frame 2200, and the second surface 2222 may be recessed backward from the front surface of the upper frame 200.

Through the recessed panel support portion 2220, when coupled to the first fixing portion 2110, an interference with an external configuration may be prevented.

In addition, an upper coupling hole 2223 corresponding to the coupling hole 2111*a* of the first fixing portion 2110 may be defined in the first surface 2221.

The panel support portion 2220 may further include an inner surface portion 2224 surrounding the recessed first surface 2221 and the second surface 2222.

The inner surface portion 2224 may be a hexahedral shape having an opened top surface and a front surface, and the first surface 2221 and the second surface 2222 may be provided therein.

In addition, the upper frame 2200 may further include a frame coupling portion 2230 coupled to the front frame 2300.

For example, the frame coupling portion 2230 may extend from a lower side of the panel support portion 2220 and include a plurality of frame coupling holes 2231.

In detail, an upper coupling portion 2311 to be described later of the front frame 2300 may be disposed on the front surface of the frame coupling portion 2230 and may be coupled through a fixing member (not shown) such as a screw.

An upper cover (not shown) may be further included to prevent the panel support portion 2220 provided by the recessed portion from being exposed to the outside.

Referring to FIG. 55, the seating portion 2111 of the first fixing portion 2110 is seated on the panel support portion 2220 of the upper frame 2200.

In addition, the first fixing portion 2110 and the upper frame 2200 through the screw S passing through the coupling hole 2111*a* of the first fixing portion 2110 and the upper coupling hole 2223 of the upper frame 2200 may be coupled to each other.

Figure 56:
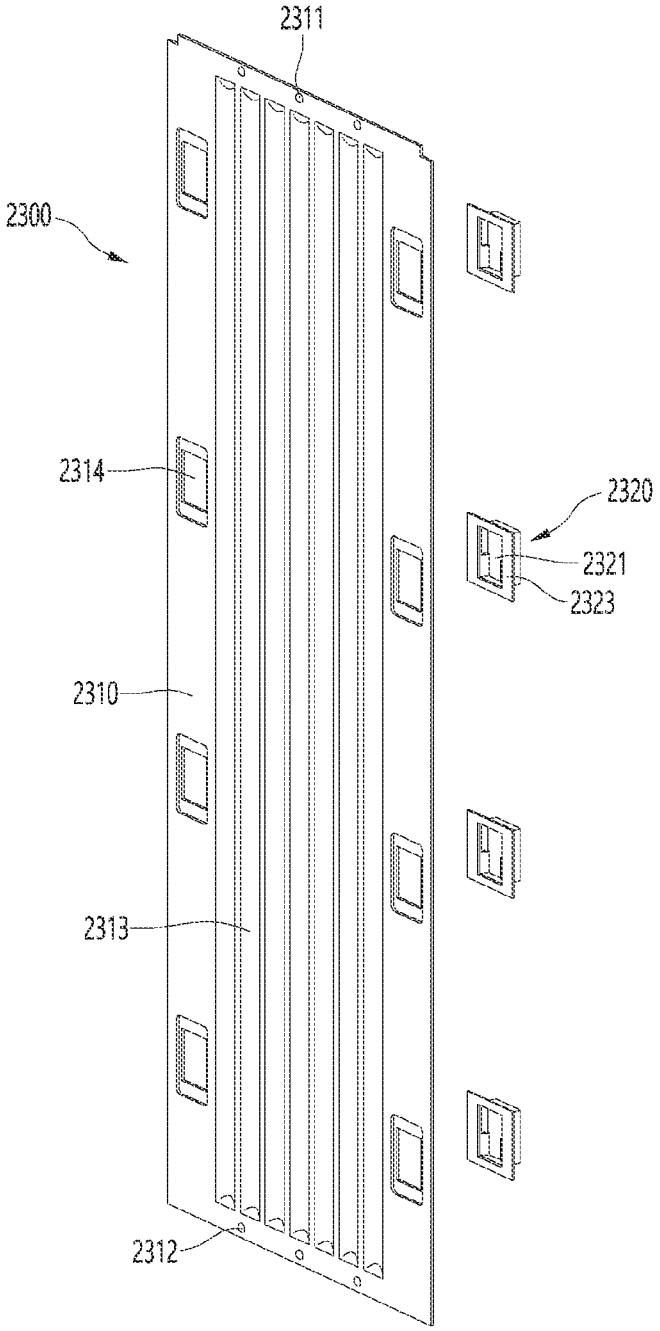
FIG. 56 is a perspective view of a front frame.
Figure 57:
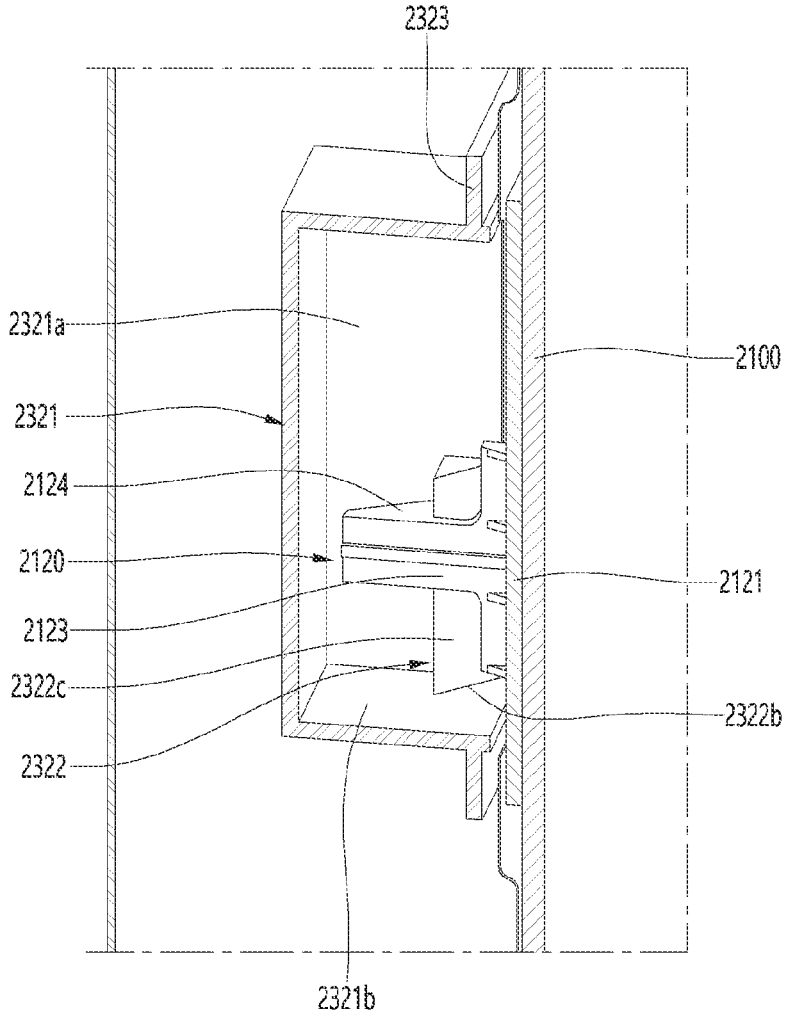
FIGS. 57 and 58 are cross-sectional views illustrating a state in which the front frame and the front panel are coupled to each other.
Figure 58:
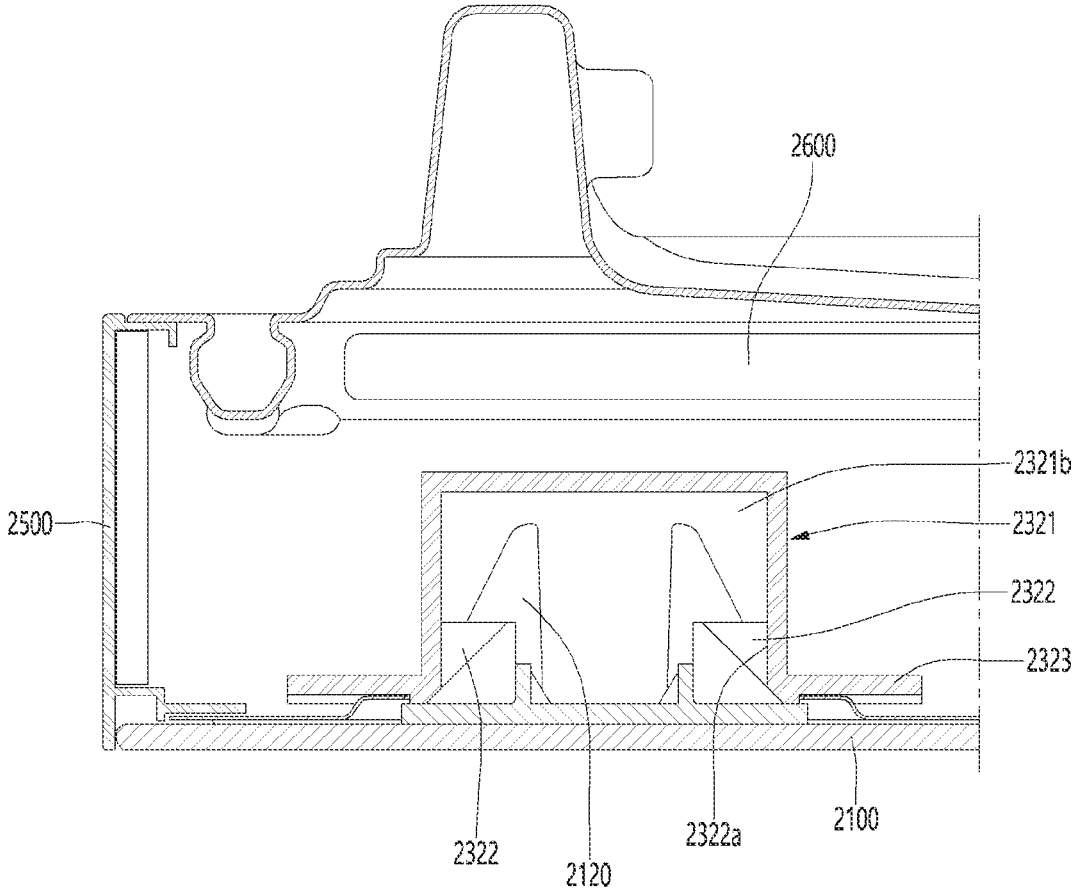

FIG. 56 is a perspective view of a front frame. FIGS. 57 and 58 are cross-sectional views illustrating a state in which the front frame and the front panel are coupled to each other.

The front frame 2300 and the coupling between the front frame 2300 and the second fixing portion 2120 will be described with reference to FIGS. 56 to 58.

The front frame 2300 may include a front plate 2310 that covers most of the front panel 2100.

An insulator may be filled between the front plate 2310 and the door liner 2600, and as the front plate 2310 prevents the insulator from being exposed, the insulator may be originally filled between the front panel and the door liner, unlike the front panel that could not be replaced, and thus, the front panel may be replaced.

The front plate 2310 may include a plurality of central recessed portions 2313 extending vertically. The central recessed portion 2313 may provide an unevenness so that the insulator is evenly filled in the thermal insulating space.

In addition, the front plate 2310 may further include an upper coupling portion 2311 coupled to the upper frame 2200 and a lower coupling portion 2312 coupled to the lower frame 2400.

In addition, the front plate 2310 may further include one or more holes 2314 (or frame openings) for providing a hook coupling portion 2320 to be described later.

The front plate 2310 and the hook coupling portion 2320 may be provided as one, or the hook coupling portion 2320 may be separately provided and attached to the front plate 2310.

The front frame 2300 may further include a hook coupling portion 2320 coupled to the second fixing portion 2120.

The hook coupling portion 2320 may be provided as a pair at left and right sides to correspond to the second fixing portion 2120 and may be disposed to correspond to the position of the second fixing portion 2120.

In this embodiment, the hook coupling portion 2320 may be referred to as an accommodation member.

In detail, the hook coupling portion 2320 may include a recessed portion 2321 which is recessed toward a rear side of the front plate 2310.

For example, the hook coupling portion 2320 may include an adhesion portion 2323 attached to surround the hole 2314 of the front plate 2310, and a recessed portion 2321 recessed from the adhesion portion 2323.

In detail, the recessed portion 2321 may be a hexahedral shape with one open surface, and the adhesion portion 2323 may be disposed on an edge of the opened one surface.

For example, the opened surface may correspond to the hole 2314 of the front plate 2310, and the inside of the recessed portion 2321 may be exposed to the front surface of the front plate 2310 through the hole 2314.

In addition, as the hook coupling portion 2320 is attached while covering the hole 2314 of the front plate 2310, the insulator may be prevented from leaking through the hole 2314.

A size of the hole 2314 of the front plate 2310 may correspond to a size of the opened surface of the recessed portion 2321, and an adhesive recessed portion 2314*a* that is in contact with the adhesion portion 2323 as an edge of the hole 2314 may be further included.

A rear surface of the adhesive recessed portion 2314*a* and the adhesion portion 2323 may adhere to each other by an adhesive means such as a tape, and the adhesive recessed portion 2314*a* may be recessed at a predetermined interval toward the rear side.

The adhesive recessed portion 2314*a* may serve to guide sliding of the second fixing portion 2120 when the second fixing portion 2120 and the hook coupling portion 2320 are separated from each other.

In detail, the second fixing portion 2120 may be slid only up to a portion at which the adhesive recessed portion 2314*a* is disposed.

In addition, the hook coupling portion 2320 may include an inclined protrusion 2322 provided in the recessed portion 2321.

The inclined protrusion 2322 may be a pair of protruding from both the side surfaces 2321*a* of the recessed portion 2321 and may protrude from both the side surfaces 2321*a* of the recessed portion 2321 having an inclination.

For example, the inclined protrusion 2322 may have a side surface 2322*a* and a lower surface 2322*b* that is in contact with an inner surface of the recessed portion 2321 and may extend vertically.

In addition, a top surface of the inclined protrusion 2322 may not be in contact with the inner surface of the recessed portion 2321.

In detail, a cross-section perpendicular to the extending direction of the inclined protrusion 2322 may be a right-angled triangle. For example, the side surface 2322*a* and the lower surface 2322*b* of the inclined protrusion 2322 may be connected to the side surface 2321*a* and the lower surface 2321*b* of the recessed portion 2321.

In addition, the inclined protrusions 2322 may be closer to each other from the front to the rear. In detail, the inclined protrusion 2322 may be a triangular prism having a cross-section at a right-angled triangle, and an inclined surface 2322*c* corresponding to a hypotenuse of the right-angled triangle may be exposed in front of the recessed portion 2321.

In detail, the inclined surface 2322*c* of the inclined protrusion 2322 may correspond to an outer surface of the hook portion 2124 of the second fixing portion 2120.

When the second fixing portion 2120 is coupled to the hook coupling portion 2320, slight force may be applied along the inclined surface 2322*c* of the inclined protrusion 2322 so as to be hook-coupled, and when the second fixing portion 2120 is separated from the hook coupling portion 2320, the second fixing portion 2120 may move to an upper side of the recessed portion 2321, in which the inclined protrusion 2322 is not provided, so that the hook coupling is easily released.

Referring to FIGS. 57 and 53, when the second fixing portion 2120 is coupled to the hook coupling portion 2320, the hook member 2122 of the second fixing portion 2120 is disposed inside to the hook coupling portion 2320.

In detail, in a state in which the front panel 2100 is fixed to the frame assembly 2000, the hook portion 2124 of the hook member 2122 may be hooked by the inclined protrusion 2322 of the hook coupling portion 2320, and thus, the second fixing portion 2120 and the front frame 2300 may not be separated from each other.

Figure 59:
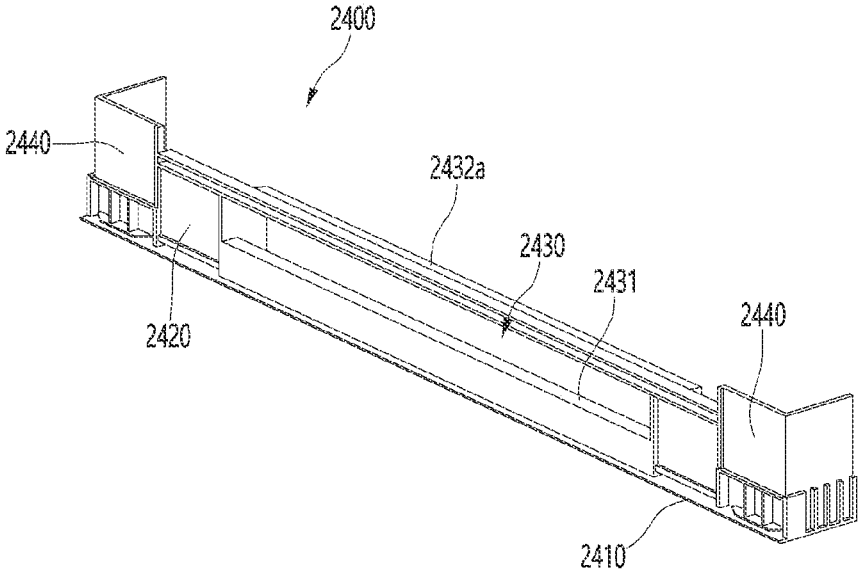
FIG. 59 is a perspective view of a lower frame.
Figure 60:
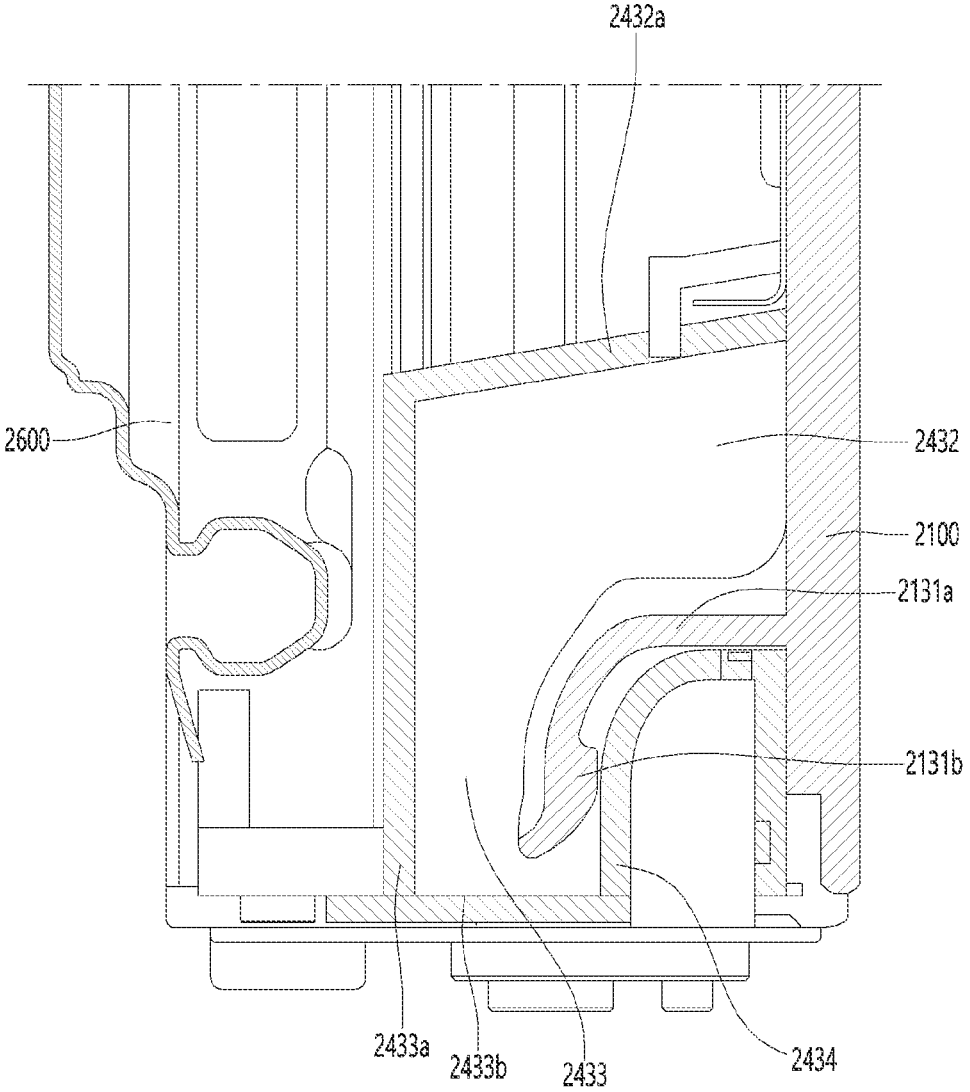
FIG. 60 is a cross-sectional view illustrating a process in which the lower frame and the front panel are coupled to each other.

FIG. 59 is a perspective view of the lower frame, and FIG. 60 is a cross-sectional view illustrating a process in which the lower frame and the front panel are coupled to each other.

The structure of the lower frame 2400 and the coupling between the lower frame 2400 and the third fixing portion 2130 will be described with reference to FIGS. 59 and 60.

The lower frame 2400 may be coupled to a lower portion of the front frame 2300, and the third fixing portion 2130 may be inserted.

In detail, the lower frame 2400 may include a lower recessed portion 2430 that is depressed from the front to the rear of the door 1912.

For example, the lower recessed portion 2430 may have a lower recessed portion inlet 2431 extending to left and right sides on the front surface 2420.

The lower recessed portion inlet 2431 may be spaced a predetermined interval from the lower surface 2410 of the lower frame 2400.

In addition, the lower recessed portion 2430 may include a first recessed portion 2432 extending from the lower recessed portion inlet 2431 toward the rear surface and a second recessed portion 2433 extending from the first recessed portion 2432 by being bent from the first recessed portion 1432.

For example, the first recessed portion 2433 may include a side surface 2432*a* extending from the lower recessed portion inlet 2431 toward the rear surface.

The second recessed portion 2433 may be bent from the side surface 2432*a* of the first recessed portion 2433 to extend toward the lower surface 2410 of the lower frame 2400.

In addition, the second recessed portion 2433 may further include a lower surface 2433*b* defining a portion of the lower surface 2410 of the lower frame 2400.

The first extension portion 2131*a* of the third fixing portion 2130 may be inserted into the first recessed portion 2432, and the second extension portion 2131*b* of the third fixing portion 2130 may be inserted into the second recessed portion 2433.

In addition, the lower recessed portion 2430 may further include a lower seating surface 2434 that supports the first extension portion 2131*a* of the third fixing portion 2130 in a state in which the third fixing portion 2130 is fixed.

In detail, the lower seating surface 2434 may include a first surface supporting the first extension portion 2131*a* of the third fixing portion 2130 and a second surface that is bent from the first surface to extend downward.

In addition, the lower frame 2400 may further include a frame coupling portion (not shown) coupled to the front frame 2300.

In addition, both ends 2440 to which a hinge (not shown) or a magnet (not shown) for opening and closing the door 1912 are coupled may be provided on both sides of the lower frame 2400.

In detail, one of both the ends 2440 of the lower frame 2400 may be provided with a hinge, and the other may be provided with a magnet, which may vary depending on which any side of the left and right sides of the refrigerator door 1912 is coupled.

Referring to FIG. 60, when the front panel 2100 and the frame assembly 2000 are coupled to each other, the third fixing portion 2130 is inserted into the lower frame 2400.

In detail, the first extension portion 2131*a* of the third fixing portion 2130 may be supported on an upper end of the lower seat surface 2434 of the lower frame 2400.

In addition, the first extension portion 2131*a* of the third fixing portion 2130 may be disposed in the first recessed portion 2432 of the lower frame 2400, and the second extension portion 2131*b* of the third fixing portion 2130 may be disposed in the second recessed portion 2433 of the lower frame 400.

Figure 61:
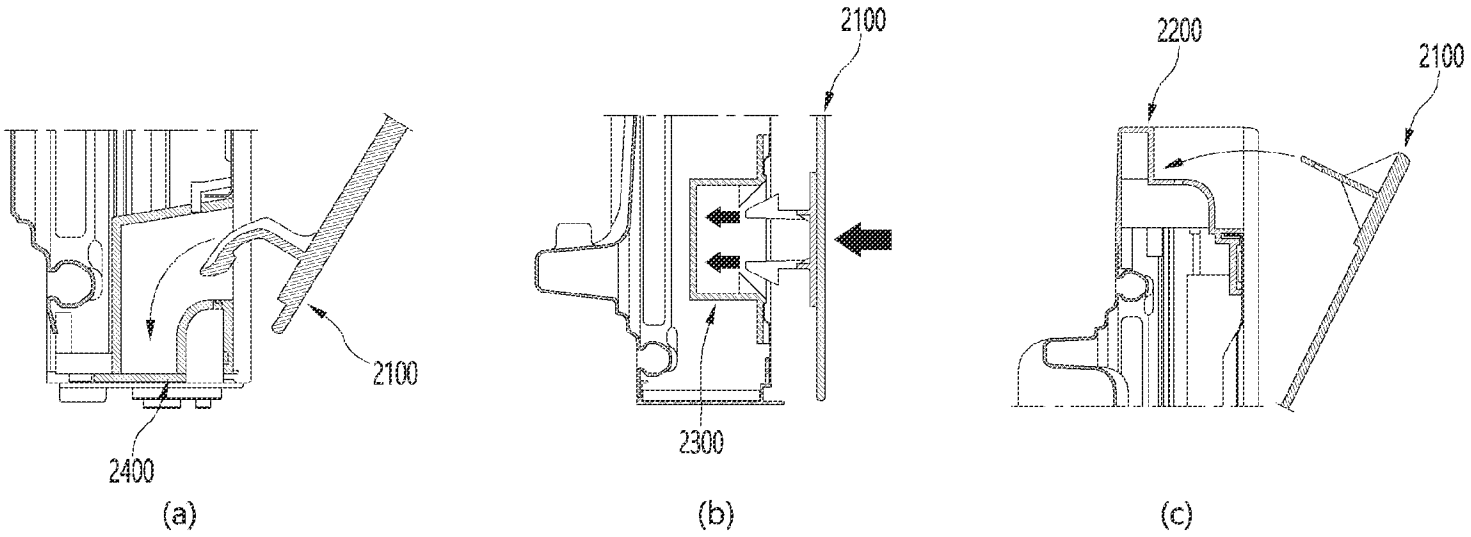
FIG. 61 is a view illustrating a process in which the front panel and the frame assembly are coupled to each other.
Figure 62:
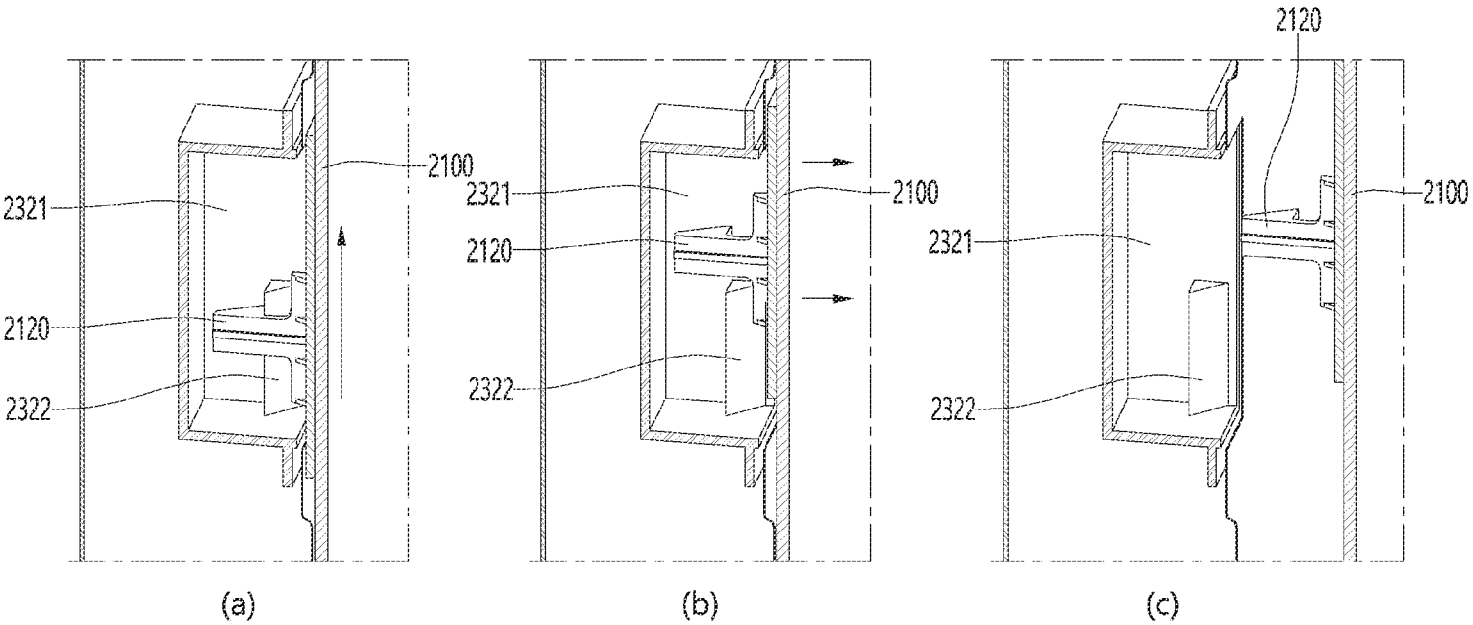
FIG. 62 is a view illustrating a process in which the front panel and the front frame are separated from each other.

FIG. 61 is a view illustrating a process in which the front panel and the frame assembly are coupled to each other, and FIG. 62 is a view illustrating a process in which the front panel and the front frame are separated from each other.

Coupling and separation of the front panel 2100 and the frame assembly 2000 will be described in detail with reference to FIGS. 61 and 62.

First, the coupling between the front panel 2100 and the frame assembly 2000 will be described.

The third fixing portion 2130 of the front panel 2100 may be inserted into the lower recessed portion 2430 of the lower frame 2400. Here, since each of the third fixing portion 2130 and the lower recessed portion 2430 has a shape including a bent portion, the front panel 2100 may be inserted in a state in which an upper portion is inclined to a front surface at a predetermined interval.

After inserting the third fixing portion 2130 of the front panel 2100 into the lower recessed portion 2430, the front panel 2100 may rotate around the third fixing portion 2130 while rotating the front surface, and thus, the upper end of the panel 2100 may approach the frame assembly 2000.

Here, certain force may be applied to the front surface of the front panel 2100 so that the second fixing portion 2130 is hook-coupled to the hook coupling portion 2320.

The second fixing portion 2130 is made of a material having predetermined elasticity, and while moving along the inclined surface 2322*c* of the inclined protrusion 2322 of the hook coupling portion 2320, the hook portion 2124 of the second fixing portion 2130 and the inclined protrusion 2322 may be locked with respect to each other.

In addition, when the hook portion 2124 and the inclined protrusion 2322 are coupled to each other, if predetermined force is applied by the inclination of the hook portion 2124 and the inclined protrusion 2322, the locking may be realized. However, when the hook portion 2124 is inserted between the recessed portion 2321 and the inclined protrusion 2322, the recessed portion 1321 may be fixed forward and backward by an interference between the hook portion 2124 and the inclined protrusion 2322.

That is, each of the second fixing portion 2130 and the inclined protrusion 2322 may have a snap-fit shape.

When the hook coupling is performed from the lower portion of the front panel 2100 toward the upper portion, the first fixing portion 2110 may be seated on the front panel support portion 2220 of the upper frame 2200. Thereafter, the front panel 2100 may be finally fixed by using a screw S.

A process of separating the front panel 2100 from the frame assembly 2000 for replacement of the front panel 2100 will be described with reference to FIG. 62.

First, after removing the screw fixing the first fixing portion 2110 and the upper frame 2200, the user slides the front panel 2100 upward.

When the front panel 2100 moves by being slid upward, the second fixing portion 2120 may move to the upper side of the hook coupling portion 2320, and the locking with the inclination protrusion 2322 provided at the lower side of the hook coupling portion 2320 may be released.

In detail, an upper end of the plate 2121 of the second fixing portion 2120 may be slid to the upper end of the adhesive recessed portion 2314*a* of the front frame 2300, and when hooked on a protrusion of the adhesive recessed portion 2314*a*, the locking between the second fixing portion 2120 and the hook coupling portion 2320 may be released.

Thereafter, if the front panel 2100 moves forward, the hook coupling may be easily released. Through this, when the front panel 2100 is coupled, the front panel may be easily fixed and may be firmly maintained to be fixed through the hook coupling, and when the front panel 2100 is separated, the hook coupling may be easily released.

The invention claimed is:

1. A refrigerator comprising:

a cabinet that defines a storage space; and a door configured to open and close at least a portion of the storage space, wherein the door comprises:

a frame assembly in which an insulator is provided, and a panel assembly detachably coupled to the frame assembly and configured to define an outer appearance of a front surface of the door, wherein the panel assembly comprises:

a panel, and a lower bent portion that is bent from a lower end of the panel and that defines an opening, at least a portion of the lower bent portion extending rearward from the lower end of the panel, wherein the frame assembly comprises:

a front frame, an upper frame connected to an upper portion of the front frame, a lower frame connected to a lower portion of the front frame, a support end that extends forward from a front surface of the lower frame, and a protrusion that extends upward from the support end and that is configured to pass through the opening of the lower bent portion in a state in which the lower bent portion is supported on the support end, wherein, in the state in which the lower bent portion is supported on the support end, an upper portion of the panel assembly is configured to be fixed to the upper frame of the frame assembly, wherein the protrusion is configured to be taken out from the opening of the lower bent portion while the panel assembly is detached from the frame assembly, wherein the opening of the lower bent portion includes a first end and a second end, the first end being positioned closer to a rear surface of the panel than the second end, and wherein a distance from the second end to an end of the lower bent portion is greater than a distance from the first end to the rear surface of the panel.

2. The refrigerator of claim 1, wherein the panel is made of a metal material and has a planar shape.

3. The refrigerator of claim 1, wherein the protrusion is one of a plurality of protrusions that extend upward from the support end, and wherein the opening is one of a plurality of openings that are arranged along the lower bent portion and that are defined at positions corresponding to the plurality of protrusions.

4. The refrigerator of claim 1, wherein the panel assembly further comprises:

an upper bent portion that is bent rearward from an upper end of the panel; and side bent portions disposed at left and right ends of the panel.

5. The refrigerator of claim 4, wherein the upper bent portion comprises:

a first bent portion that is bent rearward from the upper end of the panel; and a second bent portion that is bent downward from an end of the first bent portion.

6. The refrigerator of claim 1, wherein the panel assembly further comprises an upper bracket disposed at an upper portion of the rear surface of the panel and configured to couple to the upper frame.

7. The refrigerator of claim 6, wherein the upper bracket comprises:

an upper adhesion portion attached to the rear surface of the panel; and an upper coupling protrusion that protrudes rearward from the upper adhesion portion, and wherein the upper frame comprises:

an upper coupling portion that accommodates the upper coupling protrusion of the upper bracket, and an upper coupling member that passes through the upper coupling portion and that is coupled to the upper coupling protrusion of the upper bracket.

8. The refrigerator of claim 1, wherein the panel assembly further comprises a lower bracket that defines a lower insertion portion configured to receive the protrusion.

9. The refrigerator of claim 1, wherein the lower bent portion comprises (i) a first portion having a first extension length from the panel in a first direction, and (ii) a second portion having a second extension length from the panel in the first direction, wherein the second extension length is greater than the first extension length, and wherein the opening is defined at the second portion.

10. The refrigerator of claim 1, wherein the storage space comprises an upper storage space and a lower storage space, wherein the door comprises:

a first door configured to open and close the upper storage space; and a second door disposed at a lower side of the first door and configured to open and close the lower storage space, and wherein the first door comprises the frame assembly and the panel assembly.

11. A refrigerator comprising:

a cabinet that defines a storage space; and a door configured to open and close at least a portion of the storage space, wherein the door comprises:

a frame assembly in which an insulator is provided, and a panel assembly detachably coupled to the frame assembly and configured to define an outer appearance of a front surface of the door, wherein the frame assembly comprises:

a front frame, an upper frame connected to an upper portion of the front frame, a lower frame connected to a lower portion of the front frame, a support end that extends forward from a front surface of the lower frame, and a protrusion that extends upward from the support end, wherein the panel assembly comprises:

a panel, and a lower bent portion that is bent from a lower end of the panel and that defines a protrusion hole configured to receive the protrusion, wherein the protrusion is configured to pass through the protrusion hole in a state in which the lower bent portion is supported on the support end, wherein, in the state in which the lower bent portion is supported on the support end, an upper portion of the panel assembly is configured to be fixed to the upper frame, wherein a distance from the front surface of the lower frame to the panel is greater than a distance from the front surface of the lower frame to an edge of the support end such that the panel protrudes forward relative to the edge of the support end, wherein the protrusion is configured to be taken out from the protrusion hole of the lower bent portion while the panel assembly is detached from the frame assembly, wherein the protrusion hole of the lower bent portion includes a first end and a second end, the first end being positioned closer to a rear surface of the panel than the second end, and wherein a distance from the second end to an end of the lower bent portion is greater than a distance from the first end to the rear surface of the panel.

12. The refrigerator of claim 11, wherein the panel is made of a metal material and has a planar shape.

13. The refrigerator of claim 11, wherein the protrusion is one of a plurality of protrusions that protrude upward from the support end, wherein the protrusion hole is one a plurality of protrusion holes that are arranged along the lower bent portion and that are defined at positions corresponding to the plurality of protrusions.

14. The refrigerator of claim 11, wherein the lower bent portion comprises (i) a first portion having a first extension length from the panel in a first direction, and (ii) a second portion having a second extension length from the panel in the first direction, wherein the second extension length is greater than the first extension length, and wherein the protrusion hole is defined at the second portion.

15. The refrigerator of claim 11, wherein the panel assembly further comprises:

an upper bent portion that is bent rearward from an upper end of the panel; and side bent portions disposed at both left and right ends of the panel.

16. The refrigerator of claim 11, wherein the storage space comprises an upper storage space and a lower storage space, wherein the door comprises:

a first door configured to open and close the upper storage space; and a second door disposed at a lower side of the first door and configured to open and close the lower storage space, and wherein the first door comprises the frame assembly and the panel assembly.

17. A refrigerator comprising:

a cabinet that defines a storage space; and a door configured to open and close at least a portion of the storage space, wherein the door comprises:

a frame assembly in which an insulator is provided, and a panel assembly detachably coupled to the frame assembly and configured to define an outer appearance of a front surface of the door, wherein the frame assembly comprises:

a front frame, an upper frame connected to an upper portion of the front frame, a lower frame connected to a lower portion of the front frame, a support end that extends from the lower frame in a first direction, and a protrusion that extends from the support end in a second direction crossing the first direction, wherein the panel assembly comprises:

a panel, and a lower bent portion that extends from a lower end of the panel along the first direction and that defines an opening configured to receive the protrusion, at least a portion of the lower bent portion extending rearward from the lower end of the panel, wherein the protrusion is configured to pass through the opening of the lower bent portion in a state in which the lower bent portion is supported on the support end, wherein, in the state in which the lower bent portion is supported on the support end, an upper portion of the panel assembly is configured to be fixed to the upper frame, and a portion of the lower bent portion is disposed between the panel and the protrusion in the first direction, wherein the lower bent portion is in contact with an upper surface of the support end, wherein the protrusion is configured to be taken out from the opening of the lower bent portion while the panel assembly is detached from the frame assembly, wherein the opening of the lower bent portion includes a first end and a second end, the first end being positioned closer to a rear surface of the panel than the second end, and wherein a distance from the second end to an end of the lower bent portion is greater than a distance from the first end to the rear surface of the panel.

18. The refrigerator of claim 17, wherein a length of the opening in a third direction crossing the first and second directions is greater than a length of the portion of the lower bent portion in the first direction.

19. The refrigerator of claim 18, wherein each of the first direction and the third direction is a horizontal direction, and the second direction is a vertical direction.

20. The refrigerator of claim 17, wherein the lower bent portion comprises (i) a first portion having a first extension length from the panel in the first direction, and (ii) a second portion having a second extension length from the panel in the first direction, wherein the second extension length is greater than the first extension length, and wherein the opening is defined at the second portion.

* * * * *